US007869746B2

(12) United States Patent
Itoh et al.

(10) Patent No.: US 7,869,746 B2
(45) Date of Patent: Jan. 11, 2011

(54) IMAGE FORMING DEVICE, POWDER SUPPLY DEVICE, AND POWDER STORAGE UNIT INCLUDING A GAS SUPPLYING UNIT

(75) Inventors: Fumihito Itoh, Kanagawa (JP); Hirosato Amano, Shizuoka (JP); Kazuhisa Sudo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 61 days.

(21) Appl. No.: 11/683,253

(22) Filed: Mar. 7, 2007

(65) Prior Publication Data

US 2007/0212116 A1 Sep. 13, 2007

(30) Foreign Application Priority Data

Mar. 10, 2006 (JP) ..... 2006-065749
Mar. 10, 2006 (JP) ..... 2006-066772
Mar. 15, 2006 (JP) ..... 2006-071882

(51) Int. Cl.
*G03G 15/08* (2006.01)

(52) U.S. Cl. ..... 399/258

(58) Field of Classification Search ..... 399/258, 399/260, 262, 119
See application file for complete search history.

(56) References Cited

U.S. PATENT DOCUMENTS 5,950,055 A 9/1999 Yahata et al.
5,950,062 A 9/1999 Yahata et al.
6,393,241 B1 5/2002 Matsumoto et al.
6,501,913 B2 12/2002 Hattori et al.
6,577,842 B2 6/2003 Akiba et al.
6,591,077 B2 7/2003 Yanagisawa et al.
6,628,908 B2 9/2003 Matsumoto et al.
6,648,029 B1 11/2003 Amano
6,665,508 B2 12/2003 Sudo et al.
6,679,301 B2 1/2004 Makino et al.
6,775,503 B2 8/2004 Hattori et al.
6,826,381 B2 11/2004 Muramatsu et al.

(Continued)

FOREIGN PATENT DOCUMENTS

JP 61-100564 8/1986

(Continued)

OTHER PUBLICATIONS computer translation of jp2000-053314a to Ueda et al.*

(Continued)

*Primary Examiner*—Quana M Grainger
(74) *Attorney, Agent, or Firm*—Oblon, Spivak, McClelland, Maier & Neustadt, L.L.P.

(57) ABSTRACT

In an image forming device including an image support object which supports an electrostatic latent image, and a developing device which turns the electrostatic latent image formed on the surface of the image support object, into a visible image with toner, a powder storing unit stores powder for image formation which is either a developing agent containing a toner and a carrier or a toner. A powder supplying unit supplies the powder stored in the powder storing unit, to the developing device. The powder storing unit includes a gas supplying unit which blows off a gas from an exhaust outlet of the gas supplying unit into the powder storing unit, and a powder passage which allows the powder storing unit to communicate with the developing device.

16 Claims, 48 Drawing Sheets

U.S. PATENT DOCUMENTS

| | | | | |
|---|---|---|---|---|
| 6,859,634 | B2 | 2/2005 | Itoh et al. | |
| 6,863,096 | B2 | 3/2005 | Amano | |
| 6,874,546 | B2 | 4/2005 | Amano et al. | |
| 6,981,530 | B2 | 1/2006 | Amano et al. | |
| 7,017,625 | B2 | 3/2006 | Amano et al. | |
| 2003/0016966 | A1* | 1/2003 | Hattori et al. | 399/258 |
| 2003/0198487 | A1* | 10/2003 | Yanagisawa et al. | 399/258 |
| 2004/0037592 | A1* | 2/2004 | Hiura et al. | 399/258 |
| 2005/0163537 | A1* | 7/2005 | Muramatsu et al. | 399/258 |
| 2005/0244193 | A1* | 11/2005 | Amano et al. | 399/258 |
| 2006/0034627 | A1* | 2/2006 | Kikuchi et al. | 399/24 |
| 2006/0133850 | A1* | 6/2006 | Nishimura | 399/113 |

FOREIGN PATENT DOCUMENTS

| | | | |
|---|---|---|---|
| JP | 4-34480 | | 2/1992 |
| JP | 4-198966 | | 7/1992 |
| JP | 8-6349 | | 1/1996 |
| JP | 8-339102 | | 12/1996 |
| JP | 10-221939 | | 8/1998 |
| JP | 11-78370 | | 3/1999 |
| JP | 11-212348 | | 8/1999 |
| JP | 11-348359 | | 12/1999 |
| JP | 2000-19830 | | 1/2000 |
| JP | 2000053314 | A * | 2/2000 |
| JP | 2002-139902 | | 5/2002 |
| JP | 2002-293301 | | 10/2002 |
| JP | 2005-24622 | | 1/2005 |
| JP | 2005-215655 | | 8/2005 |
| JP | 2005-291464 | | 10/2005 |
| JP | 2005-292300 | | 10/2005 |
| JP | 2006-47972 | | 2/2006 |
| JP | 2006-48009 | | 2/2006 |
| JP | 2006-48010 | | 2/2006 |

OTHER PUBLICATIONS

Computer translation of JP2000-053314a to Ueda et al.; Feb. 2000 (included in OA Jan. 5, 2010).*
U.S. Appl. No. 11/679,949, filed Feb. 28, 2007, Sano, et al.
U.S. Appl. No. 11/679,964, filed Feb. 28, 2007, Sano, et al.
U.S. Appl. No. 10/549,918, filed Sep. 20, 2005, Amano.
U.S. Appl. No. 11/911,598, filed Oct. 15, 2007, Sano, et al.
U.S. Appl. No. 11/683,656, filed Mar. 8, 2007, Itoh, et al.

* cited by examiner

IMAGE FORMING DEVICE, POWDER SUPPLY DEVICE, AND POWDER STORAGE UNIT INCLUDING A GAS SUPPLYING UNIT

BACKGROUND OF THE INVENTION

1. Field of the Invention

This invention generally relates to an image forming device, such as a copier, a facsimile and a printer, and more particularly to an image forming device which is provided with a developing device for developing a latent image on an image support object, as well as with a powder storing unit for storing powder for image formation to be supplied to the developing device.

2. Description of the Related Art

An electrophotographic printing system is one of image forming systems and many copiers, printers and facsimiles are provided as image forming devices using the electrophotographic printing system.

In the electrophotographic printing system, an electrostatic latent image is formed by exposure of a uniformly charged surface of a photoconductor (which is an image support object) to optical writing, etc. This electrostatic latent image is visualized using either a toner of a two-component developing agent in which a magnetic carrier and a toner are mixed or a one-component developing agent in which both are unified, and the visible image is transferred to a recording medium so that the copy image is obtained.

The developing agent used for visible image processing is consumed in accordance with performance of the visible image processing. When the consumed amount exceeds a predetermined amount, the supply of a developing agent to the image forming device is needed.

For example, in the case of the two-component developing agent, the amount of the toner is decreased with time, the density of the toner in the developing agent in the developing device falls. As a result, a desired image concentration is no longer obtained. To avoid this, a toner supplying part is provided in the developing device of the image forming device so that, when the toner density in the developing agent is below a predetermined value, the toner is supplied to the developing device, and the condition that the toner density in the developing agent is stabilized is maintained.

The toner supplying part is provided in the developing device to store a predetermined amount of toner, and supplies the toner to the developing agent according to change of the toner density in the developing agent.

The size of the toner supplying part provided in the developing device is usually made comparatively small in order to prevent enlargement of the image forming device. Generally, in the case of the developing device of the above-mentioned structure, when the toner stored in the toner supplying part is consumed completely, exchange of the toner supplying part will be performed by taking the toner supplying part out of the developing device.

However, at the time of exchange of the toner supplying part, operation of the image forming device is suspended temporarily, and the useless time to stop the image formation operation is required for the exchange work and the restart of the image forming device.

It is desirable to prevent such situations and to shorten the operation stop time of the image forming device. To attain this, there is proposed a developing agent supplying device in which a toner container part adapted for storing a comparatively large amount of toner is provided, and this toner container part is connected to a developing device. In this developing agent supplying device, the toner is supplied in accordance with the amount of the toner remaining in the toner supplying part provided in the developing device. For example, refer to Japanese Laid-Open Patent Application No. 61-188564.

However, when the toner storing unit having a large capacity for storing toner is used, the toner stored inside may be condensed, and there is a problem that it is difficult to smoothly transport the toner to the developing area.

To obviate the problem, Japanese Laid-Open Patent Application No. 2002-139902 discloses a toner supplying device in which a toner storing container is provided at its lower edge with an opening, and a shaft-like connector is provided so that the connector is detachably attached to the toner storing container through the opening in accordance with attachment of the toner storing container to the image forming device body.

In the toner supplying device of Japanese Laid-Open Patent Application No. 2002-139902, the toner stored in the toner storing container is supplied to the developing device through the connector. In the connector, a toner passage through which the toner supplied to the developing device passes is provided, and an air passage which communicates with an air supply unit is connected to an intermediate part of the toner passage.

Namely, in the method of Japanese Laid-Open Patent Application No. 2002-139902, air is supplied from the air pump (air supply unit) to the toner storing container, and it is possible to keep the fluidity of the toner in the toner storing container. And the air supplied through the air passage is not easily returned back to the toner exhaust part in the downstream direction, and it is possible to prevent occurrence of the toner clogging in the transfer tube.

However, in the method of Japanese Laid-Open Patent Application No. 2002-139902, the fluidity of the toner existing near the air exhaust outlet in the toner storing container is maintained, fully secured, but a sufficient amount of air is not supplied to the toner existing at the location distant from the air exhaust outlet. The toner existing at the location distant from the air exhaust outlet may be condensed. Especially, when the capacity of the toner storing container is enlarged, it is difficult to keep good fluidity of the whole toner stored in the toner storing container over a long period of time. If the toner inside the storing container is condensed, the condensed toner may be accumulated in the transport passage for supplying the toner to the developing device, and the speed of transporting the toner may be lowered.

In the structure of Japanese Laid-Open Patent Application No. 61-188564, the development processing part and the toner supplying part are connected together by a pipe in the developing device, and the toner is transported to the development processing part by using the coil screw provided in the pipe.

There is also a structure of different type in which the toner is dropped to the inside of the developing device by its own gravity, without using the coil screw, and the toner is supplied to the development processing part.

However, the above-mentioned structure is attached to the developing device provided in the image forming device and the case in which the toner supplying part is installed in the developing device is included, and the space in which the developing part occupied in the image forming device becomes large, and enlargement and complication of the image forming device are not avoided.

In recent years, effective use of resource materials is demanded, and reuse of the toner collected by the cleaning device which collects the toner remaining on the surface of the photoconductor and the transporting unit is demanded.

In this case, there is a structure in which the toner collected by the cleaning device is temporarily stored in a recovery toner storage device and the stored toner is transported to the toner storing unit or the developing device, or a structure in which a recovery toner discharging part is provided in the cleaning device, and the toner from recovery toner discharging part is transported to the toner storing unit or the developing device.

However, in the case of the image forming device in which the toner collected by the cleaning device is transported to the toner storing unit or the developing device, it is likely to cause enlargement and complication of the image forming device. Generally, the transport of the collected toner between the recovery toner storage device and the toner storing unit is carried out by connecting together the recovery toner storage device and the toner storage unit by using a pipe in which a transporting screw (or coil screw) is provided therein, similar to the transporting unit between the developing device and the toner storing unit.

Namely, in the case of the coil screw, it is necessary to arrange it in the vicinity of the developing device or the recovery toner storage device. And it is necessary to provide a powder transport passage, such as a straight-line transport passage or a curved-line transport passage with a large radius of curvature, in order to ensure accurate and safe rotation of the coil screw.

Thus, if many components are installed inside the image forming device, the degree of freedom of arrangement of the respective components will be reduced because of the layout restrictions in the image forming device, and enlargement and complication of the image forming device will not be avoided.

If the image forming device is enlarged or complicated, the problem of the space for installation of the image forming device arises and the operability in the maintenance of exchange of the toner storing unit etc. gets worse. And there is also a problem that the operation stop time of the image forming device is increased accompanied with the maintenance of the image forming device.

To obviate the problems, there is also proposed a structure in which the toner storing unit is installed outside the image forming device (not the inside of the image forming device) and separately from the developing device, and the powder storing unit and the developing device are connected together by a connecting member, such as a pipe in which a transporting screw is provided inside, so that the toner from the toner storing unit is transported to the developing device. For example, refer to Japanese Laid-Open Patent Application No. 04-198966.

In the case of the above structure, the problem of the operation stop time increase may be reduced by enlarging the storing capacity of the toner storing unit and decreasing the exchange frequency of the toner storing unit.

However, in the structure of Japanese Laid-Open Patent Application No. 04-198966, when the toner storing unit is installed outside the image forming device, the transport passage from the toner storing unit to the developing unit is usually excessively long. If the transport passage of toner is excessively long, the toner may stagnate within the transport passage and a problem that the transporting speed of the toner be decreased may arise. On the other hand, it is also necessary that the supply of toner to the development hopper or the developing device is performed while the toner amount adjustment is performed.

However, if the transport passage of toner is excessively long, it is difficult to perform the supply of toner while performing the toner amount adjustment accurately, and it will be difficult to perform the supply of toner appropriately. That is, it will be difficult to carry out efficient and exact supply of toner from the toner storing unit to the developing device in the case of the structure of Japanese Laid-Open Patent Application No. 04-198966.

Also in the case of the toner storing unit installed inside the image forming device, many components, such as a drive unit of the photoconductor and a drive unit of the developing unit, must be arranged around the developing device. When a large-capacity toner storing unit is used, it is desired to install the toner storing unit at a location distant to some extent from the developing device, the same problem as in the above-mentioned case of the toner storing unit installed outside the image forming device will arise.

SUMMARY OF THE INVENTION

According to one aspect of the invention, there is provided an improved image forming device in which the above-described problems are eliminated.

According to one aspect of the invention there is provided an image forming device which is adapted for reducing the exchange frequency of the toner storing unit, shortening the operation stop time can be shortened, and preventing the toner from stagnating in the transport passage when the toner is supplied from the toner storing unit to the developing device, in order to perform efficient and smooth supply of the toner.

According to one aspect of the invention there is provided a powder storing unit which is adapted for storing an adequately large amount of powder and ensuring efficient and safe supply of powder to the powder receiving unit.

According to one aspect of the invention, there are provided a powder supply device and an image forming device which are adapted to ensure little exchange work and allow large-capacity storage of powder without giving damage to powder.

In an embodiment of the invention which solves or reduces one or more of the above-mentioned problems, there is provided an image forming device including an image support object which supports an electrostatic latent image, and a developing device which turns the electrostatic latent image formed on the surface of the image support object, into a visible image with toner, the image forming device comprising: a powder storing unit storing powder for image formation which is either a developing agent containing a toner and a carrier or a toner; and a powder supplying unit supplying the powder stored in the powder storing unit, to the developing device, the powder storing unit comprising: a gas supplying unit blowing off a gas from an exhaust outlet of the gas supplying unit into the powder storing unit; and a powder passage allowing the powder storing unit to communicate with the developing device.

In an embodiment of the invention which solves or reduces one or more of the above-mentioned problems, there is provided a powder storing unit for use in a powder supply device which transports powder to a powder receiving device by mixing the powder to an air flow, the powder storing unit comprising: a powder storing part in which powder is stored; an opening for supplementing powder to an internal space of the powder storing part; an opening/closing unit for allowing or inhibiting communication of the internal space of the powder storing part with an outside through the opening; and a restricting unit preventing removal of the opening/closing unit from the powder storing unit from being performed by an unauthorized user.

In an embodiment of the invention which solves or reduces one or more of the above-mentioned problems, there is provided a powder supply device which supplies powder for image formation to an image forming device, the powder supply device comprising: a powder storing unit storing powder for image formation; and a container unit accommodating the powder storing unit, the container unit being constituted to be integral with or separate from the image forming device, wherein the powder storing unit is arranged so that the powder storing unit is detachably connected to a powder transporting unit transporting the powder, stored in the powder storing unit, in a state where the powder is mixed with air, to the image forming device, wherein the powder storing unit comprises an electronic information recording unit recording electronic information related to the powder storing unit, and the container unit comprises an electronic information transmitting unit transmitting the electronic information received from the powder storing unit.

According to the embodiments of the invention, it is possible to reduce the exchange frequency of the toner storing unit and shorten the operation stop time substantially, without causing enlargement of the image forming device, and it is possible to provide an image forming device which can transport toner from the toner storing unit to the developing device smoothly.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will be given of embodiments of the invention with reference to the accompanying drawings.

Figure 1:
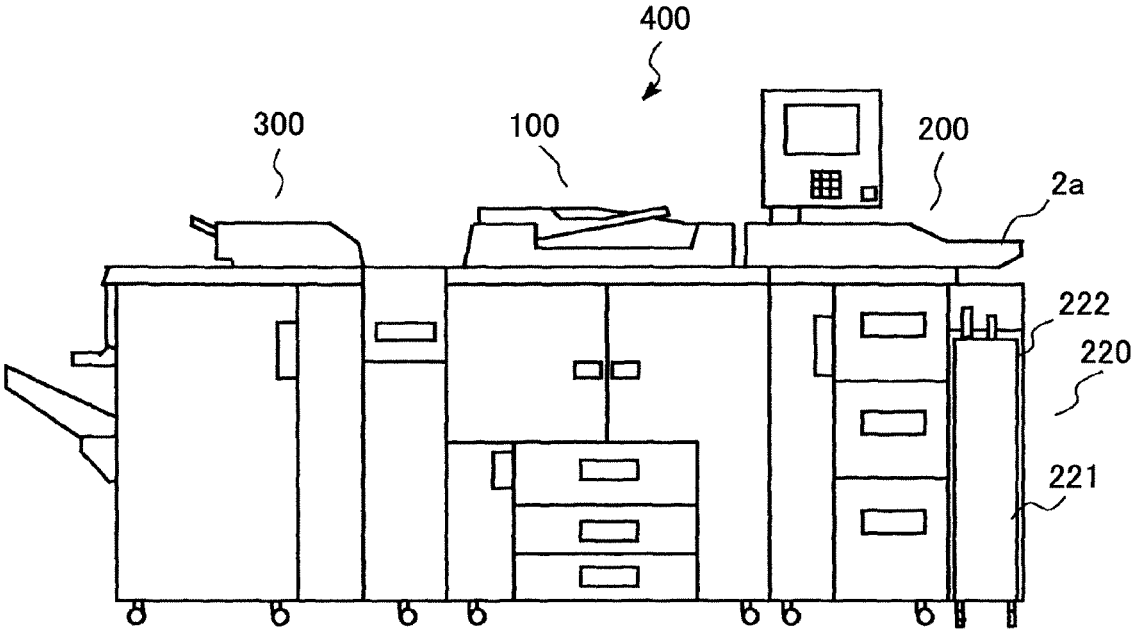
FIG. 1 is a diagram showing the composition of an image formation unit provided with an image forming device in an embodiment of the invention.

FIG. 1 is a schematic diagram showing the composition of an image forming device in an embodiment of the invention.

As shown in FIG. 1, an image-forming unit 100 is provided in the middle of an image formation system 400, and a sheet feeding unit 200 is provided on the right side of the image-forming unit 100. In this embodiment, the image-forming unit 100 is an image forming device using the electrophotographic printing method to form a fixed image using a toner. In the sheet feeding unit 200, a wing 2*a* is provided as a paper feed tray projecting from the right side, and a toner storing unit 220 which stores the toner used by the image-forming unit 100 is provided below the bottom of the wing 2*a*.

The toner storing unit 200 is connected with the image-forming unit 100 by the transport passage (not illustrated), and the toner stored in the toner storing unit 200 is supplied to the image-forming unit 100 by a powder supply device (which will be described later).

Although the installing location of the toner storing unit 220 in the image formation system 400 may be set up arbitrarily, the space below the wing 2*a* can be effectively used by installing the toner storing unit 220 as shown in FIG. 1. Provided in the left-hand side of the image-forming unit 100 in FIG. 1 is a post processing unit 300 for performing sorting, a stapler fixing, etc.

Figure 2:
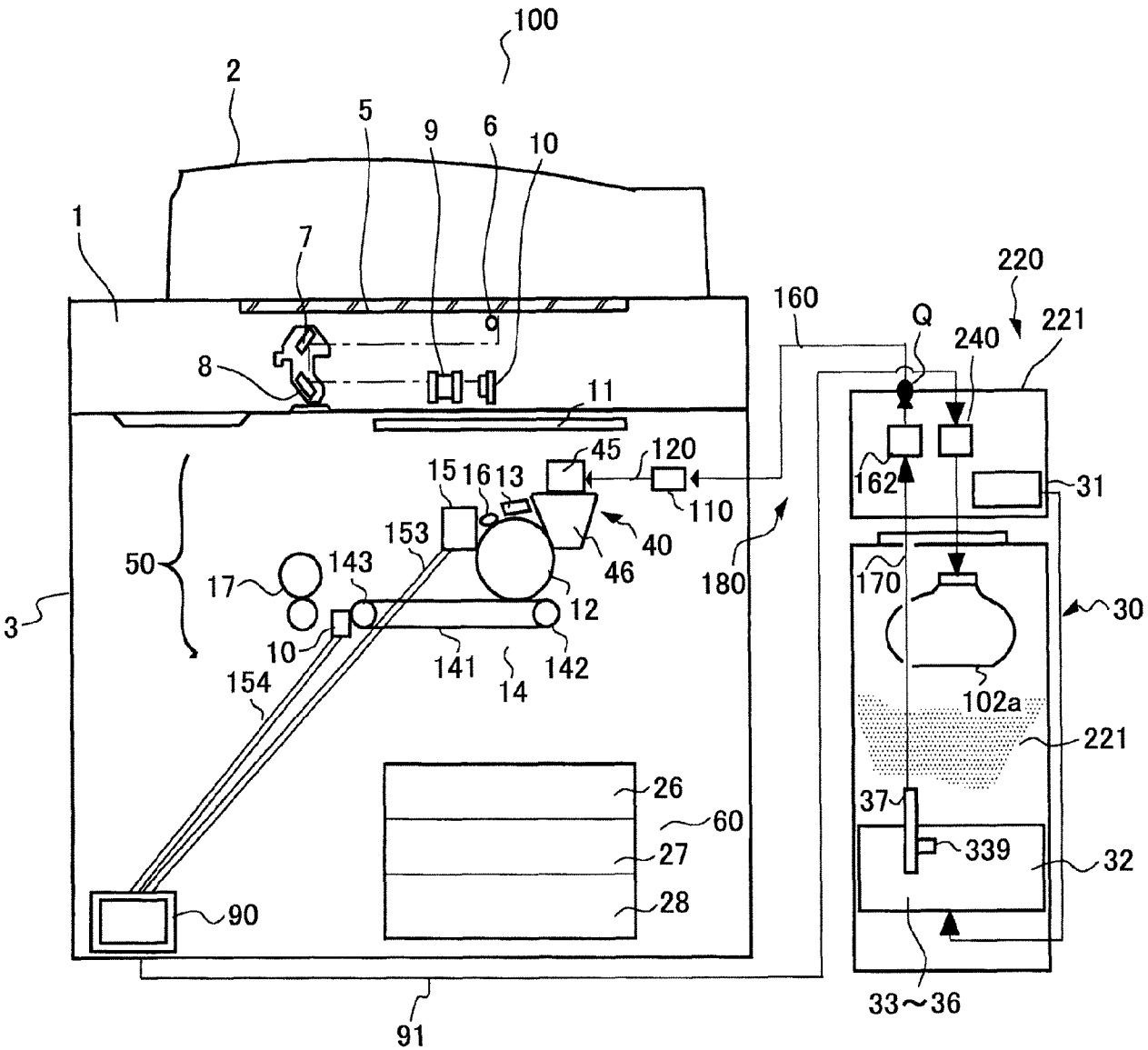
FIG. 2 is a diagram showing the structure of the image forming device and a toner storing unit in this embodiment.

Next, the structure of the toner storing unit 220 provided near the image-forming unit 100 and the image-forming unit 100 (or the image forming device of the invention) will be explained with reference to FIG. 2. FIG. 2 shows the structure of the image forming device and the toner storing unit provided near the image forming device in this embodiment.

As shown in FIG. 2, the document reading part 1 and the document automatic feed part 2 are provided in the upper part of this image forming device 100, and the copier part 3 which has the printer part 50 and the sheet feeding part 60 is provided in the bottom of the document reading part 1. Near the image forming device 100, the toner storing unit 220 is provided as a powder storing unit.

In this embodiment, the toner storing unit 220 is constituted to be separate from the image forming device 100, but this toner storing unit 220 may be provided inside the image forming device 100. The document automatic feed part 2 supplies the document, which is laid on the top of the feed part 2, to the contact glass 5 automatically.

The document reading part 1 is provided for reading the image of the document which is not illustrated. When the start switch which is not illustrated is pressed after the document is placed by the user's manual operation on the contact glass 5 fixed to the upper part of the document reading part 1, the document reading by the document reading part 1 is started.

If the start switch is pressed after a document is placed on the document automatic feed part 2, the document is automatically fed to the contact glass 5, and then the document reading by the document reading part 1 is started.

Upon start of the document reading, optical illumination of the document placed on the contact glass 5 is performed by the light source 6 which is moved in the right direction of FIG. 2. The reflected light image from the document is reflected one by one by the 1st mirror 7 and the 2nd mirror 8. And after passing through the image-formation lens 9, it is detected by the image sensor 10 including a CCD for reading the reflected light image, so that the image information is read.

The printer part 50 forms a toner image as an image on the recording sheet P as an image recording medium, and includes an exposure unit which is an optical writing unit 11 and a latent-image support object which is a drum-like photoconductor 12. Charging unit 13, developing device 40, transfer transporting unit 14, drum cleaning device 15, electricity discharging unit 16, etc. are provided in the vicinity of photoconductor 12.

The development hopper 45 is provided in the upper part of the developing device 40 to be integral with the developing device 40. Near the transfer transporting unit 14, a belt cleaning device 10, and the left-hand side of the transfer transporting unit 14 is provided with a fixing device 17, inversion delivery unit 18 (not illustrated).

Upon depression of the start switch, rotation of the photoconductor 12 will be started by the driving unit which is not illustrated. The exposure unit (the optical writing unit 11) carries out light modulation of the laser beam L based on the image signal read by the document reading part 1, and exposes photoconductor 12 as a latent-image support object.

Specifically, a laser beam L is emitted from the light source which includes a laser diode etc., and this laser beam L passes along the lens system for scan image-formation (not illustrated) which includes an fθ lens, being made to deviate on the rotating polygon mirror rotated by a polygon motor by the main scanning direction (the axial direction of the photoconductor 12). And it reaches the surface of the photoconductor 12 rotated through the mirror and the lens, and an electrostatic latent image is formed on the surface.

In the transfer transporting unit 14, the transfer transporting belt 141 is wound under tension between the plurality of rollers 142 and 143. The transfer transporting belt 141 being moved by the rollers 142 and 143 forms the transfer nip part in contact with the circumference of the photoconductor 12.

The transfer bias roller which is not illustrated is contacted by the transfer transporting belt rear surface in the transfer nip part. Transfer bias is applied to the transfer bias roller by the power source which is not illustrated, and a transfer electric field is formed in the transfer nip by the bias application.

After the electrostatic latent image formed on the photoconductor 12 by exposure of the optical writing unit 11 is developed by the developing device 40 and made into a toner image, it is transferred to the above-mentioned transfer nip part. On the other hand, the resist roller pair 19 provided in the right portion of the photoconductor 12 pinches between the rollers the recording sheet P sent from the sheet feeding part 60 in response to the pressing of the start switch.

And the recording sheet P is sent out to the timing which can be laid on the top of the toner image on the photoconductor 12 in the transfer nip part. The toner image formed on the photoconductor 12 is fixed to the recording sheet P in the transfer nip part by sending of the recording sheet P.

And the toner image of the photoconductor 12 surface is transferred to the recording sheet P surface by the nip pressure in the transfer electric field and transfer nip part by the transfer bias roller. The recording sheet P which passed the transfer nip part is sent in fixing device 17 with the transfer transporting belt 141 of the transfer transporting unit 14.

The fixing device 17 puts the recording sheet P, sent by the transfer transporting belt 141, between heating roller 17*a* and pressurizing roller 17*b*. And the sheet is delivered to the delivery unit 18, and the toner image is fixed to the recording sheet P under the heat and pressure. The delivery unit 18 delivers the recording sheet P to the paper output tray which is installed in the exterior of the image forming device 100 through the exhaust passage 18*a*.

It is also possible to use this delivery unit 18 as an inversion delivery unit. In a case where the inversion delivery unit is provided and the double-sided copy mode is chosen by the user, after the inversion part performs the side inversion of the recording sheet P, it is transported again to the resist roller pair 19. With respect to the recording sheet P again transported to the transfer nip part from the resist roller pair 19, a new toner image is transferred to the surface of the recording sheet P opposite to the surface where the toner image is transferred previously. After the remaining toner adhering to the photoconductor 12 surface after passing the above-mentioned transfer nip part is cleaned by drum cleaning device 15, it is accommodated in the powder recovery container slack recovery tank 90 through the inside of transport passage 153.

After the photoconductor 12 surface cleaned is discharged with the electricity discharging unit 16, it is charged uniformly with the charging unit 13, in preparation for next image formation.

The sheet feeding part 70 is provided with three sheet paper cassettes 26, 27, and 28 in which a number of recording sheets P are accommodated.

The transport passage 33 including the plurality of transporting roller pairs (not illustrated) is provided in the right side of the sheet feeding part 70. The sheet paper cassettes 26, 27, and 28 are pressing the feed roller which is not illustrated on the best paper of the recording sheet P accommodated in the inside, by the rotation, turn the best paper to transport passage 33, and send it out.

Actuation of the start switch will send out the recording sheet P to the transport passage 33 from any one of the sheet paper cassettes 26, 27, and 28. The recording sheet P sent out to the transport passage 33 is transported to the resist roller 19 of printer part 50 by the transporting roller pair with which transport passage 33 is provided and which is not illustrated.

The toner storing unit 220 generally includes the toner storing unit 221 which stores toner, and the container unit 222 which accommodates the toner storing unit 221. In FIG. 1, it is fixed to the formation system 400 (refer to FIG. 1), and container unit 222 is constituted as the formation system 400 and one. It is also possible for it not to be restricted to the structure shown in FIG. 1 as an establishment mode of container unit 222, to fix to image forming device 100 directly, and to provide. It is also possible not to fix to image forming device 100 to the image-forming unit 400 whole, but to provide with these and another object.

Figure 3:
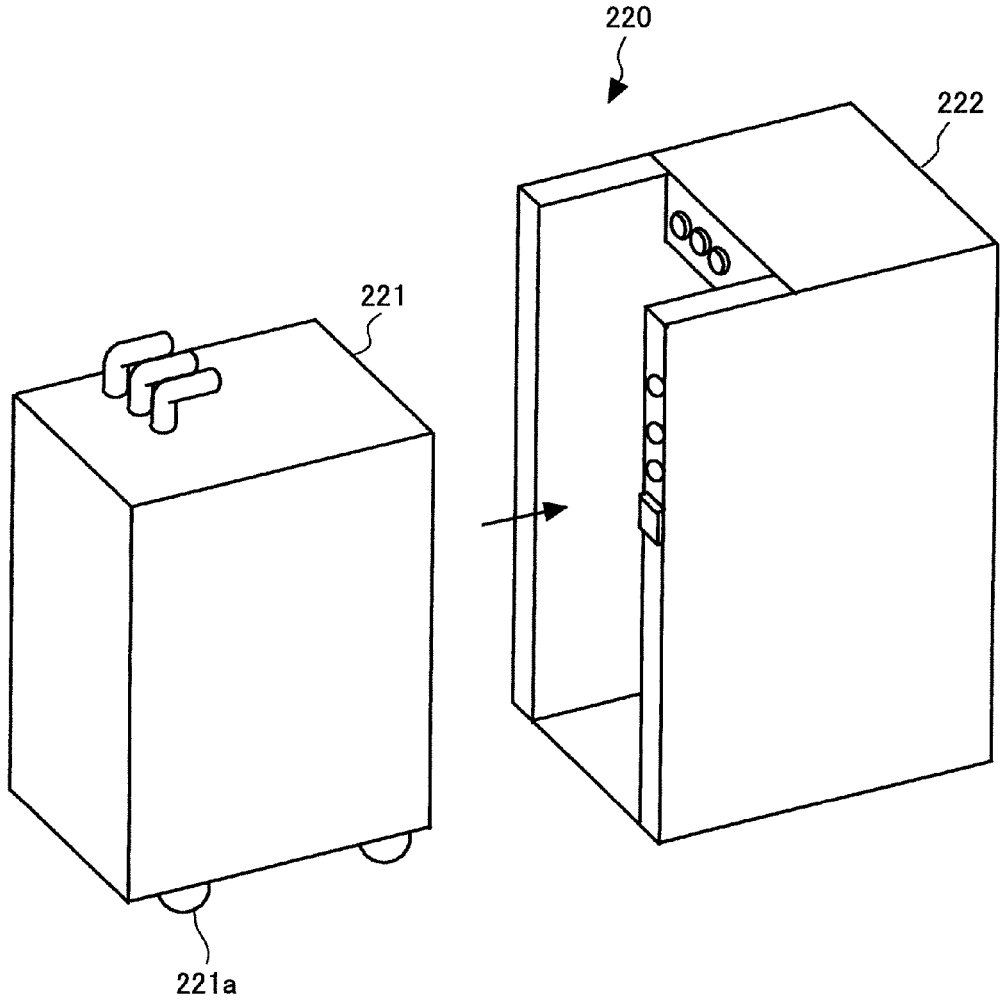
FIG. 3 is a perspective view showing the structure of a toner storing unit.

As shown in FIG. 3, the toner storing unit 221 is constituted so that it is detachably connected to the container unit 222. Developing device 40 provided in the side of photoconductor 12 is opened for free passage with toner storing unit 221 by powder passage 180 which comprises the transporting tube 120, the 2nd transporting tube 160, and the transporting passage 170 via the developing device 40, the development hopper 45 with which one is provided, and the subtank 110.

Once the toner in toner storing unit 221 is transported at the developing device 40 side and collected in subtank 110 by the powder supplying unit which comprises a gas supply device 30 and powder passage 180, it is supplied in development hopper 45. The powder supplying unit of this invention is provided for transporting the toner in the toner storing unit 221 to the developing device 40.

In the developing tank 46 of the developing device 40, a 2-component developing agent containing a toner and a magnetic carrier (not illustrated) is accommodated. Mixed churning is carried out by the above-mentioned powder supplying unit with the internal 2-component developing agent, and the toner supplied in developing device 40 is used for development. T sensor which is not illustrated is provided in the base of developing tank 46 of developing device 45.

This T sensor is outputted to the control unit which does not illustrate the signal according to the permeability of the 2-component developing agent in the developing tank 46. Since the toner density of the 2-component developing agent is correlated with permeability, T sensor will detect the toner density of the 2-component developing agent.

The above-mentioned control unit is making it operate suitably with the drive motor which does not illustrate the pump provided in the middle of powder passage 180 so that the output signal from T sensor may be brought close to a predetermined command, and it recovers the toner density of the 2-component developing agent to which toner density is reduced with development.

However, since the permeability of the 2-component developing agent is changed by environmental variations, such as humidity, the height change of the 2-component developing agent, etc., the control unit corrects the above-mentioned command suitably.

Specifically, the above-mentioned command is corrected according to the image concentration of the criteria toner image made to form on photoconductor 12 to predetermined timing. About this image concentration, it is grasped by the output from the reflection type photosensor (P sensor) which detects the rate of a light reflex of a reference toner image.

The transfer remaining toner which is not transferred by the recording sheet P has adhered to the surface of photoconductor 12 which passed the above-mentioned transfer nip part.

This transfer remaining toner is scratched by drum cleaning device 15, and is collected by recovery tank 90 via transport passage 153. After the transfer remaining toner adhering to the transfer transporting belt 141 surface after the recording sheet P passes a transfer nip part is also cleaned by belt cleaning device 10 which contacted to transfer transporting belt 141 and is formed, it is accommodated in recovery tank 90 through the inside of the transport passage 154.

Next, the structure between the toner storing unit 220 and the developing device 40 will be explained.

In the image forming device in this embodiment, the toner in the toner container unit 220 is transported by the powder supplying unit mentioned above at the developing device 40 side. The powder supplying unit has gas supply device 30 which mobilizes the toner of toner storing unit 221 inside, and the powder passage 180 which transports the toner in toner storing unit 221 to the developing device 40.

In the developing device 40 and the toner storing unit 221 which are provided in the side of photoconductor 12 in FIG. 2, the transporting tube 120, the 2nd transporting tube 160, and the transporting passage 170 connect via the developing device 40, and the development hopper 45, the powder pump 130 and the subtank 110 as a 1st intermediate powder storing part with which one is provided.

In this embodiment, the powder passage 180 is formed in the transporting tube 120, the 2nd transporting tube 160, and the transporting passage 170. It has the suction pipe 37 at the head of the transporting passage 170 as powder passage 180, and the suction pipe 37 and the powder passage 180 are open for free passage, and toner storing unit 221 and developing tank 46 inside of developing device 40 has mutually composition in which a toner can circulate.

The gas supply device 30 is provided for mixing the toner in the toner storing unit 221 in a gas flow. The gas supply device 30 includes a gas supplying pump 31 and a jet generating part 32. The toner accommodated in toner storing unit 221 is agitated by the air which blows off from jet generating part 32 with gas supplying pump 31, and is mobilized.

By providing the suction pump 162 in the powder passage 180 in the location of container unit 221, and a negative pressure arising in the suction pipe 37 with this suction pump 162, the toner mobilized by the action of the gas supply device 30 within the toner storing unit 221 is attracted from the suction pipe 37, and is led in the powder passage 180.

The toner transported from toner storing unit 220 by forming powder pump 130 in the top face of development hopper 45 is smoothly introduced in development hopper 45, without stagnating in the transporting tube 120 inside.

The image forming device of this invention can also have the structure which connects the transporting tube 120 with the opening of direct development hopper 45, without not being restricted to the structure shown in FIG. 2, and forming the above-mentioned powder pump 130.

Figure 4:
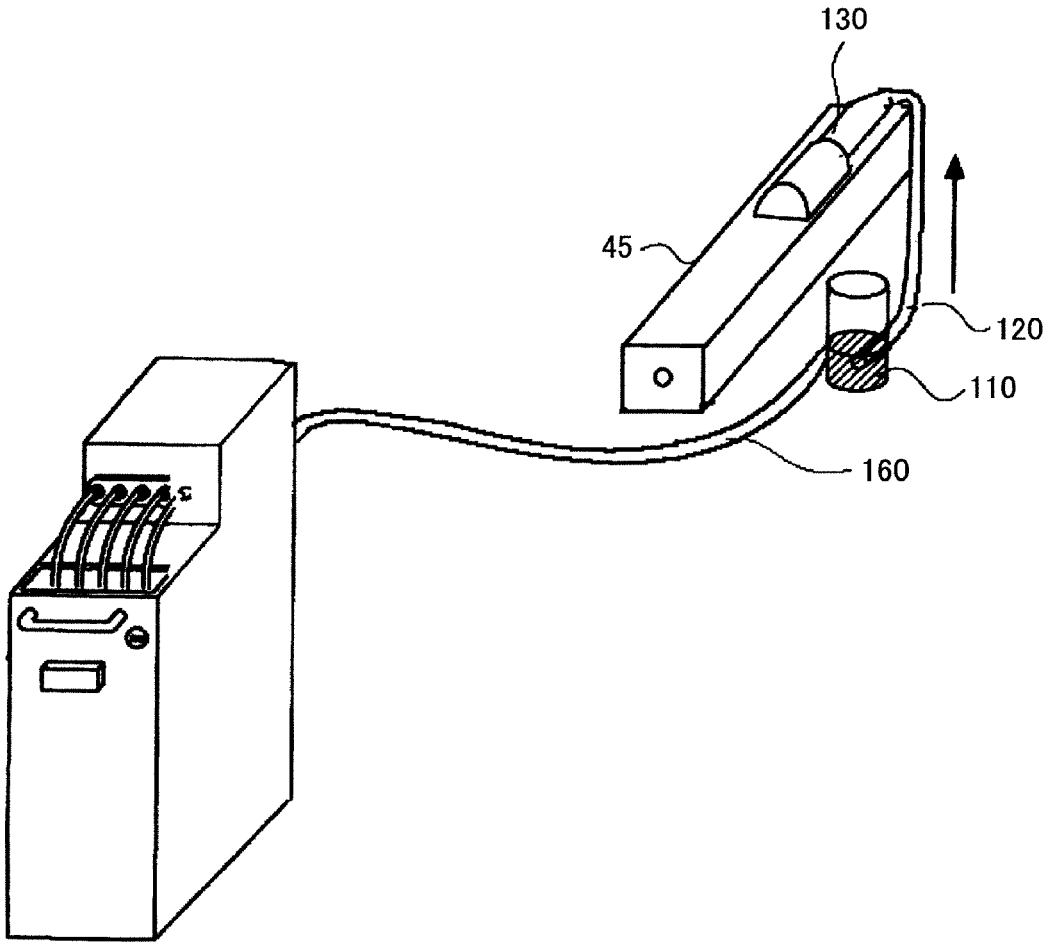
FIG. 4 is a perspective view showing the structure between the toner storing unit and the development hopper in the image forming device of this embodiment.

The structure between toner storing unit 220 in the 1st embodiment and developing device 40 will be explained using FIG. 4. FIG. 4 is a perspective view showing the structure between the toner storing unit and the development hopper in the image forming device of this embodiment.

In FIG. 4, the toner storing unit 220 and the subtank 110 are connected by the 2nd transporting tube 160, and the subtank 110 and the powder pump 130 are connected by the transporting tube 120. From the junction Q to the toner storing unit 220 of the 2nd transporting tube 160 before the inside of toner storing unit 221 is connected by the transporting passage 170.

The powder pump 130 and the development hopper 45 are directly connected by connecting the opening 137 in which the underside of powder pump 130 is provided and the opening 147 provided on the development hopper 45 top surface. One end of the 2nd transporting tube 160 is connected to junction Q of the bottom side face of toner storing unit 220, and the other end is connected to the top side face of subtank 110.

Although the subtank is directly connected with toner storing unit 220 by the 2nd transporting tube 160, it is also possible to have structure which forms powder pump 130 in the location of the toner storing unit 220 side this side of subtank 110 in FIG. 2. In this case, the end of the 2nd transporting tube is connected to the suction opening of this suction pump.

The transporting tube 120 comprises flexible construction material, one end of the transporting tube 120 is connected to the bottom side face of subtank 110, and the other end is connected to the suction opening of powder pump 130.

The transporting tube 120 is arranged in few clearances between subtank 110 and the image forming device side face, and the neighborhood near the terminal area part with subtank 110 of a terminal area part with powder pump 130 is curving. The transporting passage 170 is a transporting passage of the toner in toner storing unit 220 inside. It comprises a flexible construction material like the transporting tube 120.

One end of the transport passage 170 is connected with suction pipe 37 top end provided in toner storing unit 221 inside, it connects with junction Q of the transporting tube 120 in container unit 222, and the other end is provided in a part for the cavity part of toner storing unit 221 inside and the container unit 222 surface of a wall.

Although it is omitted in FIG. 4, in the subtank 110, the toner amount detection sensor 112 for the toner amount detecting unit slack subtanks in a toner storing unit which detects the toner amount in a subtank as agitating member 113 for stirring unit slack subtanks for agitating the toner which collected in subtank 110 is provided.

Figure 5:
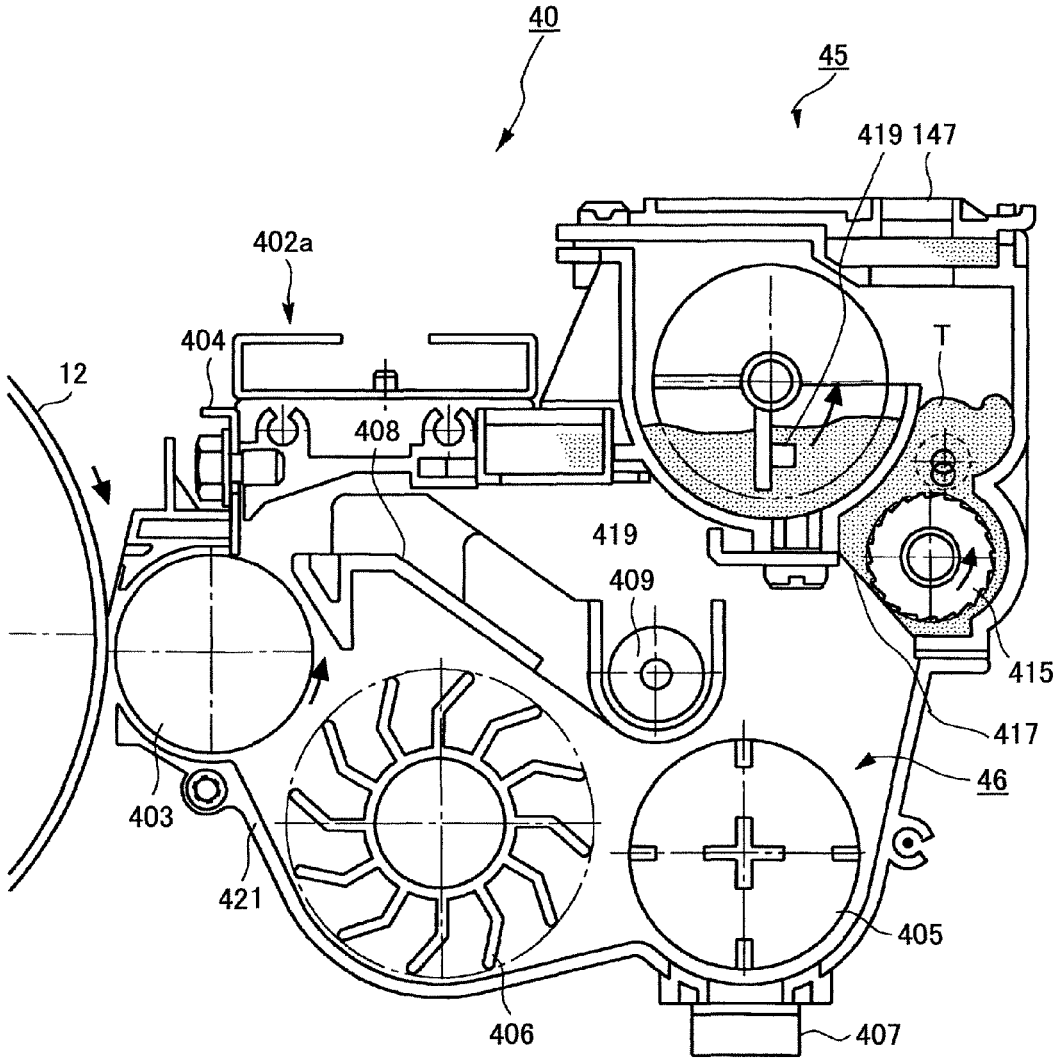
FIG. 5 is an enlarged diagram showing the structure of the developing device vicinity.

The detailed structure and operation of the subtank 110 will be described later with reference to FIG. 12. FIG. 5 is an enlarged diagram the structure of the developing device vicinity. The developing device 40 comprises the development hopper 45 and the developing tank 46. The development hopper 45 is constituted by the actuator (not illustrated) which makes makeup regulating board 417 which makes mainly contact gearing-like the toner supplying member 415 and the toner supplying member 415, and it has, agitator 419 which transports the toner in development hopper 45, and the toner supplying member 415 and the agitator 419 drive. The regulating board 417 has the plurality of byway holes in the direction of the stretch.

The toner supplying member 415 has a saw-shaped gearing on the surface, and it is displacing the gear tooth of this gearing to the periphery sense so that it may shift to shaft orientations. In the development hopper 45, the toner transported from toner storing unit 220 is attracted by powder pump 130, and is supplied from opening 147. The detailed structure of powder pump 130 is mentioned later.

The toner supplied in development hopper 45 is transported to the toner supplying member 415 by revolution of the agitator 419 in the direction indicated by the arrow in the figure.

The toner transported to the toner supplying member 415 enters between the gear teeth of the gearing, and these toners are transported to the makeup regulating board 417 by revolution of the arrow direction of the toner supplying member 415. The toner transported by makeup regulating board 417 passes through the byway hole provided in the direction of a stretcher of makeup regulating board 417, and falls in the developing tank 46 provided in the lower part.

Next, the structure of the gas supply device 30 will be explained. The gas supply device 30 comprises a jet generating part 32 provided in gas supplying pump 31 provided in container unit 222, and the underside of toner storing unit 221.

Figure 6A:
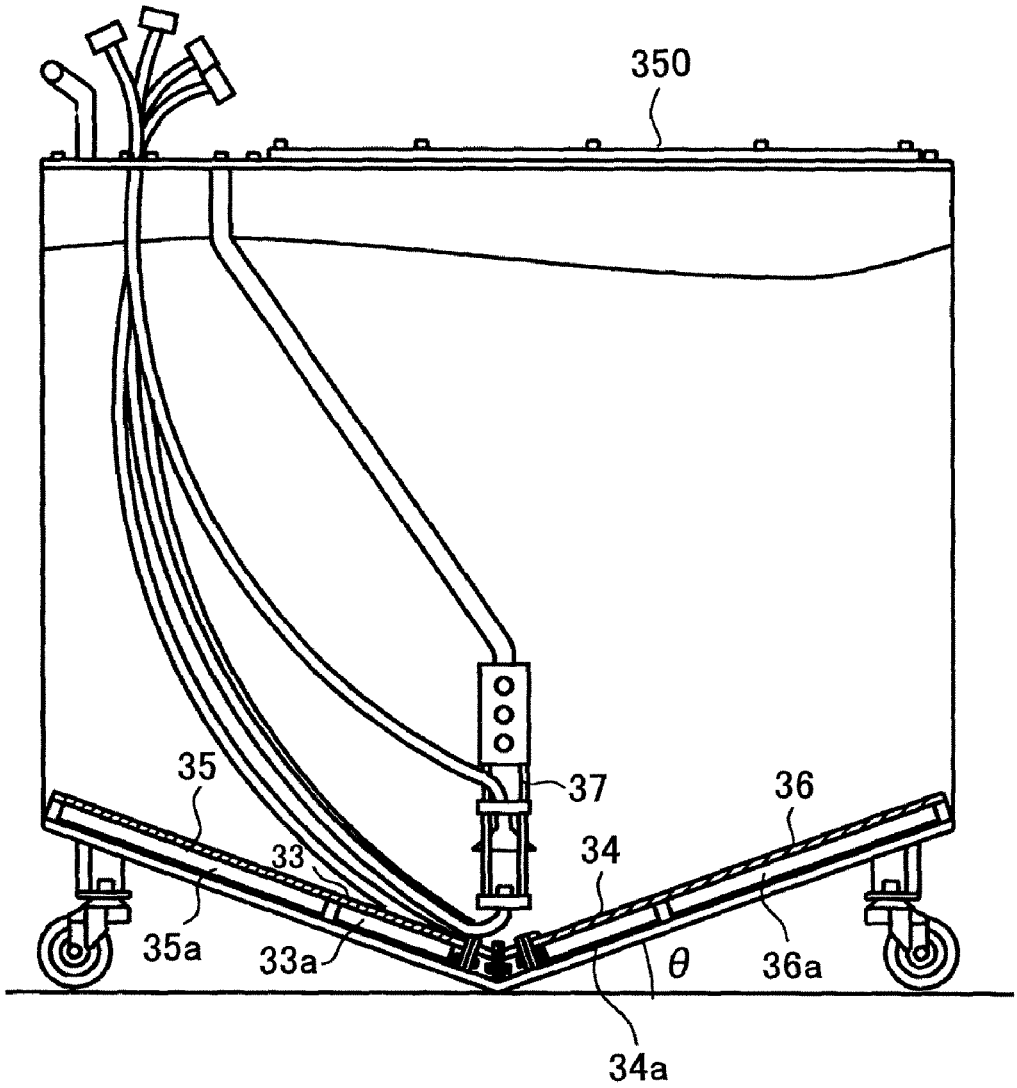
FIG. 6A is a diagram showing the internal structure of a toner storing unit.
Figure 7:
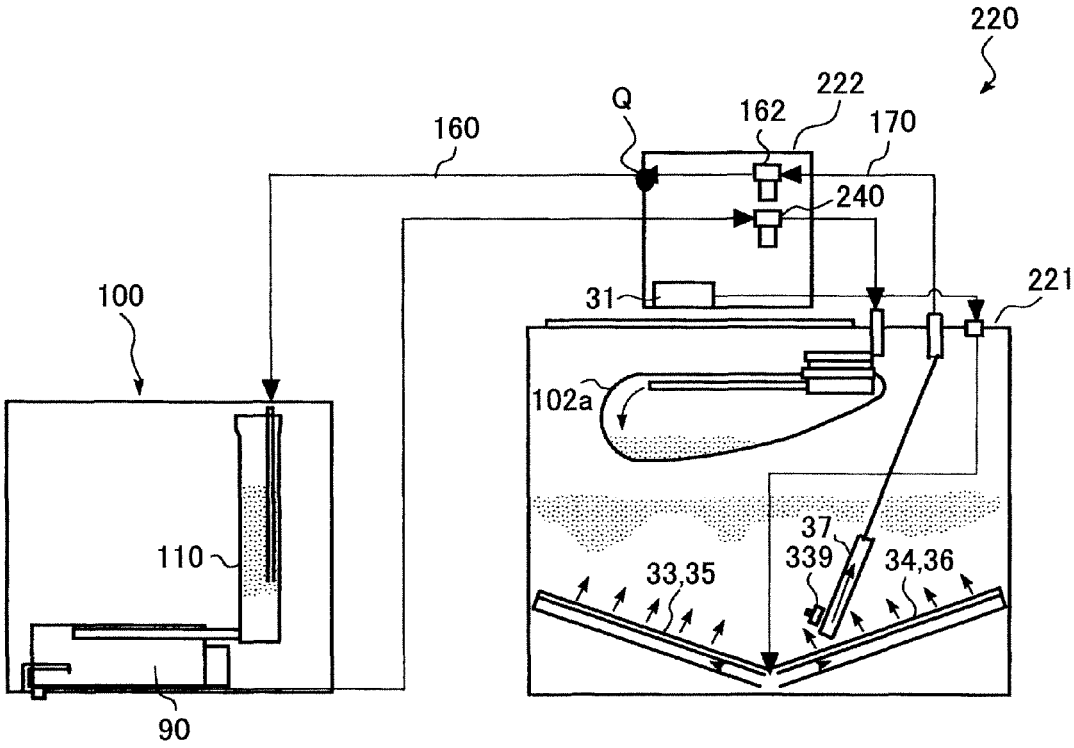
FIG. 7 is a diagram for explaining the internal structure of a toner storing unit and a container unit.

FIG. 6A is a diagram showing the internal structure of the toner storing unit 221. FIG. 7 is a diagram for explaining the internal structure of the toner storing unit and the container unit. In FIG. 6A, the jet generating part 31 comprises the air chambers 33*a*, 34*a*, 35*a*, and 36*a* which are provided in the internal underside of the toner storing unit 221 and provided in the bottom of the porous members 33, 34, 35, and 36. The small acreage is used from porous members 35 and 36 by which porous members 33 and 34 installed in the center side under the inside of toner storing unit 221 among porous members 33, 34, 35, and 36 are installed in the side-face side of toner storing unit 221 underside.

As for the toner storing unit 221 provided with jet generating part 32, the base inclines in the shape of V. As for this inclination angle theta, it is preferred that it is an angle smaller than the angle of repose of the toner stored. In this embodiment, the inclination angle of the base of toner storing unit 221 is set up for becoming 20-degree order to the degree of angle of repose of the toner stored being just over or below 40 degrees. An angle of repose shows the thing of the inclination of the crest of powder formed when carrying out the drop deposition of the powder from the upper part.

It is possible to make small the dead space by the dip of the top of flooring by setting up more gently than the angle of repose of the toner inclination angle of the top of flooring of the toner storing unit 221.

The cross-section of the toner storing unit 221 is formed into a rectangular shape. Thereby, the maximum containing amount is securable, using the tooth space stored effectively. The porous members 33-36 are components which can pass gaseous and which have detailed porosity. It is preferred that the open area ratio of the porous members 33-36 is in a range of 5 to 40%. It is more preferred that it is in a range of 10 to 20%.

It is preferred that the average opening diameter of the porous members 33-36 is in a range of 0.3-20 micrometers. It is more preferred that it is in a range of 5-15 micrometers. This is because the volume average particle diameter of the toner generally used is 3-15 micrometers in many cases.

As for the diameter of the hole part of porous members 33-36, it is preferred that it is 0.1 to 5 times the volume average particle diameter of the toner which is an object for transporting. It is more preferred that it is 0.5 to 3 times.

Although there is no restriction in the material of porous members 33-36, it can be chosen suitably according to the object. For example, sintered bodies, such as glass and a resin particle, the resin by which photoetching is carried out, the porosity resin material obtained by punching resin etc. thermally, a metal sintered body, by heating the copperplate produced in the form where deposited metallic copper with the electrochemical process around the metal plate-like material by which punching is carried out, the net layered product, and the easy-melting metallic thread bundle, and penetration implantation of the easy-melting metallic thread bundle is carried out. The metallic material with which the ea metallic thread part has alternative fusion holes which has a part for the hole part of the marks removed selectively is mentioned.

In FIG. 7, the air chambers 33*a*, 34*a*, 35*a*, and 36*a* are connected to gas supplying pump 31 provided in container unit 222. Actuation of gas supplying pump 31 will blow off and supply air in toner storing unit 221 from the hole of porous members 33, 34, 35, and 36 via air chambers 33*a*-36*a*.

In FIG. 7, the gas supplying pump 31 is considered as the structure provided in container unit 222. Or it is good also as structure which forms this gas supplying pump 31 in toner storing unit 221.

As mentioned above, the opening diameter of the hole of porous members 33-36 is set as the range mentioned above to the average particle diameter of the toner used, and very fine blowhole is supplied to the toner accommodated in toner storing unit 222 from the hole. The toner which is powder is agitated by this, it mobilizes, and behavior which is a liquid is shown.

Even when the fines toner entered into the hole part of porous members 33-36, or a toner with large particle diameter adheres to the surface of porous members 33-36, and the excretory pore of a hole is closed or it carries out, it sets at the time of the gas blowout performed to the next.

The toner which entered the inside of these holes or adhered to the surface can be blown away with the pressure of the air supplied with gas supplying pump 31. It is because this has the strong pressure of the air supplied with gas supplying pump 31 to the weight per toner particle.

The chamber 33*a* by the side of the center provided in the inner side base of toner storing unit 221 as mentioned above, the porous members 33 and 34 which the capacity comprises small chambers 35*a* and 36*a* by the side of a side face, and are laid in the side near the center part at the base of toner storing unit 221 inner side. Since what has acreage smaller than porous members 35 and 36 laid in the side near a side face is used, when an equivalent amount of air is supplied, respectively in each air chambers 33*a*, 34*a*, and 35*a* and 36*a*, the air which blows off from porous members 33 and 34 of the side near a center part at the bottom is equalized by the air which blows off from porous members 35 and 36 of the side near a side face. For this reason, the whole toner stored in toner storing unit 221 can be made to mobilize uniformly.

As shown in FIG. 6A, in the toner storing unit 221, the suction pipe 37 which attracts the toner stored in toner storing unit 221 is connected to the end of the transporting passage 160 and to the transporting passage 160. The suction pump 162 which produces a negative pressure in this suction pipe 37, and attracts the toner in toner storing unit 221 is provided in the container unit 222.

Near the suction opening of toner suction pipe 37, the toner residual amount sensor 339 is provided as a detection unit to detect the existence of the toner in toner storing unit 221.

Figure 6B:
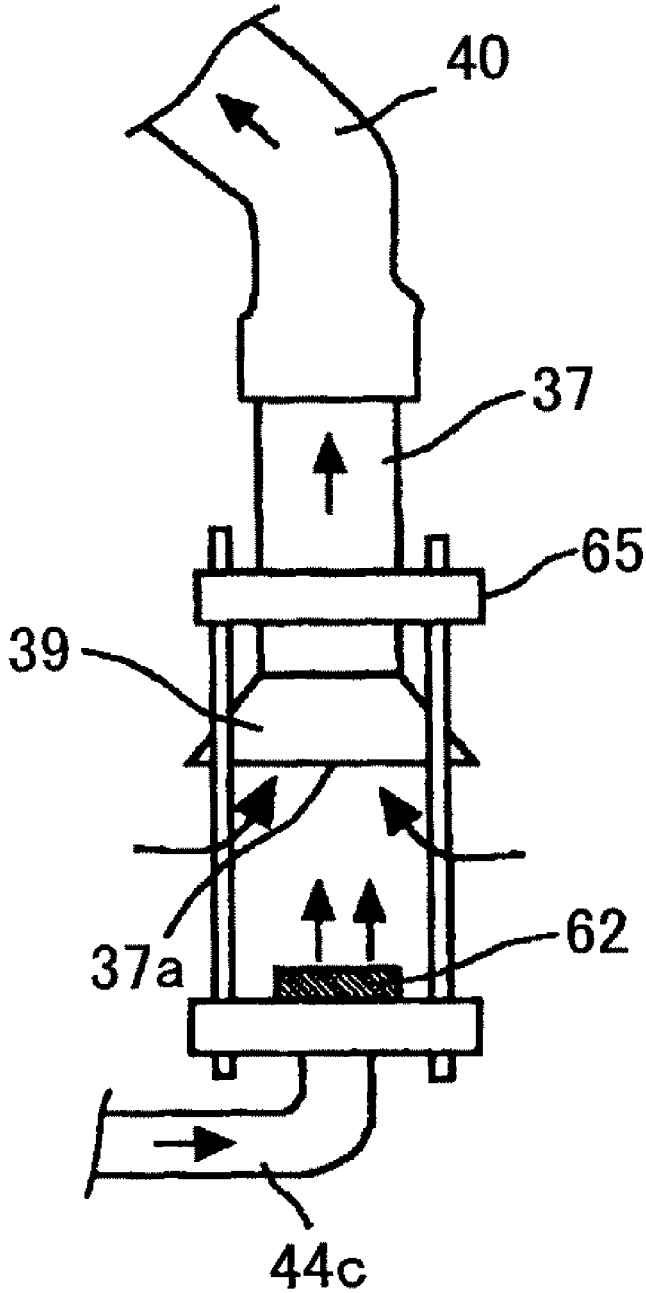
FIG. 6B is an enlarged diagram showing the structure of the suction pipe vicinity in FIG. 6A.

FIG. 6B is an enlarged diagram showing the structure of the suction pipe 37 vicinity in FIG. 6A. The suction tubing 37 is fixed to hold component 65 supported by support member 61 in FIG. 6B. Under the suction pipe 37, the 2nd gas blowout part 62 held at hold component 65 is provided.

The hold component 65 and support member 61 appoint the location of the 2nd gas blowout part 62 to suction pipe 37 while appointing the location of suction pipe 37 in toner storing unit 221.

Through the contact button and the 3rd tube which do not illustrate the air sent out from gas supplying pump 31, further, it discharges directly near the toner residual amount sensor 339, and the 2nd gas blowout part 62 is formed the suction opening 37*a* of the suction pipe 37 and by the porous member. The 2nd gas blowout part 62 can also be formed through the air chamber. The porous member of the 2nd gas blowout part 62 is formed with the same material as porous members 33-36 of jet generating part 32 mentioned above.

The toner transporting characteristic improves without mobilizing the toner and a stick arising, by the suction pipe 37, the suction pump 162, and the transporting passage 170, and the 2nd transporting tube 160, while the density of the toner near the suction opening 37*a* of suction pipe 37 falls. The toner about the toner residual amount sensor 339 will be mobilized, and the detection engine performance by toner residual amount sensor 339 will be stable.

In the above-mentioned embodiment, air is blown off near the toner residual amount sensor 339 near the suction opening 37*a* of suction pipe 37 using the 2nd gas blowout part 62. On the other hand, the gas blowout part which discharges air near the suction opening 37*a* of suction pipe 37, and the gas blowout part which discharges air near the toner residual amount sensor 339 can also be provided independently. The 2nd gas blowout part 62 can also be formed in one with jet generating part 32 for which it is prepared by the bottom of toner storing unit 221.

In FIG. 6B, the flow adjusting member 39 is formed in the suction opening 37*a* of the suction pipe 37. This flow adjusting member 39 is a funnel-like component formed so that the effective area product of a suction opening might become large, and makes the suction force in suction opening 37*a* increase.

Since the suction pipe 37 is installed in the location near the base of toner storing unit 221 as shown in FIG. 6B, the toner which can attract a toner from the location near the base of toner storing unit 221, and is stored in toner storing unit 222, the whole amount can be mostly introduced in the powder passage 180.

As shown in FIG. 6A, the filter 350 for preventing that the internal pressure in toner storing unit 221 increases by the air supplied by gas supply device 30 is provided in the top face of toner storing unit 221. As a location in which this filter 350 is provided, if it is the upper part, it is more possible than the waterline of a toner in case toner storing unit 221 inside is in a full condition not only the top face of toner storing unit 221 but to provide in a side face.

It is also possible to use the same component as porous members 33-36 as filter 350. For example, a sheet of Gore-Tex (the registered trademark, the Japan Gore-Tex make) which is a continuation porous-structure object made of fluororesin can constitute.

As mentioned above, the toner storing unit 221 is detachably connected to the above-mentioned container unit 222, and it is provided with toner storing unit 221 by which a new toner is stored, when the toner in toner storing unit 221 is consumed and exchange is needed.

For this reason, as for toner storing unit 221, it is preferred to have structure it is easy to make it move.

As shown in FIG. 6A, it can have structure which can detach and attach easily to container unit 222 by forming movable components 221*a*, such as a caster, in the external base of toner storing unit 221. The toner is attracted by suction pipe 37 from the inside of toner storing unit 221 in FIG. 4 as mentioned above.

Once it passes along the transporting passage 170 and the 2nd transporting tube 160 and is accumulated in the subtank 110, it passes along the transporting tube 120 and is transported by suction of the powder pump 130 in the development hopper 45 (see FIG. 2 and FIG. 4).

The toner transported in development hopper 45 is suitably supplied in developing tank 46 based on the output signal of T sensor provided in developing tank 46, and development is presented with it.

The development hopper 45 which connects with developing tank 46 and is formed is for adjusting eventually the amount of supply of the toner into developing tank 46 in a little range. The maximum capacity which can store a toner inside is restricted.

For this reason, when performing toner feed in the development hopper 45, performing high-precision control is desired so that the amount of supply may become suitable within the limit.

However, when the toner storing unit 220 and the development hopper 45 are directly connected with the transporting tube 120, it is actually difficult to adjust the amount of supply of the toner into development hopper 45 in the fine range.

Since the subtank 110 as an intermediate powder storing part is formed before development hopper 45 in this embodiment, It is related between subtanks 110 from toner storing unit 221 which accommodates a large amount of toner.

Toner feed can be performed transporting a toner and controlling the amount of supply in the rough range, the amount of supply in a little range about the inside of development hopper 45 from subtank 110.

For this reason, a suitable amount of a toner can be efficiently supplied in development hopper 45 at each event.

In FIG. 2, the toner collected by recovery tank 90 is transported via recovery way 91 in the waste toner bottle 102*a* connected to toner storing unit 221 by suction of suction pump 240 formed in container unit 222.

It is possible to make the toner collected in recovery tank 90 agitate and mobilize by the revolution of the agitator by providing the agitator omitted in the inside of the recovery tank 90.

It is possible to establish a jet generating part like toner storing unit 221 in recovery tank 90 as other methods, to connect a gas supplying pump to this jet generating part, and to also make a recovery toner mobilize according to the same device as shown in FIG. 6A and FIG. 7.

The toner in the waste toner bottle 102*a* are collected with exchange of toner storing unit 221, and are newly used as a recycle toner. In FIG. 2, it had structure which equips a 100 image forming device outside-of-the-body part with powder storing unit 220.

Figure 18:
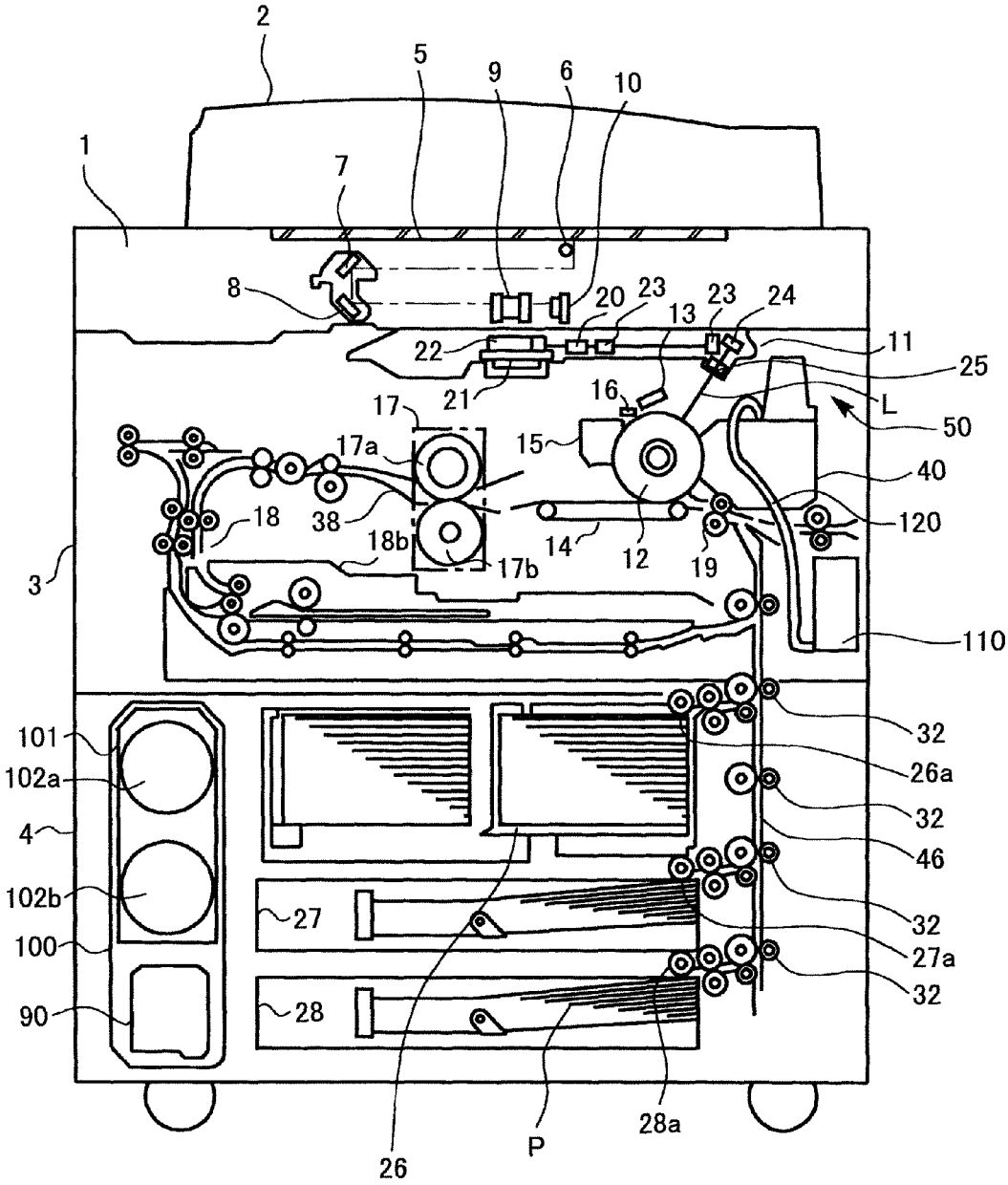
FIG. 18 is a diagram showing the composition of an image forming device in an embodiment of the invention.

Or it is also possible to consider this powder storing unit 220 as the structure with which the inside of image forming device 100 body is provided, as shown in FIG. 18.

FIG. 18 is a block diagram showing the structure of the image forming device which provided the inside of a copier with the toner storing unit.

In FIG. 18, the developing device 40 and the toner storing unit 220 are arranged on the diagonal line.

In the image forming device of the embodiment of the invention, the subtank 110 as an intermediate powder storing part is formed in the powder passage 180, but the toner storing unit 220 and the development hopper 45 can also be considered as the structure directly connected with the transporting tube 120.

Figure 8:
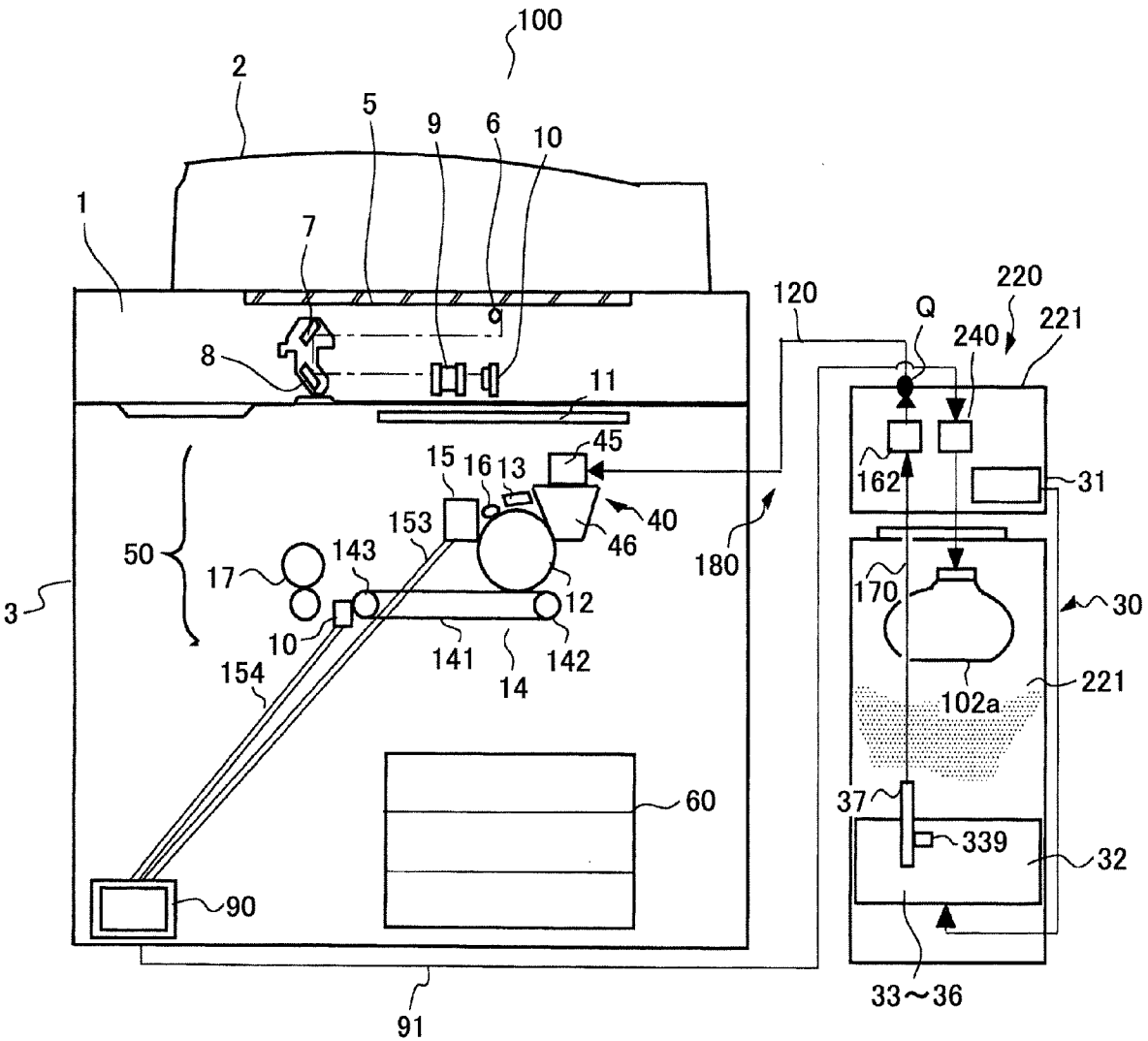
FIG. 8 is a diagram showing the structure of the image forming device and the toner storing unit in this embodiment.

FIG. 8 is a diagram showing the structure concerning the embodiment of the toner storing unit which it had near the image forming device in this embodiment of the invention, and this image forming device.

Figure 9:
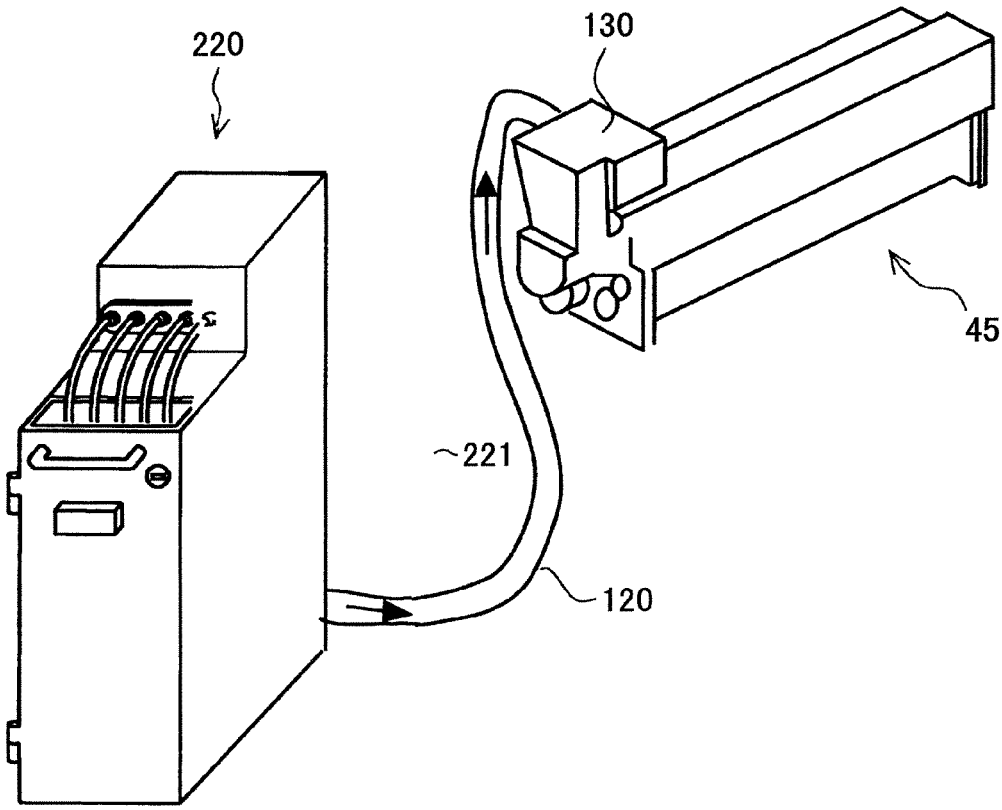
FIG. 9 is a perspective view showing the structure between a toner storing unit and a development hopper of an image forming device in an embodiment of the invention.

FIG. 9 is a perspective view showing the structure between the toner storing unit and the development hopper in this embodiment.

In FIG. 8, the developing tank 46 and the toner storing unit 221 of the developing device 40 provided in the side of photoconductor 12 are connected by the transporting passage 170 and the transporting tube 120 via the developing device 40, and the development hopper 45 and the powder pump 130 which are provided integrally.

In this embodiment, the powder passage 180 is formed with the transporting passage 170 and the transporting tube 120.

It has the suction pipe 37 at the head by the side of the toner storing unit 221 of the powder passage 180, and the suction pipe 37 and the powder passage 180 are open for free passage, and the inside of the toner storing unit 221 and the developing tank 46 of the developing device 40 has mutually composition in which a toner can circulate.

After the toner in toner storing unit 221 is mobilized by the gas supply device 30 which includes gas supplying pump 31 and jet generating part 32, it is attracted from suction pipe 37 by suction pump 162 formed in powder passage 180, and is led in powder passage 180.

Here, the image forming device of this embodiment is the same as that of the previous embodiment about structure other than the structure in powder passage 180 between toner storing unit 220 and developing device 40.

In FIG. 9, the toner storing unit 220 and the powder pump 130 are connected by the transporting tube 120.

From junction Q to toner storing unit 220 of the transporting tube 120 before toner storing unit 221 inside is connected by the transporting passage 170.

The powder pump 130 and the development hopper 45 are directly connected by connecting with opening 147 of the development hopper 45 top face opening 137 in which the underside of powder pump 130 is provided.

The transporting tube 120 comprises flexible construction material, one end of the transporting tube 120 is connected to the bottom side face of container unit 222 in terminal area Q, and the other end is connected to the suction opening of powder pump 130.

The transporting tube 120 is arranged in few clearances between developing device 40 and image forming device 100 side faces, and the neighborhood of a terminal area part with powder pump 130 is curving. The transport passage 170 is a transporting passage of the toner in the toner storing unit 220.

It comprises flexible construction material like the transporting tube 120. The end of transport passage 170 is connected with the top end of suction pipe 37 with which toner storing unit 221 inside is provided.

It connects with junction Q of the transporting tube 120 in container unit 222, and the other end is provided in a part for the cavity part of the inside of toner storing unit 221, and the container unit 222 surface of a wall (refer to FIG. 1).

As mentioned above, in FIG. 9, the toner attracted by suction pipe 37 from the inside of toner storing unit 221 passes along the transporting passage 170 and the transporting tube 120, and is transported in development hopper 45 by the suction force of powder pump 130.

The toner transported in development hopper 45 is suitably supplied in developing tank 46 based on the output signal of T sensor provided in developing tank 46, and development is presented with it.

In this embodiment, saving of the space of the image forming device 100 can be attained by having the structure which connects the toner storing unit 221 and the development hopper 45 of the developing device 40 directly with the transporting tube 120.

It is also possible not to form development hopper 45 in developing device 40, but to consider developing tank 46 and toner storing unit 221 as the structure directly connected with the transporting tube 120.

In this case, one end of the transporting tube 120 is connected to bottom side face Q of container unit 221, and the other end is connected with the suction opening of suction pump 130 provided in the top face of developing tank 46.

In this case, the toner attracted by suction pipe 37 from the inside of toner storing unit 221 passes along the inside of transport passage 170 and the transporting tube 120, and is supplied by suction of powder pump 130 in direct developing tank 46.

Also in this embodiment, it is preferred to adjust the amount of supply suitably based on the output signal of T sensor provided in developing tank 46.

In FIG. 8, the toner collected in the recovery tank 90 is transported via recovery way 91 in the waste toner bottle 102*a* connected to toner storing unit 221.

The toners collected in the waste toner bottle 102*a* are collected with exchange of toner storing unit 221, and are newly again used as a recycle toner.

In the powder passage 180 of the image forming device of this invention, it is also possible to form the subtank 110 as an intermediate powder storing part and the toner bank 310 as a 2nd intermediate powder storing part between the toner storing unit 220 and the developing device 40.

The structure of the powder supplying unit concerning the 3rd embodiment of this invention will be explained.

Figure 10:
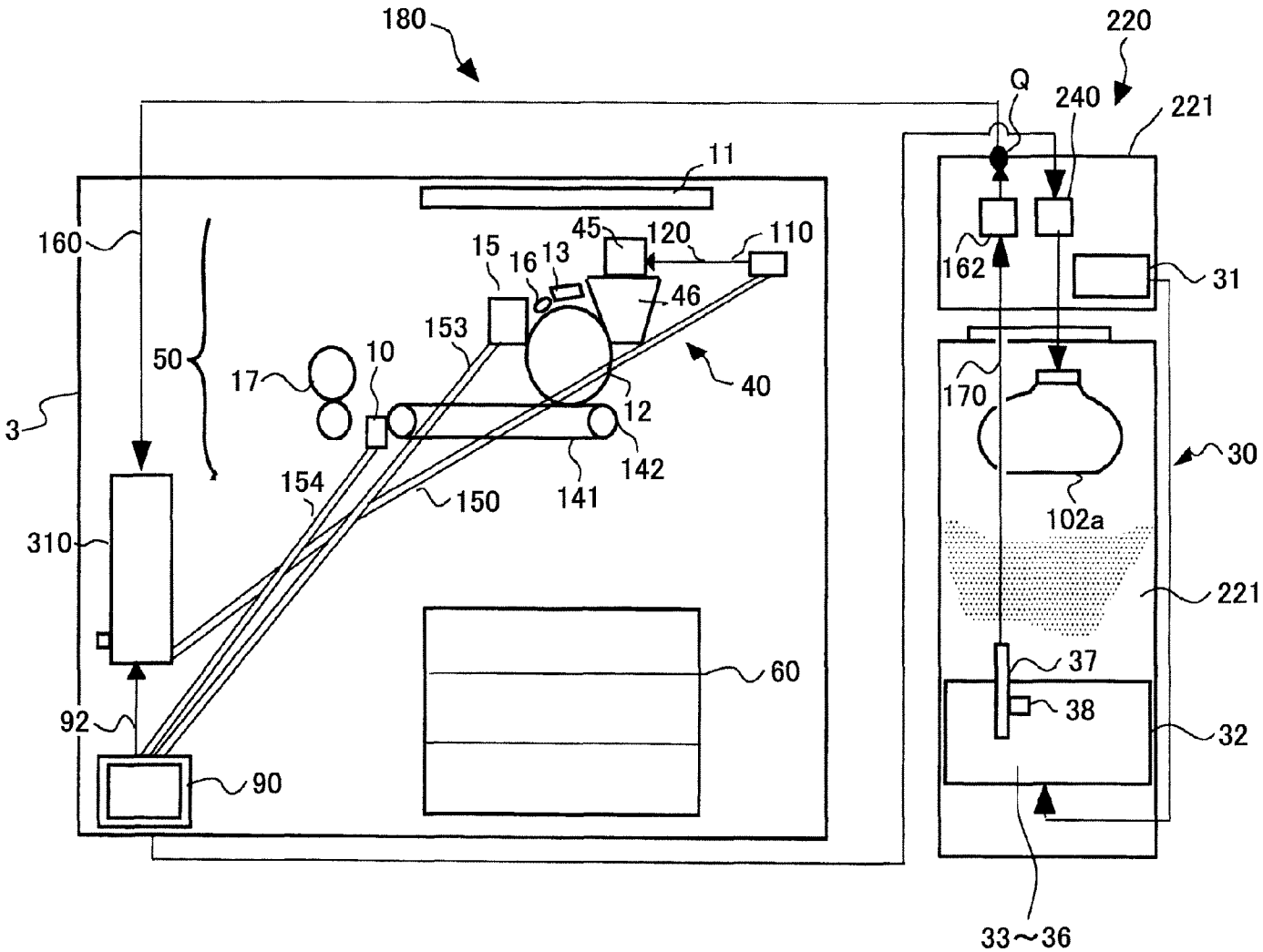
FIG. 10 is a diagram showing the structure of an image forming device and a toner storing unit in an embodiment of the invention.

FIG. 10 is a diagram showing the structure concerning the 3rd embodiment of the toner storing unit which it had near the image forming device in an embodiment of the invention, and this image forming device.

In FIG. 10, the document reading part 1 and the document automatic feed part 2 which are provided in the upper part of the copier part 3 omitted. In FIG. 10, the developing tank 46 and toner storing unit 221 of the developing device 40 are provided in the side of the photoconductor 12. The developing device 40, the development hopper 45 with which one is provided, the powder pump 130, the subtank 110 as an intermediate powder storing part, and the toner bank 310 as a 2nd intermediate powder storing part are provided.

The transporting passage 170, the 2nd transporting tube 160, the transport passage 150, and the transporting tube 120 are connected with toner storing unit 221.

In this embodiment, the powder passage 180 is formed with the above-mentioned transporting passage 170, the 2nd transporting tube 160, the transporting passage 150, and the transporting tube 120.

It has the suction pipe 37 at the head by the side of the toner storing unit 221 of the powder passage 180, and the suction pipe 37 and the powder passage 180 are open for free passage, and the toner storing unit 221 and the developing tank 46 inside the developing device 40 have mutually composition in which a toner can circulate.

After the toner accommodated in toner storing unit 221 is mobilized by the gas supply device 30 which includes gas supplying pump 31 and jet generating part 32, it is attracted from suction pipe 37 by suction pump 162 formed in powder passage 180, and is led in powder passage 180.

Here, the image forming device of this embodiment is the same as that of the previous embodiment about the structure other than the structure in the powder passage 180 between the toner storing unit 220 and the developing device 40.

Next, the structure between the toner storing unit 220 and the developing device 40 in the image forming device in an embodiment of the invention will be explained.

Figure 11:
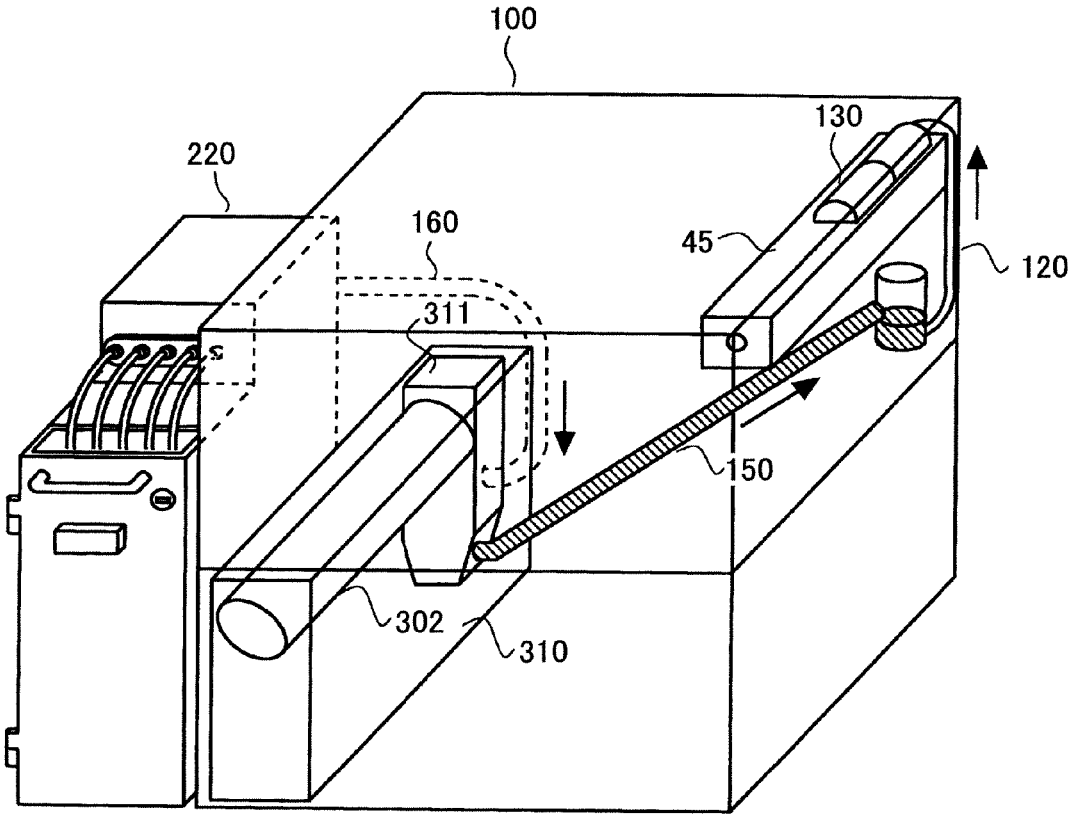
FIG. 11 is a perspective view showing the structure between the toner storing unit and the development hopper of the image forming device of this embodiment.

FIG. 11 is a perspective view showing the structure between the toner storing unit and the development hopper in the image forming device in this embodiment.

In FIG. 11, the toner storing unit 220 and the toner bank 310 are connected by the 2nd transporting tube 160.

The toner bank 310 and the subtank 110 are connected by the transport passage 150, and the subtank 110 and the powder pump 130 are connected by the transporting tube 120.

From the junction Q to the toner storing unit 220 of the 2nd transporting tube 160 before the inside of the toner storing unit 221 is connected by the transporting passage 170.

The powder pump 130 and the development hopper 45 are directly connected by connecting the opening 137 provided in the underside of powder pump 130 and the opening 147 provided in the top surface of the development hopper 45.

The 2nd transporting tube 160 is made of a flexible construction material, the one end is connected to the junction Q of the bottom side face of the toner storing unit 220, and the other end is connected to the top side face of the toner bank 310.

In the downstream powder transporting part, one end of the transporting tubing 150 is connected to the bottom side face of the toner bank 310, it connects with the top side face of the subtank 110, and the other end is mostly prolonged on the straight line to the subtank 110 from the toner bank 310.

In the transporting tubing 150, feeding unit slack the transporting coil 151 is formed, and the toner in toner storing unit 220 is transported to subtank 110 because you make it rotate with the transporting coil drive motor which does not illustrate this transporting coil 151.

The transporting tube 120 comprises a flexible construction material like the 2nd transporting tube 160, one end of the transporting tube 120 is connected to the bottom side face of subtank 110, and the other end is connected to the suction opening of powder pump 130.

The transporting tube 120 is arranged in few clearances between subtank 110 and the image forming device side face, and the neighborhood near the terminal area part with subtank 110 of a terminal area part with powder pump 130 is curving.

The transporting passage 170 is a transporting passage of the toner in the toner storing unit 220 inside. It comprises flexible construction material like the transporting tube 120. The end of the transporting passage 170 is connected with suction pipe 37 top end provided in toner storing unit 221 inside. It connects with junction Q of the 2nd transporting tube 160 in container unit 222, and the other end is provided in a part for the cavity part of toner storing unit 221 inside and the container unit 222 surface of the wall.

The structure of the subtank 110 will be explained with reference to FIG. 12. FIG. 12 is a schematic diagram showing the structure between development hoppers 45 from toner bank 310 in the image forming device of the 3rd embodiment.

Figure 12:
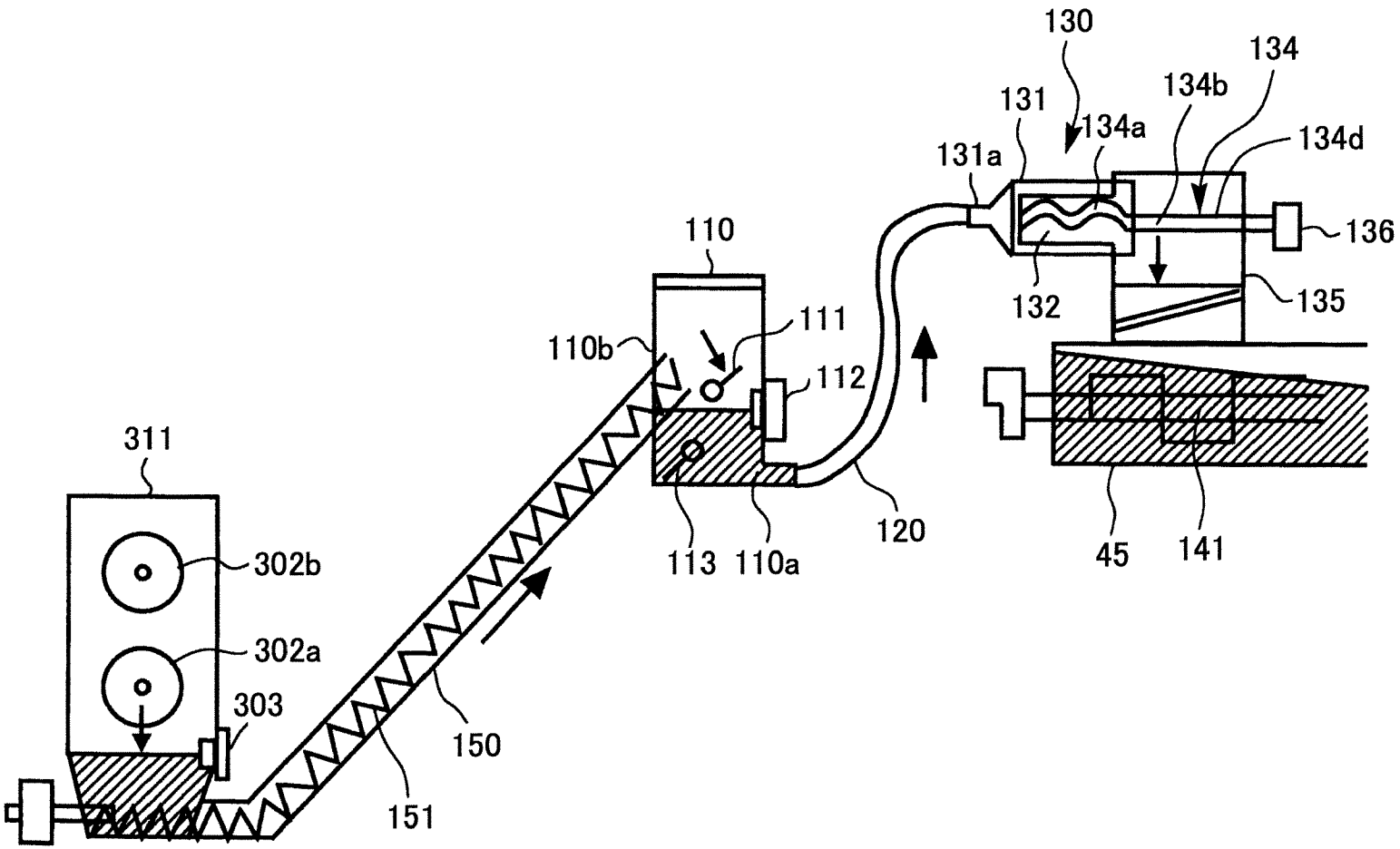
FIG. 12 is a diagram showing the structure between the development hopper and the toner bank in the image forming device of this embodiment.
Figure 13:
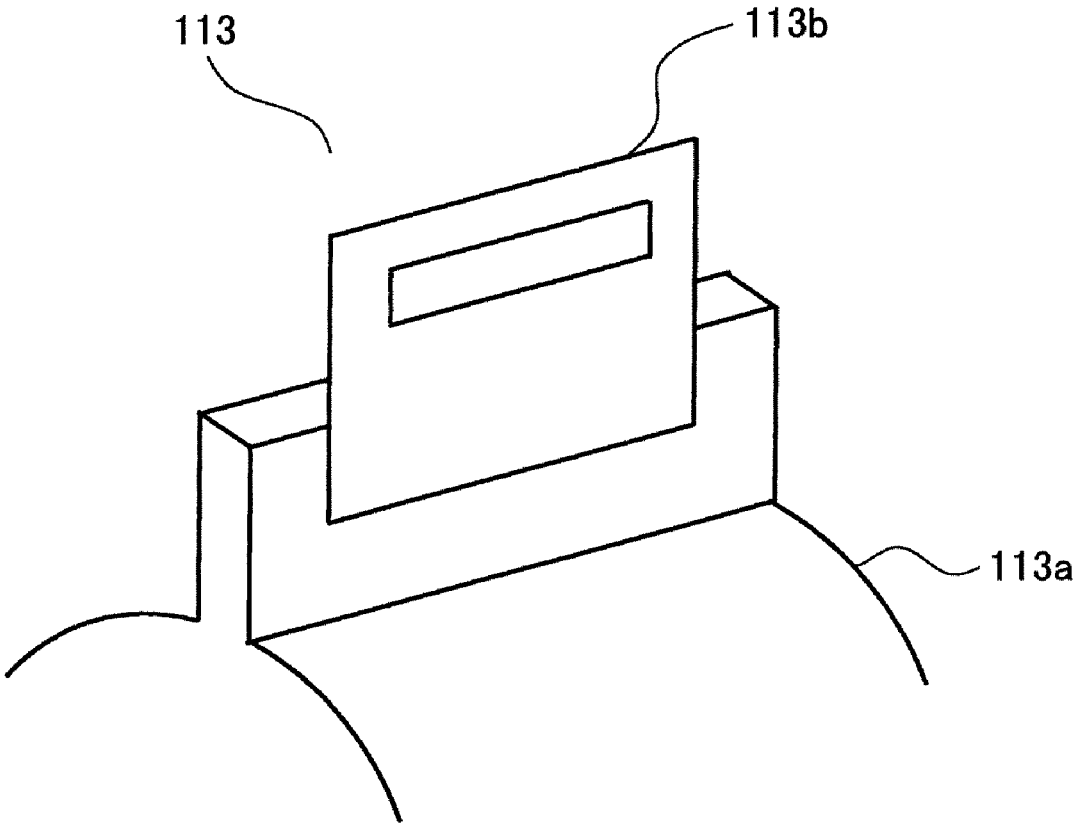
FIG. 13 is a block diagram of the agitating member for subtank.

In FIG. 12, the agitating member 113 for stirring unit slack subtanks for agitating the toner which collected in subtank 110 is formed in subtank 110. The agitator 113 for subtank comprises the revolving shaft 113*a* and the agitation member 113*b* fixed to the projection prolonged from this revolving shaft 113*a*, as shown in FIG. 13.

The agitation member 113*b* is made of a deformable laminated component, such as a resin film, and has an opening. It has toner amount detection sensor 112 for the toner amount detecting unit slack subtanks in a toner storing unit which detects the toner amount in a subtank. Toner amount detection sensor 112 for subtank is arranged below from the terminal area 110*a* with the transporting tube 120 rather than the upper part and the terminal area 110*b* with the transporting tubing 150.

When the toner amount detection sensor 112 for subtank detects those with the toner by arranging up rather than the terminal area 110*a* with the transporting tube 120, the terminal area 110*a* with the transporting tube 120 can be covered with a toner.

Therefore, when attracting the toner in a subtank with a powder pump, attracting air with a toner is lost and decline in carrying efficiency can be controlled.

If the toner are collected up rather than terminal area 110*b* with the transporting tubing 150, the toner amount made to store in subtank 110 increases too much, and large driving torque is needed for making agitating member 113 for subtank rotate.

For this reason, the nonconformity of the agitating member drive motor for subtank being enlarged will arise.

The sensor surface cleaning member 111 for subtank which cleans the surface of this toner amount detection sensor 112 is provided.

Figure 14:
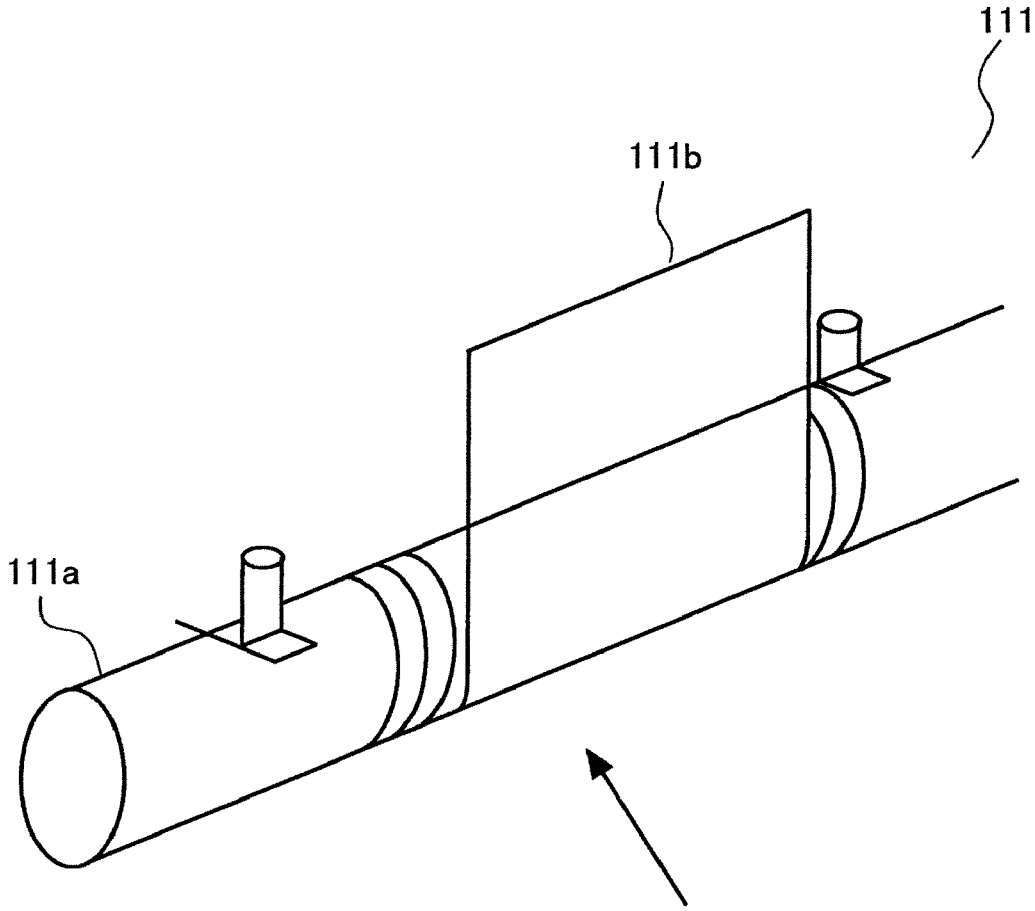
FIG. 14 is a block diagram of the sensor surface cleaning member for subtank.

The sensor surface cleaning member 111 for subtank is formed with the wire rod attached to revolving shaft 111*a* and this revolving shaft, as shown in FIG. 14, it scratches and includes picking component 111*b*.

Next, the powder pump 130 will be explained based on FIGS. 12 and 15.

Figure 15:
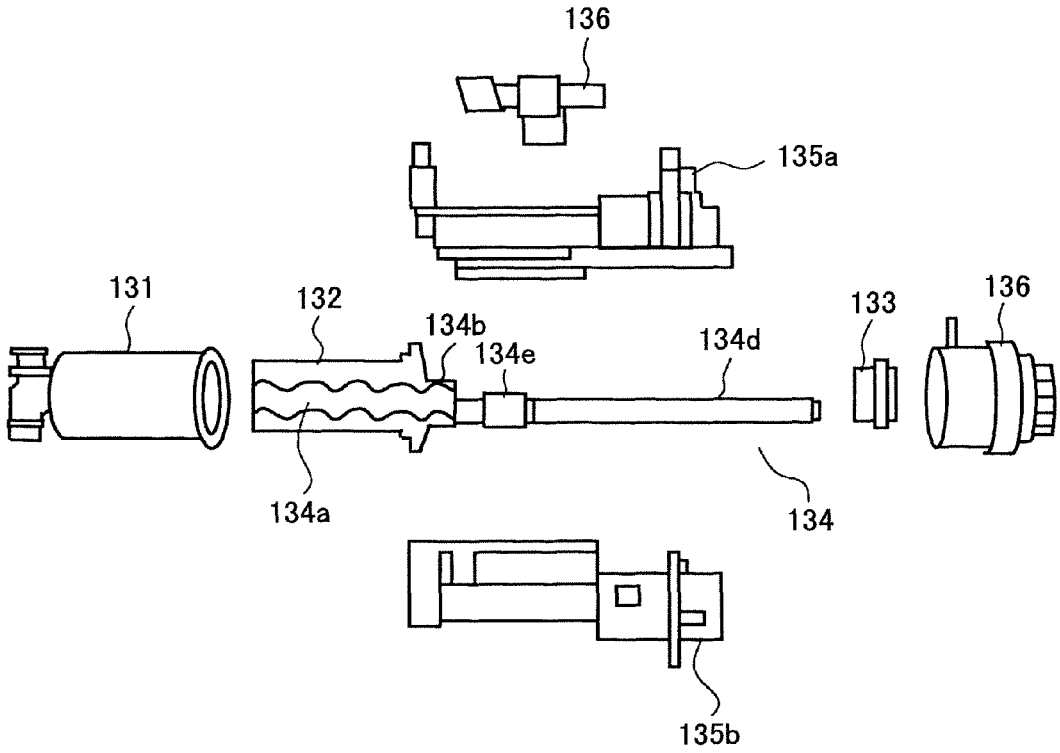
FIG. 15 is an exploded diagram of a powder pump.

FIG. 15 is an exploded view of the powder pump 130. The powder pump 130 in this embodiment is provided to attract the toner in the subtank 110 and to supply the toner to the development hopper 45 of the developing device 40. The invention is not limited to this embodiment, and, if needed, installing and using the same for other part as a powder pump action mode suitably.

As the powder pump 130, a one-axial off-center screw pump of revolution positive displacement is used. Since a one-axial off-center screw pump of revolution positive displacement does not transport powder with air like an air pump type, it needs to provide a large-scale unit in neither subtank 110 nor a powder pump, and can miniaturize the image forming device.

Since suction/discharge force is strong, a toner is not easily got blocked and the toner transporting characteristic stabilized over temporality can be maintained.

The powder pump 130 has a stator 132 which is made of an elastic body, such as rubber which has a through hole of the structure of the shape of a double-spiral internal thread, and rotor 134 in which a one-axial off-center screw part 134*a* is provided.

The screw part 134*a* of the rotor 134 is inserted in the through hole of the stator 132 pivotally.

The nickel plate is given to the inner circumference side of the through hole of the stator 132 so that it may not wear out by attrition with a toner or a one-axial off-center screw part 134*a*.

The above-mentioned stator 132 has fitted in with the inner circumference side of cap 131. The suction opening 131*a* is formed in the left-hand side of the cap 131, and the transporting tube 120 is connected to this suction opening 131*a*.

The rotor 134 has the joint part 134*b* in the right side edge part of the screw part 134*a*.

As shown in FIG. 15, the revolving shaft 134*d* is attached to the shaft end of the joint part 134*b* with the spring pin 134*e*. The bearing 133 and the clutch 136 are attached to the right side edge part of the revolving shaft 134*d* of the rotor 134.

It connects with the powder pump drive motor which is not illustrated, and clutch 136 is made to rotate rotor 134.

The case 135 is attached to the toner blow-down side edge part of the cap 131. The case 135 includes the top case 135*a* with which the top face and the back side face are formed, and the lower case 135*b* with which the near-side face is formed, as shown in FIG. 15.

Make the left side end part of top case 135*a*, and the left side end part of lower case 135*b* contact the toner blow-down side edge part of cap 131, respectively, the right side end part of top case 135*a* and the right side end part of lower case 135*b* are made to contact bearing 133, respectively, and top case 135*a* and lower case 135*b* are set.

After the top case 135*a* and lower case 135*b* have suited, by cover member 136, top case 135*a* and lower case 135*b* are held, and it fixes. The opening 137 is provided in the underside of case 135, and this opening 137 is attached to opening 147 of the development hopper 45.

Figure 16:
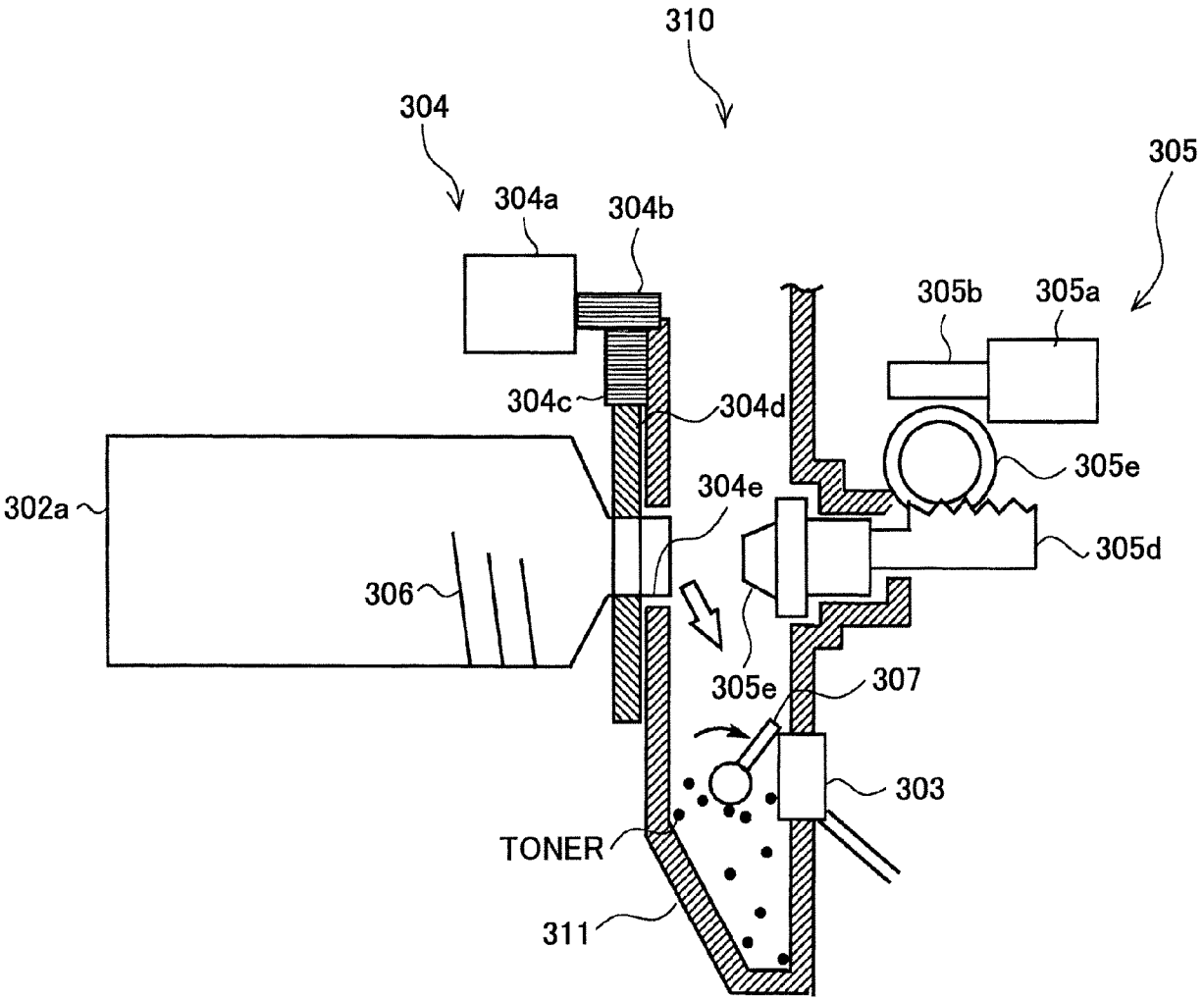
FIG. 16 is an enlarged diagram showing the internal structure of a toner bank.

Next, the internal structure of toner bank 310 will be explained. FIG. 16 is an enlarged diagram showing the internal structure of the toner bank 311.

The side face of toner bank case 311 is provided with toner bottles 302*a* and 302*b* with which it filled up with the toner as shown in FIG. 12, and toner bank case 311 is provided with toner bottles 302*a* and 302*b* by the same device.

FIG. 16 is an enlarged view of the part of the toner bottle 302*a* which is attached to the lower side face of the toner bank case 311. The bottle drive unit 304 for rotating toner bottle 302 is formed in the upper part of this toner bottle 302*a*. The bottle drive unit 304 includes bottle drive motor 304*a*, idler reduction gear 304*c* which is engaged with the motor reduction gear 304*b*, and actuation reduction gear 304*d* which wearing opening 304*e* for being provided with opening of toner bottle 302 is formed, and is engaged with the idler reduction gear 304*c*.

The bottle opening closing gear 305 is formed in toner bottle opening and the location which counters. Bottle opening closing gear 305 suits with pinion 305*d* with which cap part 305*e* which is engaged with the bottle opening-and-closing drive motor 305*a*, the opening-and-closing reduction gear 305*c* which is engaged with the motor reduction gear 305*b*, and opening-and-closing reduction gear 305*c*, and covers at the head in bottle opening is attached.

The bottle opening is covered by cap part 305*e* when not supplying the toner in a toner bottle. Under the toner bank case 311, the toner is stored and toner amount detection sensor 303 for toner bank which detects the amount of this stored toner is formed.

When it is detected that there is no toner in height predetermined in this toner amount detection sensor 303 for toner bank, bottle opening-and-closing drive motor 305*a* drives, and it is made to move in the direction which estranges cap part 305*e* from bottle opening. Thereby, bottle opening carries out opening.

If the bottle opening carries out opening, bottle opening-and-closing drive motor 305*a* will be made to drive, and toner bottle 302 will be rotated. Spiral projection 306 is formed in the toner storing part of toner bottle 302, and by revolution of toner bottle 302, the toner in a storing part is guided at spiral projection 306, moves to bottle opening, and falls from bottle opening to toner bank case 311.

If the toner amount detection sensor 303 for toner bank detects that a toner is in predetermined height, it will suspend the revolution of toner bottle 302, will move the cap part 305*e*, and will cover the bottle opening.

The sensor surface cleaning member 307 for toner bank which cleans the surface of toner amount detection sensor 303 for toner bank as shown in FIG. 16 may be formed. This sensor surface cleaning member 307 for toner bank has the same structure as the sensor surface cleaning member 111 for subtank shown in FIG. 14.

It can control the surface of toner amount detection sensor 303 for toner bank becoming dirty with a toner, and stopping achieving a predetermined function by this.

According to the device mentioned above, the toner attracted by suction pipe 37 from the inside of toner storing unit 221 as the 1st embodiment showed is stored by toner bank case 311 of toner bank 310 through the transporting passage 170 and the 2nd transporting tube 160.

The toner transported in development hopper 45 is suitably supplied in developing tank 46 based on the output signal of T sensor provided in developing tank 46, and development is presented with it.

As the intermediate powder storing part disposed in the powder passage 180, the subtank 110 between the development hopper 45 and the toner storing unit 210 is provided for collecting temporarily the toner being supplied in the development hopper 45.

The maximum capacity of the toner which can be stored inside the subtank 110 is restricted. The toner amount in the subtank 110 changes with time in connection with the consumption of toner being used by the developing device 40 for development. For this reason, the amount of the toner supplied in subtank 110 is desired to be controlled by the suitable amount based on the detection result of toner amount detection sensor 112 for subtank.

As shown in the previous embodiment, when the toner storing unit 220 is directly connected with subtank 110 with the transporting tube 120, it is actually difficult to adjust the amount of supply of the toner into subtank 110 in the fine range.

In this embodiment, the toner bank 310 as the 2nd intermediate powder storing part is provided in the location between the toner storing unit 210 and the subtank 110. For this reason, it is related with the transporting of the toner between toner banks 310 from toner storing unit 220 which has accommodated a lot of toner. It carries out by controlling the amount of supply in the rough range, and it can carry out, controlling the amount of supply in a little range about the transport of the toner between subtanks 110 based on the detection result of toner amount detection sensor 112 for subtank from toner bank 310.

As shown in FIG. 10, the recovery tank 90 and toner bottle 302 in toner bank 310 are connected by recovery way 92. The toner collected in recovery tank 90 is transported in toner bottle 302 via this recovery way 92, and is again used in the image forming device 100.

Thus, by forming the toner bank 310 other than subtank 110 as an intermediate powder storing part in this embodiment, the toner collected from cleaning device 15 and belt cleaning device 10 in the recovery tank 90 is returned to the printer part 50 of image forming device 100 by reflux apparatus slack recovery way 92, and the recovery toner can be used effectively.

In FIG. 9, it is also possible to form recovery way 95 (not illustrated) which connects recovery tank 90 and subtank 110, and to have structure which transports the toner collected in exhausting part 90 in subtank 110.

It is also possible to form recovery way 96 (not illustrated) which connects recovery tank 90 and development hopper 45, and to have structure which transports the toner collected in recovery tank 90 in development hopper 45.

The recovery way 95 can be provided also in the 1st embodiment. The recovery way 96 can be provided also in the above embodiment. Among the toner transport passages from toner storing unit 221 to developing device 40, many components, such as a drive unit of photoconductor 12 and a drive unit of developing device 40, are arranged, and it is difficult for the developing device 40 vicinity to form the transport passage of a toner in straight line shape.

For this reason, an inexpensive toner transporting unit which is provided with the coil in the transporting tube cannot be provided. For this reason, from subtank 110, even if a toner transport passage is complicated between development hoppers 45, powder pump 130 as a downstream transporting part which can transport a toner is used.

However, if the toner in the toner storing unit 221 is attracted using the powder pump 130, it is necessary to use a powerful powder pump, and the image forming device will carry out large-sized or a suction force will become a cost overrun.

In this embodiment, since subtank 110 is formed between toner storing unit 221 and powder pump 130, powder pump 130 attracts the toner currently stored in subtank 110.

For this reason, even if it can shorten the transporting distance which transports a toner with powder pump 130 and does not form powerful powder pump 130 of a suction force, a toner can be transported to a developing unit.

The toner in the toner storing unit can be transported to subtank 110 with a cheap unit by using as the transporting tubing 150 provided with coil 151*a* unit to transport the toner in toner storing unit 221 into subtank 110.

In this embodiment, like the previous embodiment, the recovery tank 90 and the waste toner bottle 102*a* in the toner storing unit 220 can be connected by the recovery way 91, and it can also have structure which collects the toners collected in recovery tank 90 in the waste toner bottle 102*a*.

Figure 17:
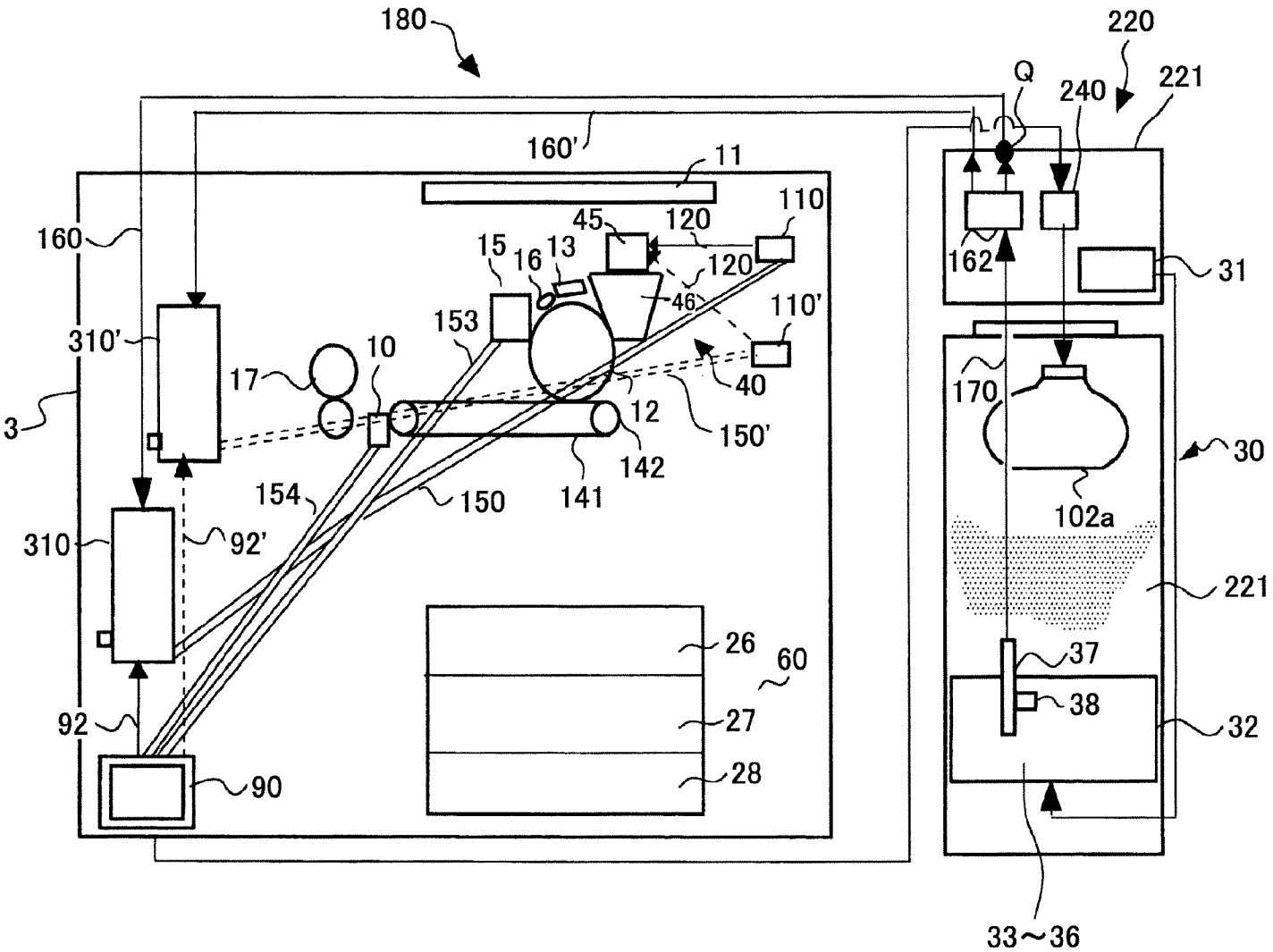
FIG. 17 is a diagram showing the structure of an image forming device in which a plurality of intermediate powder storing parts are provided.

In this embodiment, as shown in FIG. 17, the plurality of toner banks 310 can also be formed in the image forming device 100. In this case, the 2nd transporting tube is provided separately, respectively and it connects with toner storing unit 220, and the transport passage 150, the subtank 110, and the transporting tube 120 are separately formed in each toner bank 310, respectively, and are connected with development hopper 45 on it.

The toner bottle 302 is formed in the inside of each toner bank 310 by the device mentioned above, respectively. In each toner bottle 302, the recovery way 92 for connecting with recovery tank 90 is provided separately, and is connected with the recovery tank 90.

Since the toner collected in recovery tank 90 can be transported in the plurality of toner bottles 302 by this, a recovery toner can be more efficiently refluxed in printer part 50.

In the above-mentioned embodiment, although the toner is independently stored in toner storing unit 221, it is also possible to make this toner storing unit 221 inside mix a toner and a carrier. Thereby, the 2-component developing agent containing a toner and a carrier can be supplied to the developing device 40. Also in the image forming device which collects the 2-component developing agent which contains a toner and a carrier, in the developing tank 46, it is applicable. The toner storing unit 220 as a powder supply unit used in this invention being alike is not an object limited to being used by image forming device 100 and one, and can also be used with image forming device 100 and another object, it is also possible to accommodate matter, such as powder objects, such as flour and manure, a powder-like chemical, a glass bead, in powder storing unit 221 of powder storing unit 220 in this case.

It is also possible to accommodate the matter of matter with comparatively high specific gravity, such as cement, a coating, a liquefied chemical, etc., etc. which has viscosity.

If the condition of having been stored inside the container is continued for a long period of time, it will condense inside, or the matter will be solidified, and will become difficult to take it out to the container exterior.

The agitation member is installed in the inside of the container, when it has structure which agitates the toner by the revolution of this agitation member, it deteriorates by attrition and a good preservation condition cannot be maintained. Without degrading a housed article by making gas blow off to storing part 221 inside by structure mentioned above, powder storing unit 221 used in this invention can make the whole able to mobilize uniformly, and can make it possible to perform ejection to the exterior of a housed article smoothly.

Figure 19:
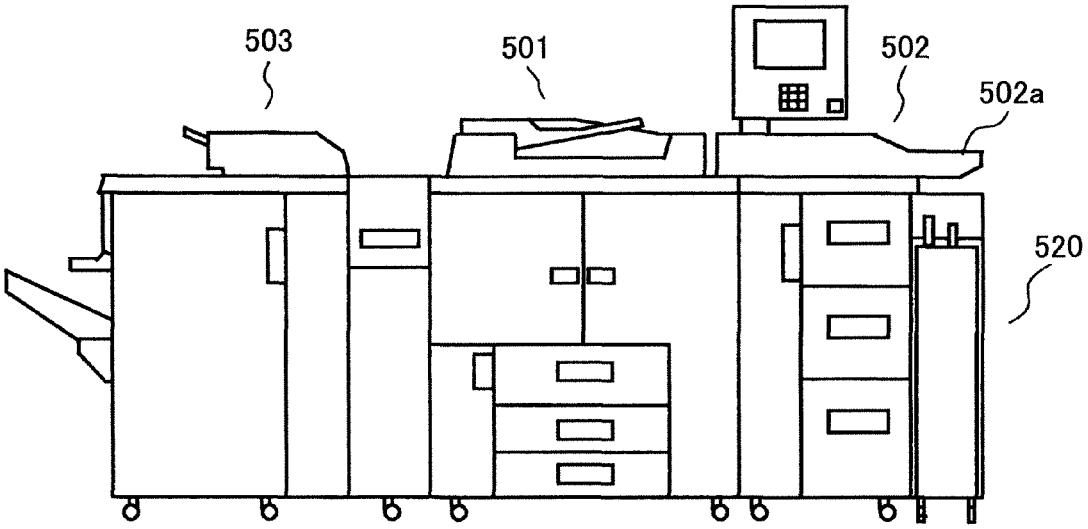
FIG. 19 is a diagram showing the composition of an image forming device in an embodiment of the invention.

FIG. 19 shows the composition of an image forming device in an embodiment of the invention. As shown in FIG. 19, it is a post processing unit with which code 501 performs an image-forming unit, 502 performs a sheet feeder unit, and 503 performs sorting, a stapler fixing, etc., and an image-forming unit is a reproducing unit of the electrophotographic printing system which uses a powder toner.

There is the wing 502*a* of the sheet feed tray projecting from the right-hand side of FIG. 19 in the sheet feeder unit 502, and powder supply device 520 which constitutes a toner supplying device in the lower part of the wing 502*a* is formed.

Although the installing location of powder supply device 520 can be set up arbitrarily, in this embodiment, the part which became a dead space by the overhang of wing 502*a* is used.

Figure 20:
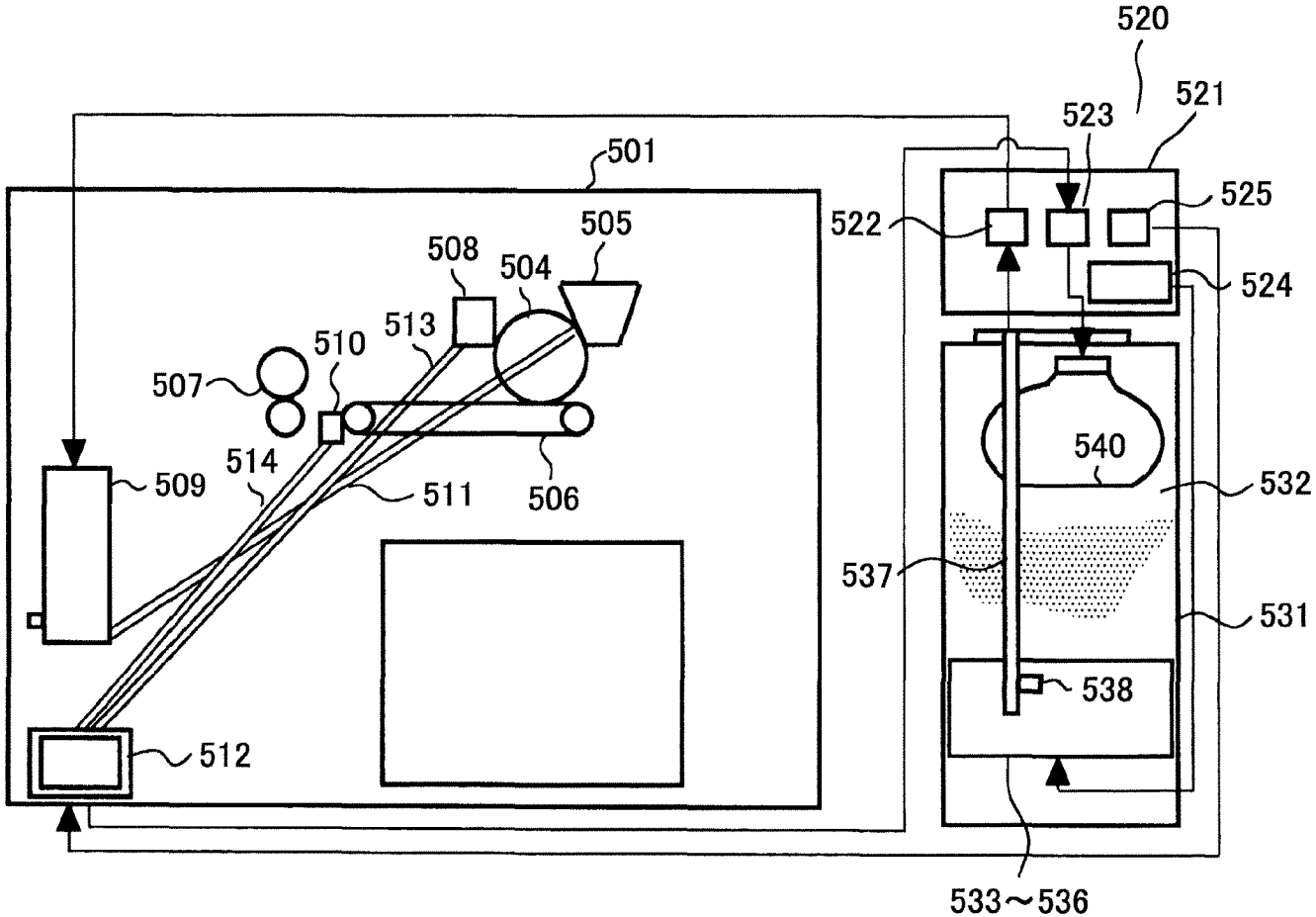
FIG. 20 is a diagram showing the connected state of a container unit and an image-forming unit.
Figure 21:
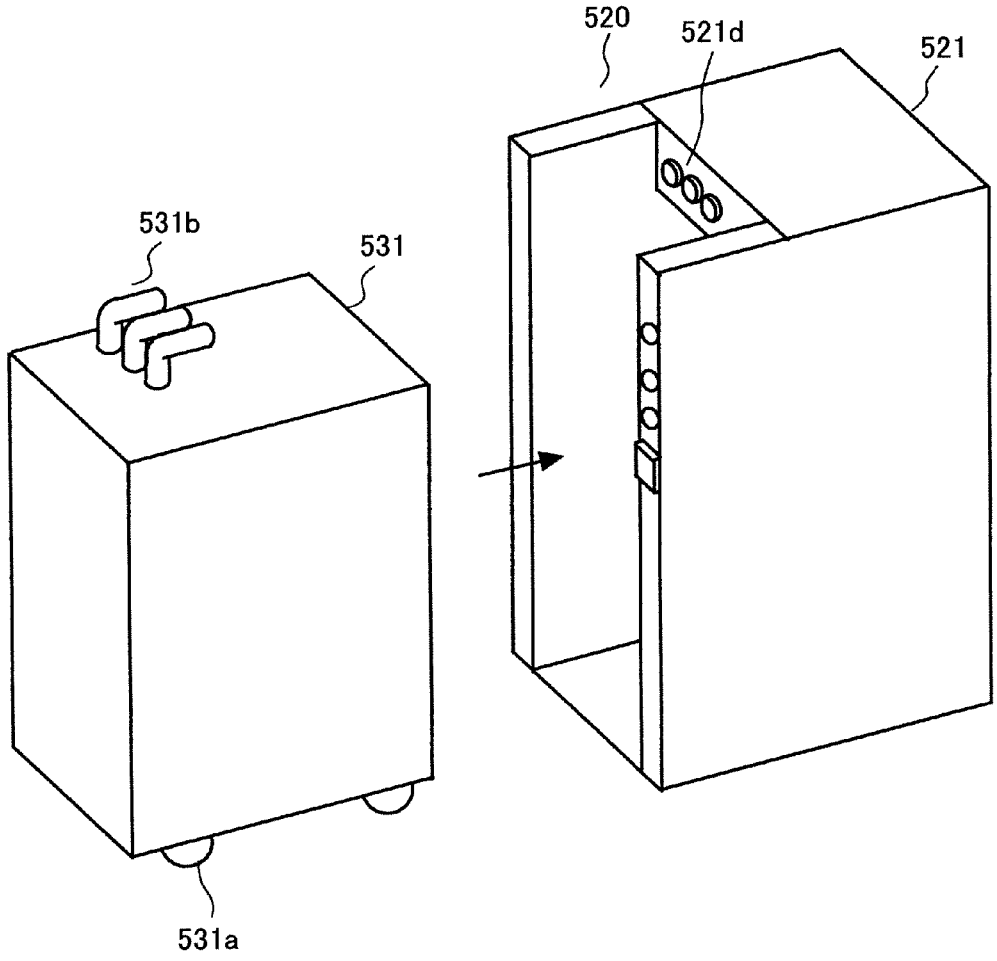
FIG. 21 is a perspective view of the container unit.

FIG. 20 shows the connected state of the image-forming unit 501 and the powder supply device 520. FIG. 21 is a perspective view of the powder supply device 520.

In FIG. 20, the image-forming unit 501 includes the photoconductor drum 504 as an image support object. When the photoconductor drum 504 is rotated in the clockwise direction by the motor, the surface of the photoconductor drum 504 is uniformly charged by the charging unit which is not illustrated.

Next, scanning exposure by a laser beam is performed to the charging part by the optical writing device, and an electrostatic latent image is formed on the surface of the photoconductor drum 504. The electrostatic latent image is turned into a visible image by the developing device 505 with toner, and the visualized toner image is transferred to the recording medium which is fed from the sheet feeding part or the sheet feeder unit 502 arranged at the lower part of the image forming device. The recording sheet is transported in the predetermined timing by the transfer belt 506.

The recording medium to which the toner image is transferred is transported to the fixing device 507, and the image is fixed to the recording medium as a permanent image.

On the other hand, the residual toner which remains on the photoconductor drum 504 surface is removed from the photoconductor drum 504 surface by the cleaning device 508. By repeating the above operation, image formation can be performed one after another.

The toner of the transfer belt 506 is cleaned by the belt cleaning 510. As shown in FIGS. 20 and 21, the powder supply device 520 is attached to the container unit 521 fixed to powder supply device 520, and container unit 521, and the body side of the image forming device comprises a dismountable powder storing unit 531 in this embodiment. The casters 531*a* are formed so that dislodging can be done easily, when it removes from container unit 521 to powder storing unit 531.

As for powder storing unit 531 of this invention, it is preferred to take the form which stands on the floor directly and is transported. It is desirable to carry in the transporting casters 531*a* which have movable wheels. However, it is large scale, if the casters 531*a* are used, the center of gravity of powder storing unit 531 will become still higher, and since it is a form every floor, there is a possibility that a user may kick carelessly and may push down. Also in such a case, by using the above structure, the scattering of the powder to the floor can be controlled.

Provided in the powder storing unit 531 are the powder storing part 532 in which the toner being supplied to the image-forming unit 501 is stored, and the waste toner recovery container 540 in the upper part of the tank. Provided in the container unit 521 are the pumps 522 and 523 which transport toner, and the air pumps 524 and 525 which supply air.

Although the toner supplied to image-forming unit 501 from powder supply device 520 is also transportable to the development hopper (not shown) of direct developing device 504, it is sent to toner hopper 509 formed in image-forming unit 501 by this embodiment.

The toner sent to toner hopper 509 is transported by the development hopper of developing device 505 through transport passage 511 by toner transporting unit, such as a toner transporting coil and a powder pump.

Figure 22:
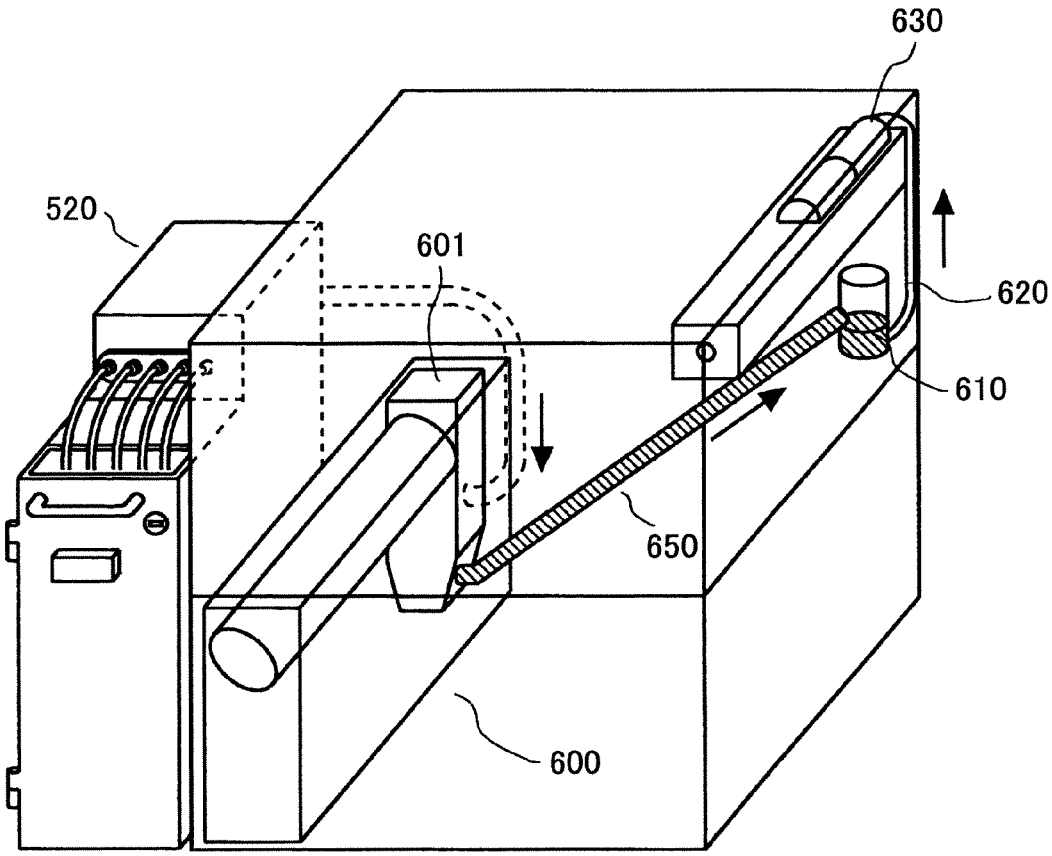
FIG. 22 is a diagram showing the transport passage of the powder which uses a development hopper.

FIG. 22 shows the transport passage of the powder which uses a development hopper. The toner supplied to image-forming unit 501 from powder supply device 520 is transported by toner bank case 5101, further, passes along the transporting tubing 650 and is transported to subtank 610. It is transported via the transporting tube 620 to the development hopper 640 of developing device 504.

Figure 23:
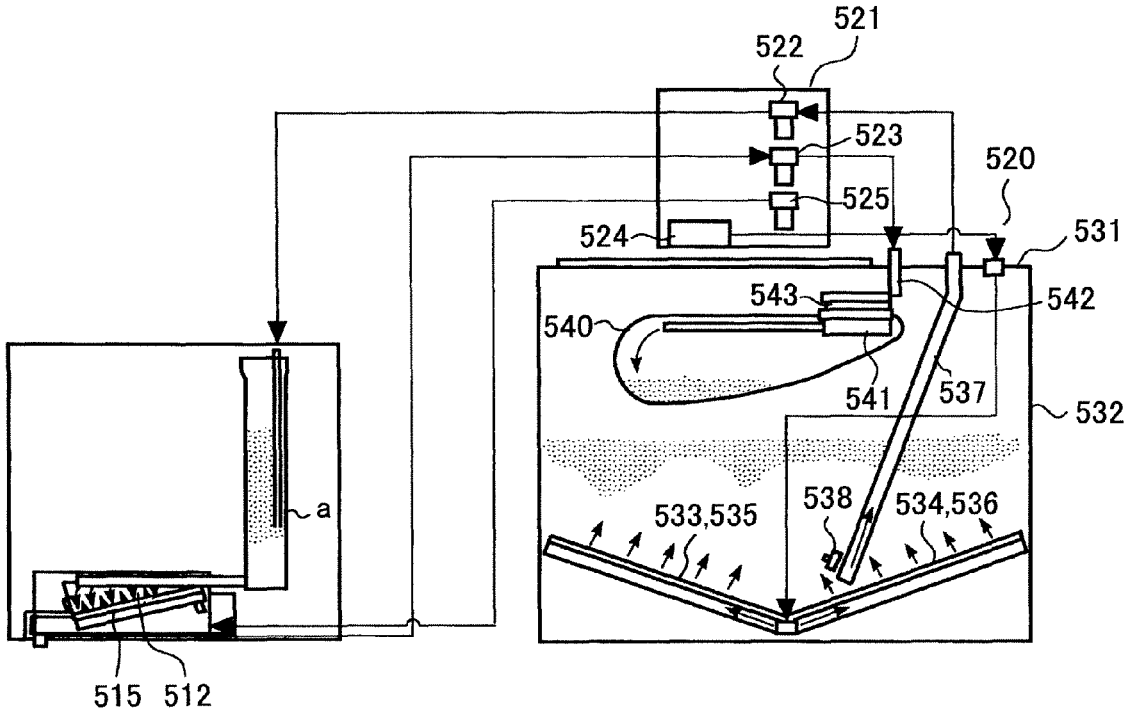
FIG. 23 is a diagram showing the internal structure of a container unit.

FIG. 23 shows the internal structure of powder supply device 520. The powder storing part 532 of the powder storing unit 531 is inclined in the shape of V, and the inclination angle θ should be smaller than the resting angle of the toner stored in this embodiment, it is set as about 20 degrees and the toner resting angle is about 40 degrees.

Figure 24:
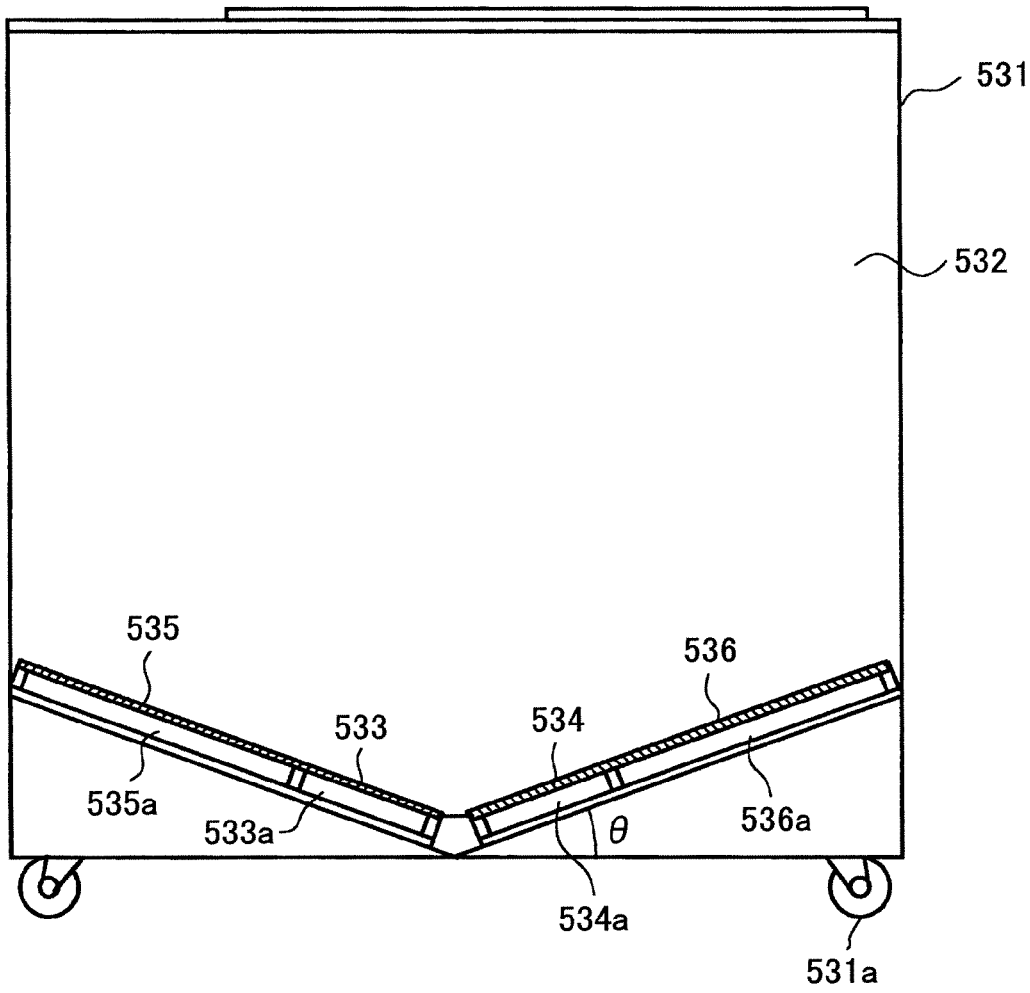
FIG. 24 is a diagram showing the composition of a powder storing unit.

If the inclination angle θ of the floor is set up gently, it is possible to make the dead space by dip small. And as shown in FIG. 24, the fluid membrane which is an air blowout component which includes porous members 533, 534, 535, and 536 is provided in the above-mentioned top of flooring.

This powder storing part 532 can secure the maximum containing amount on a tooth space by using that cross-section configuration as a rectangular parallelepiped.

As a material of porous members 533-536, there is no restriction in particular and it can choose suitably according to the object. For example, there are porosity resin materials, such as glass, a sintered body of a resin particle, resin by which photoetching is carried out, and resin punched thermally, metal sintered bodies, metal plate-like material by which punching is carried out, a net layered product, etc. in the material of porous members 533-536. Air chambers 533*a*, 534*a*, 535*a*, and 536*a* connected to air pump 524 are formed in the lower part of porous members 533-536.

The acreage of lower porous members 533 and 534 is set up smaller than the acreage of upper porous members 535 and 536. Similarly, the capacity of lower chambers 533*a* and 534*a* is set up smaller than the capacity of upper chambers 535*a* and 536*a*.

If the air pump 524 operates, the toner stored via the air chambers 533*a*, 534*a*, 535*a*, and 536*a* by air blowing off from the porous members 533, 534, 535, and 536 which are fluid membrane will be supplied, and a toner will be mobilized. That is, the toner is mobilized by air like a liquid. And the mobilized toner is attracted from the toner suction tubing 537 by the pump 522, and it is transported to the toner hopper 509 in the image-forming unit 501.

If the toner is attracted upwards, it is sent to the image-forming unit 501 to a location higher than the storage location of the powder storing part 532. For this reason, the toner scattering is stopped to the minimum of the toner in the powder storing part 532, and passes along the inside of the transporting tubing slightly even if problems, like the powder supply device 520 and the transporting tubing between the image-forming unit 501 separate accidentally occur.

Moreover, the capacity of the lower air chambers 533*a* and 534*a* is smaller than the capacity of the upper air chambers 535*a* and 536*a* and the acreage of lower porous members 533 and 534 is smaller than the acreage of the upper porous members 535 and 536. If the equivalent amount of air is supplied to each of the air chambers 533*a*, 534*a*, 535*a*, and 536*a*, the air which blows off from lower porous members 533 and 534 will become homogeneity from the air which blows off from upper porous members 535 and 536. Therefore, the toner attracted with toner suction tubing 537 can make it mobilize more certainly.

Near the suction opening of the toner suction tubing 537, the sensor which detects the existence of toner is provided as the near-end sensor 538.

The filter 539 (FIG. 25B) which prevents that the internal pressure in the powder storing part 532 from be increased by the air supplied is provided in the upper part. If the powder storing part 532 is the upper part from the waterline of the full-condition toner, not only the upper part of the powder storing part 532 but the side part is sufficient as this filter 539, and the material of the filter 539 may be the same as that of the porous member.

For example, a sheet of Gore-Tex (the registered trademark; produced by Japan Gore-Tex Co.) which is a continuation porous-structure object made of fluororesin may be used as the material of the filter 539.

The toner transported to the toner hopper 509 of the image-forming unit 501 from the powder storing part 532 of the powder supply device 520 is transported to the development hopper of developing device 505 through the transport passage 511, and development is performed with the developing device 505.

In this powder supply device 520, the powder storing unit 531 storing toner can be removed from the container unit 521, and it can be moved. If the toner in the powder storing part 532 becomes empty mostly, the supply of toner can be performed by exchanging it with a new powder storing unit 531 which is filled up with toner.

The powder storing unit 531 has a power supply separate from that of the image-forming unit 501, and if the toner remains in the image-forming unit 501 in part, it is possible to exchange the powder storing unit 531, without turning off the image-forming unit 501.

By the way, some toner which adhered to the photoconductor by the development is not transferred to the recording sheet, and it remains on the photoconductor surface. The residual toner is removed by the cleaning device 508. Stain and toner adhering to the transfer belt 506 are removed by the belt cleaning 510.

When it accumulated in the recovery container provided in the image forming device by making into the waste toner the toner removed by cleaning and the recovery container filled conventionally, operation of a machine is stopped and it is exchanging for a new recovery container.

In the conventional structure, a 30-40 kg toner can be stored to powder storing part 532 of powder supply device 520. When about 10% of photoconductor adhering toners should remain and all toners are exhausted, about 3-4 kg of the waste toner is collected. Therefore, what is about 10 kg with large-sized capacity of the recovery container for the user who consumes about 30 kg of toners in one month must be exchanged every 2 or 3 months.

Although enlarging the capacity of the recovery container and reducing the exchange frequency is also considered, it is difficult for there to be the end in the capacity of the recovery container provided in image-forming unit 501, and to enlarge the capacity of the recovery container.

In this embodiment, the toner collected in cleaning of the image-forming unit 501 is sent to the waste-toner recovery container 540 by forming the waste-toner recovery container 540 which stores the waste toner in the powder storing unit 531. The waste-toner recovery containers 540 are also collected together at the time of exchange of powder storing unit 531. Exhausting part 512 is formed in image-forming unit 501, and, the toner removed by cleaning device 508 is sent to exhausting part 512 via the transport passage 513.

The toner removed by the belt cleaning 510 is brought together in the exhausting part 512 via the transport passage 514. The fluid membrane where the floor includes the porous member 515 like the powder storing part 532 is provided in this exhausting part 512. Air blows off from the porous member 515 with air pump 525. Fluidization of the recovery toner to which fluidity became scarce by the blowdown of air is attained, and even the above-mentioned powder supply device 520 can be easily transported by suction of pump 523.

The reinforcement of the waste-toner recovery container 540 does not need to take the impact from the outside etc. into consideration, either. Therefore, the waste-toner recovery container 540 can consist of flexible resin bag-making (for example, plastic bag). Although the waste-toner recovery container 540 is attached to set part 541 with an elastic band etc., line 542 into which the waste toner is sent, and filter 543 which extracts air are formed in this set part 541. Thus, the line 542 and the filter 543 can be attached to the waste-toner recovery container 540 by operation by providing the line 542 and the filter 543 in the set part 541.

Figure 25A:
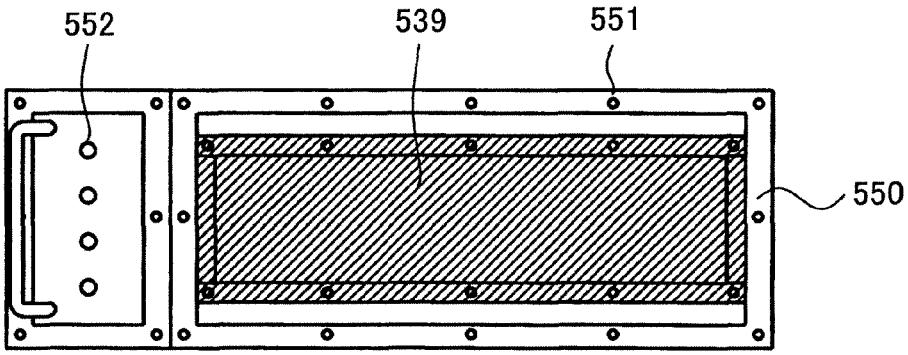
FIG. 25A and FIG. 25B are diagrams showing the structure of a powder storing unit.
Figure 25B:
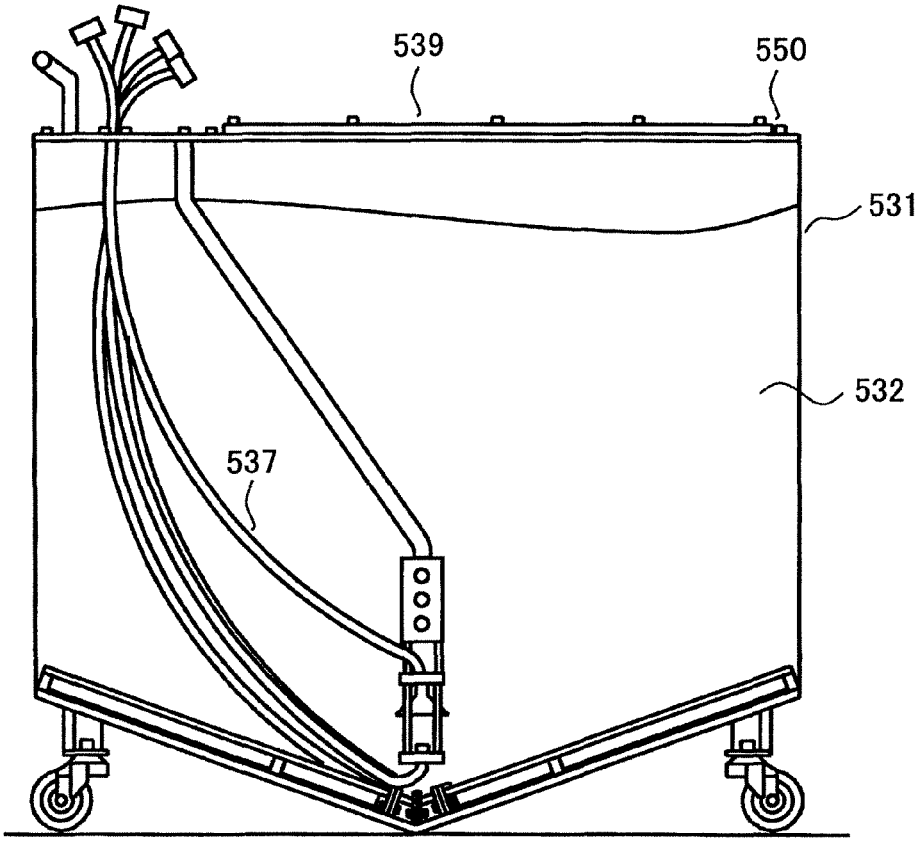

FIG. 25A and FIG. 25B show the structure of a powder storing unit. FIG. 25A is a diagram showing the powder storing unit 531 when viewed from the top face. FIG. 25B is a diagram showing the powder storing unit 531 when viewed from the side face. As shown, the lid 550 is provided on the top of the powder storing unit 531, and this lid 550 closes the opening for supplying powder to the inside of the powder storing unit 531. Fixture 551 is provided as a restricting unit which restricts a free passage and cutoff of a closing gear, and lid 550 is made to fix to powder storing unit 531 with fixture 551. The fixture 551 in this embodiment is a set of screws in which the screw thread is formed in the anti-clockwise rotation direction, which is opposite to the rotation direction of the normal screw thread. Since it is a reverse end screw thread, it can be made the configuration which uses an adapter for exclusive use for opening and closing of the screws. Thereby, actuation of the third party who does not know the maintenance method of this unit can be checked. It is possible to prevent careless opening of the lid, and it is possible to increase the safety at the time of the exchange work of a mass powder storing unit.

Since it has filter 539, toner supply is performed where the lid is usually shut. Thereby, the safety at the time of the exchange work is secured, and the tightness of scattering of the toner from the powder storing unit 531 and the accident at the time of toner exchange can be increased.

Figure 26A:
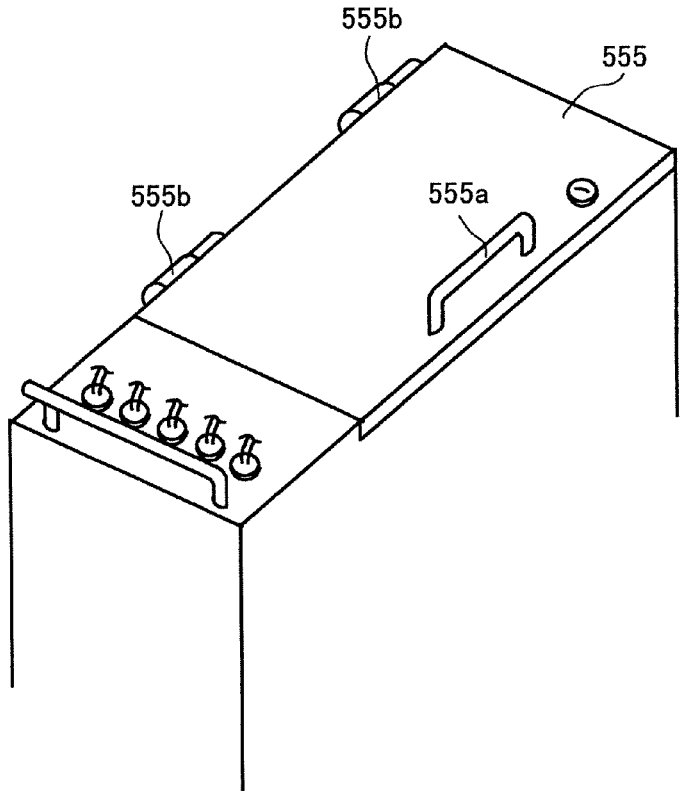
FIG. 26A and FIG. 26B are diagrams showing the opening-and-closing pattern of a lid.
Figure 26B:
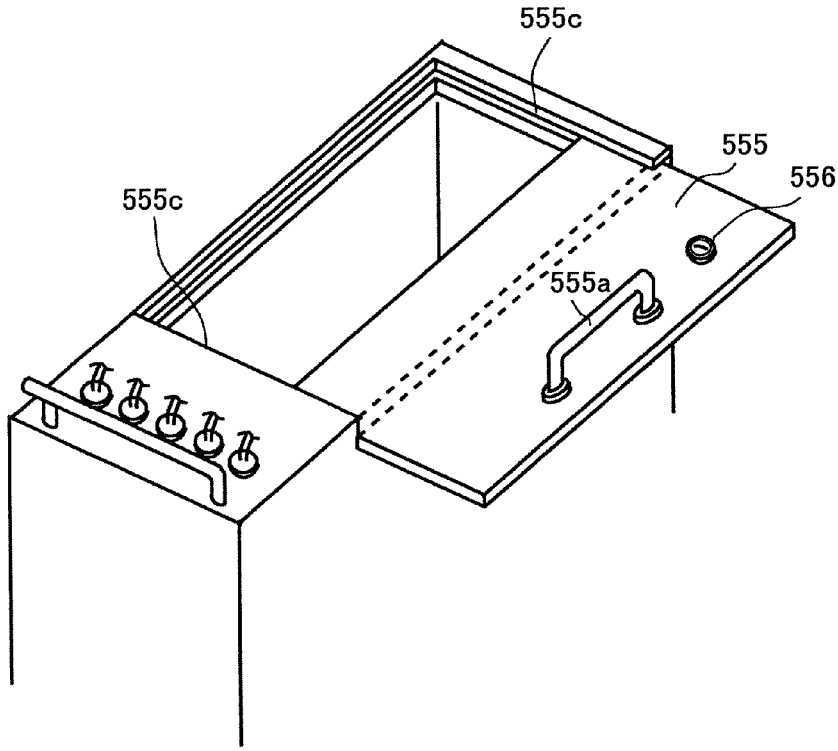

FIG. 26A and FIG. 26B show the opening-and-closing pattern of the lid. The lid 550 can be opened and closed, and as shown in FIG. 26A, opening for supplying powder can also be made into wrap door 555.

It is provided with this door 555 by hinge 555*b* which is in the top face of powder storing unit 531 about that end. Thereby, in addition to safety, opening and closing of lid 550 can be performed easily, and improvement in working efficiency can be aimed at.

It can also be covered a slide type with lid 550 as shown in FIG. 26B. In FIG. 26B, the lid 550 can be moved toward the diagonal below, and it can open and close.

The rail 555*c* for the slide can also be provided at the end of opening for supplying the powder of the powder storing unit 531 so that it may be easy to slide the lid 550. As for the lid 550, the confidentiality influences the transport performance in the mass powder storage unit of the air carrier system, and it is preferred that it is heavy. Also in such a case, it becomes unnecessary to lift the lid by making it the slide-type lid 550, and the increase of the safety and the person in which the force is still weaker can also work easily more.

FIGS. 27A-27D show the structure of a cylinder type lock. The cylinder-type lock is used as the fixture 551 which fixes the lid 550 to the powder storing unit 531.

Figure 27A:
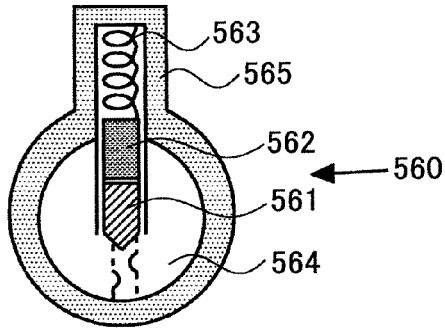
FIG. 27A, FIG. 27B, FIG. 27C, and FIG. 27D are diagrams showing the structure of a cylinder type lock.
Figure 27B:
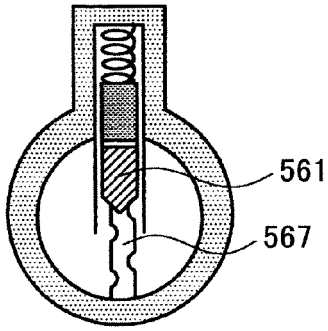
Figure 27C:
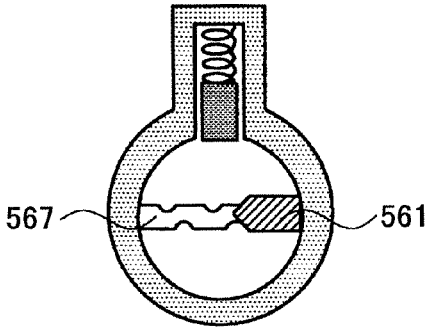

FIG. 27A shows the condition when extracting a key, a condition when FIG. 27B inserts a key, and a condition when FIG. 27C locks. Pin 560 of FIG. 27A includes tumbler pin 561 and driver pin 562, and spring 563 is being fixed to the upper part of driver pin 562. Therefore, since pin 560 is extended with spring 563 and it enters in flame tube 564 in the state of FIG. 27A which does not insert key 567, a revolution of flame tube 564 can be prevented. Insertion of the key 567 will coincide with the boundary 566 of the contact surface of the tube 564 and outer casing 565, tumbler pin 561, and driver pin 562. Therefore, by rotating key 567, as shown in FIG. 27C, only flame tube 564 can rotate and it can lock.

Figure 27D:
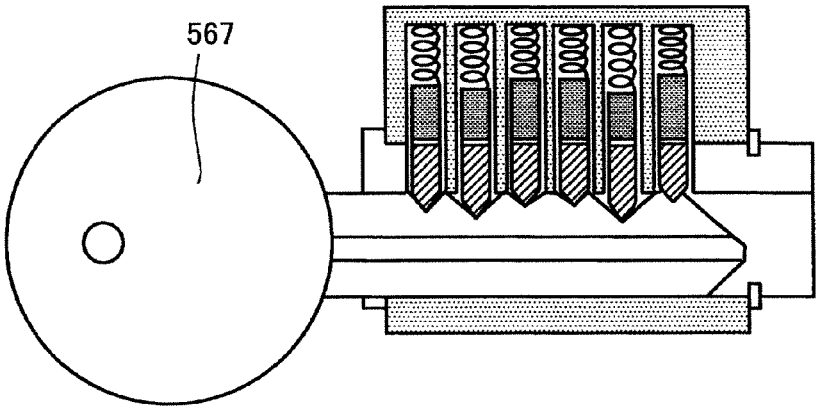

FIG. 27D shows the condition that boundary 566 of the contact surface of flame tube 564 and outer casing 565, tumbler pin 561, and driver pin 562 is in agreement.

Although the die length of pin 560 is decided according to the configuration of key 567, boundary 566 of all the tumbler pins 561 and driver pins 562 can rotate flame tube 564 only in accordance with the case where regular key 567 is inserted.

Keyhole 556 for key 567 is provided in the top face of powder storing unit 531, and with key 567, where lid 550 is shut, it can be locked. Key 567 can cancel the lock.

Even when not hanging key 567, units (not shown), such as a notch for holding in the location, where lid 550 is shut, can be provided. By shutting lid 550 formed in the top face of powder storing unit 531, and hanging key 567, even when it becomes impossible for any persons other than people with key 567 to open lid 550 and an operator leaves near a machine, the effectiveness of preventing opening and closing of lid 550 by an outsider can be heightened.

When the lid 550 is shut, the effectiveness of preventing leakage and scattering of a toner can also be heightened irrespective of whether key 567 is hung.

In this embodiment, although the example of the pin cylinder is shown as a cylinder-type lock, a magnetic cylinder, a disc cylinder, a yarn deflection plate cylinder, etc. can be used. The electronic lock can be used as fixture 551 which fixes lid 550 and powder storing unit 531.

Figure 28:
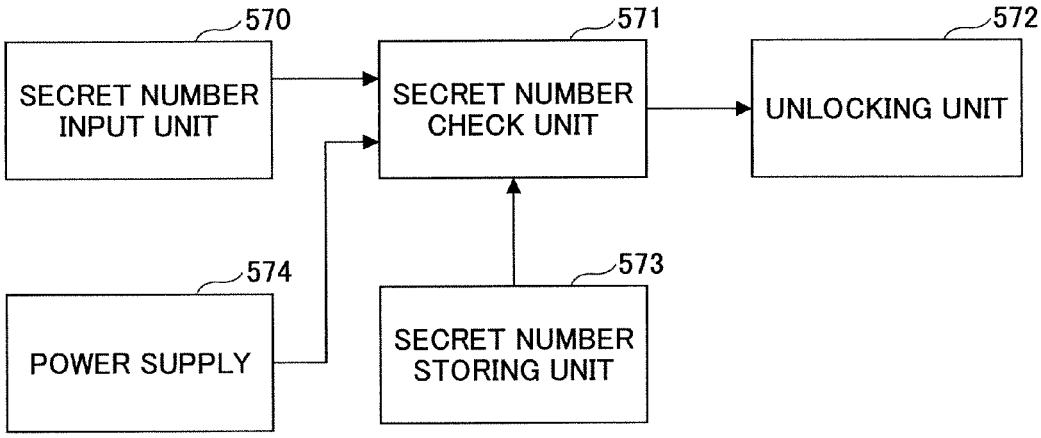
FIG. 28 is a diagram showing the structure of an electronic lock.
Figure 29:
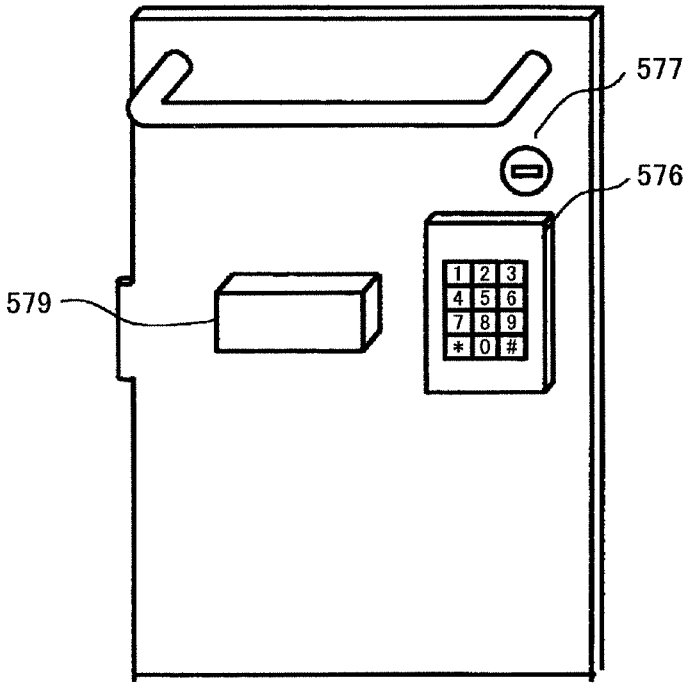
FIG. 29 is a diagram showing the push button of an electronic lock.

FIG. 28 and FIG. 29 explain the electronic lock of this invention. FIG. 28 shows the structure of the electronic lock. As shown, the secret number memory unit 573 by which the electronic lock of this invention stored the secret number for unlock, the secret number input unit 570 which inputs a secret number, and the inputted secret number and the secret number stored in the secret number memory unit are compared, and it has the secret number check unit 571 which outputs an unlock command signal when both are in agreement, and unlocking unit 572 which unlocks a lock in response to an unlock command signal.

FIG. 29 shows the push button of the electronic lock of this invention. As shown in FIG. 29, the electronic lock of this invention constitutes the electronic lock which has push button 576. When unlocking, the secret number input unit 570 is operated and a secret number is inputted.

The inputted secret number is changed into an electrical signal and sent out to the secret number check unit 571. Then, the secret number check unit 571 of the electronic lock compares the inputted secret number with the secret number stored in the secret number memory unit 573, and only when the secret numbers are in agreement, it outputs an unlock command signal.

If the unlock command signal outputted from the secret number check unit 571 is received, unlocking unit 572 will drive the stepping motor for unlock, and will unlock the electronic lock. The operator can register freely that rewriting of a secret number is possible, then the desired secret number, using EEPROM (electrically rewritable read only memory) etc. as the secret number memory unit 573 of the electronic lock.

Since it becomes unnecessary to build in a power source in an electronic lock when supplying power source 574 of powder storing unit 531 to an electronic lock, the electronic lock can be miniaturized more. The battery exchange becomes unnecessary, and the maintenance is unnecessary.

Figure 30:
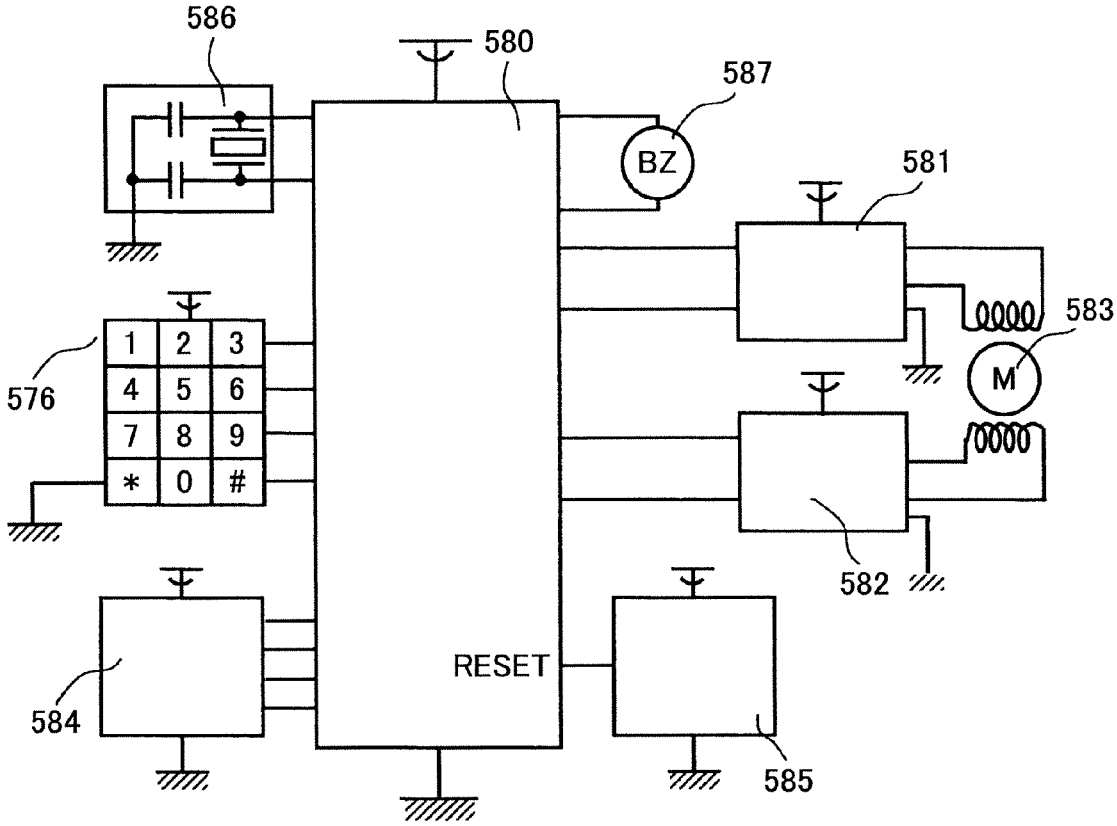
FIG. 30 is a diagram showing the electric circuit of an electronic lock.

FIG. 30 shows the electric circuit of the electronic lock. In FIG. 30, reference numeral 580 indicates MPU (microprocessor), and reference numerals 581 and 582 indicate the motor drive circuits for rotating the stepping motor 583. The forward or reverse direction rotation of the stepping motor 583 can be made freely by changing the phase angles $\psi 1$ and $\psi 2$ of the driving pulse outputted from the motor drive circuits.

In FIG. 30, reference numeral 584 indicates EEPROM (memory) which stores the control program and the secret number, reference numeral 585 indicates a power-on-reset circuit which resets the circuit to the initial state automatically at the time of the power-source charge, reference numeral 586 indicates a time constant circuit for clock oscillation, and reference numeral 587 indicates an electronic buzzer. In FIG. 30, reference numeral 576 indicates a push button. The operator operates the push button 576 to input the secret number to unlock the electronic lock.

Figure 31:
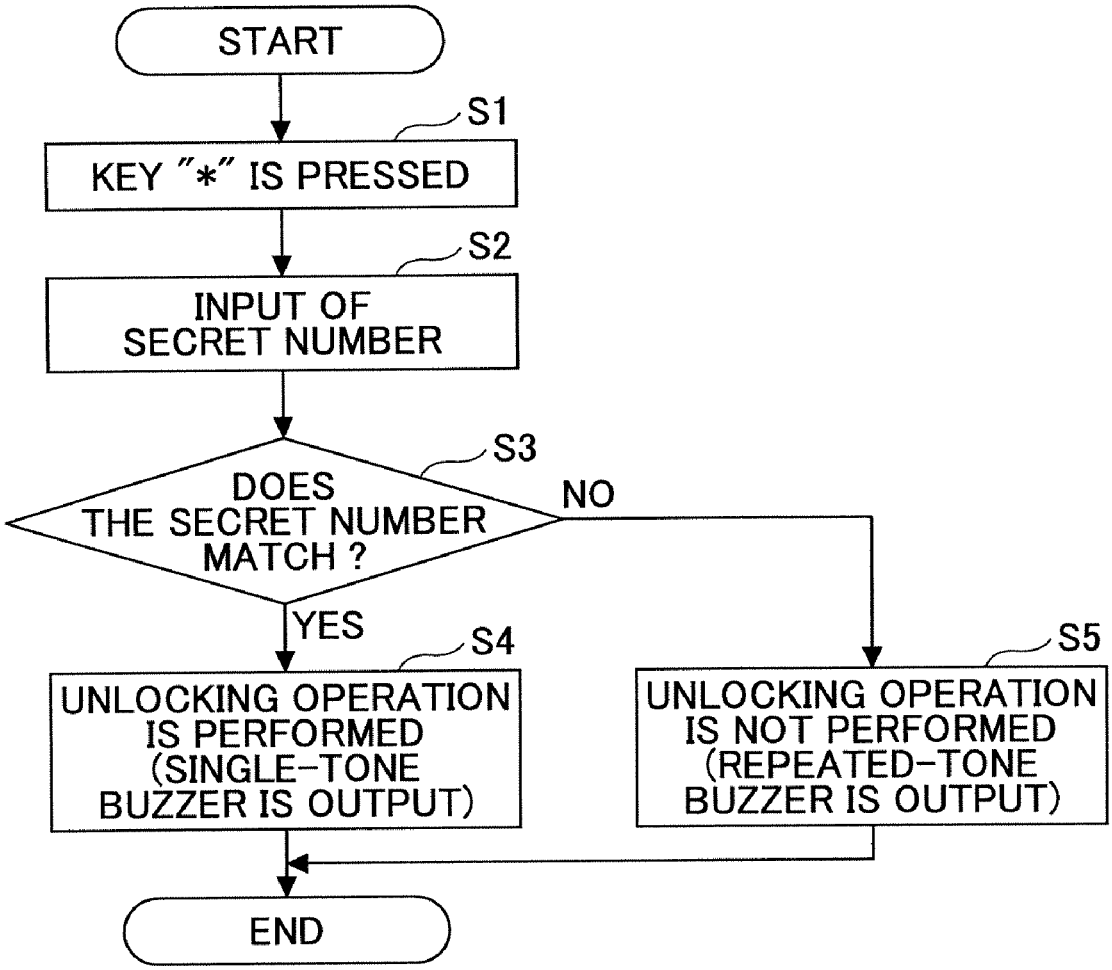
FIG. 31 is a flowchart for explaining an unlock operation of the electronic lock.

Next, the unlock operation using the electronic lock will be explained. FIG. 31 is a flowchart for explaining the unlock operation of the electronic lock. Four digits are beforehand registered into the memory in the electronic lock as the secret number for unlocking. The secret number is not memorized in the secret number input unit 570.

When using the secret number input unit 570 which has the push button 576, the operator needs to make a note of or do the code of the secret number set as the electronic lock, and needs to memorize by a certain method. This secret number can be rewritten freely.

In order to unlock the electronic lock by the push button 576, the "*" key of push button 576 is pressed (step S1). Thereby, a power-source connection circuit operates and feed initiation of the power source 74 is carried out to the electronic lock.

Subsequently, each of several characters of the secret number is inputted one by one from the push button 576, and finally the "#" key which indicates the end of the input is pressed (step S2). The MPU 580 transmits the secret number inputted according to the predetermined transmission format to the electronic lock.

When each key of the push button 576 is pressed, the electronic buzzer 587 outputs a single-tone sound, indicating that the key is pressed. When no key is pressed for 15 seconds after the "*" key is pressed, the power source 574 is turned off automatically.

It is detected whether the secret number sent from the secret number input unit 570 and the secret number of the electronic lock stored in the memory are in agreement (step S3).

When they are in agreement, the status signal "1" which indicates that the result is in agreement is outputted to the secret number input unit 570, and the motor drive circuits 581 and 582 are driven so that the unlock operation is started (step S4).

And when the unlock operation is performed, the electronic buzzer 587 outputs a long-tone sound and the LED is turned on so that the processing is ended (step S6).

On the other hand, when they are not in agreement, the processing is ended after the electronic buzzer 587 outputs a repeated single-tone sound for a fixed time, which indicates that the lock cannot be unlocked (step S5).

Only when the secret number inputted from the push button 576 and the secret number registered into the electronic lock are in agreement, the electronic lock is unlocked. Therefore, unless the secret number is known, the electronic lock cannot be unlocked.

Figure 32:
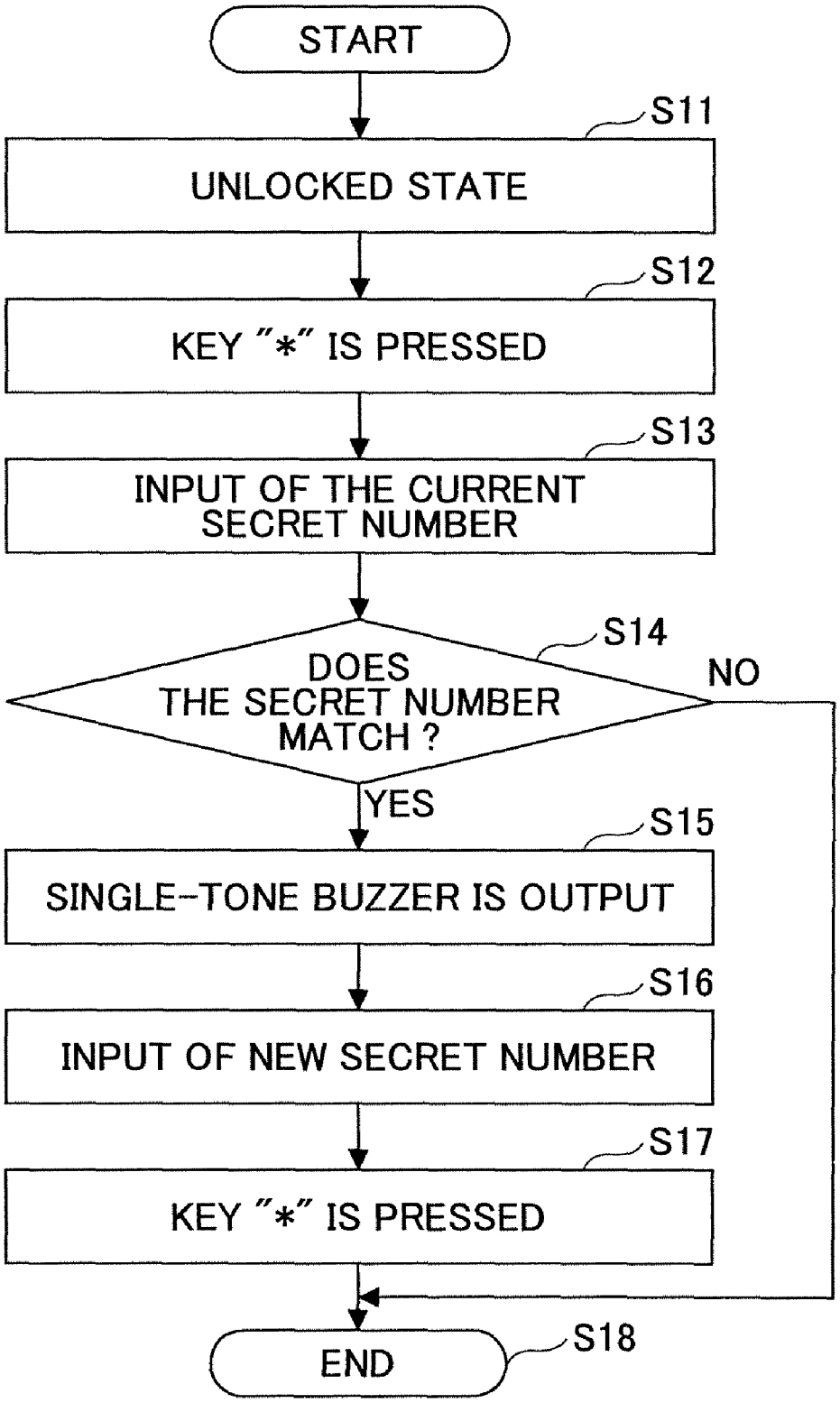
FIG. 32 is a flowchart for explaining a changing process of a secret number registered in the electronic lock.

FIG. 32 is a flowchart for explaining the change processing of the secret number registered into the electronic lock.

When changing the secret number registered into the electronic lock, the key "*" is pushed using the push button 576 and it is set in a secret number input mode (step S12). Since a short sound buzzer sound is outputted if it is set in the secret number input mode, the secret number registered after that now is inputted (step S13).

It is detected whether the input secret number and the secret number stored in the memory are in agreement (step S14). When they are in agreement, a short sound buzzer sound is outputted and the lock is set in an unlock condition (step S15). The electronic lock is set in a secret number change mode (step S16). The processing is ended when the input secret number is not in agreement with the secret number stored in the memory (step S8). In the secret number change mode, the desired four-digit secret number is inputted and the "*" key which indicates the end of the input of the secret number is pressed (step S17). Thereby, the new secret number is sent to the electronic lock in a predetermined transmission format. The MPU 580 of the electronic lock deletes the old secret number stored in the memory 584 and stores the new secret number. After the registration of the new secret number is performed, a single-tone sound is outputted by the electronic buzzer 587, which indicates that the secret number is changed.

When the push button 576 is not operated over a predetermined time (for example, 15 seconds) during the processing, the power source 574 is turned off automatically and the processing is ended. At the time of factory shipment, "0000" is registered into the electronic lock as an initial secret number, and when the change processing of the secret number is performed for the first time after shipment, "0000" will be inputted.

Although the administrator can set up a secret number arbitrarily, a lot number and a toner delivery date to the powder storing part 532 may be used. Not only the safety but the management of quality can be performed. However, as for the input of the lot number or the toner delivery date to the powder storing part 532, it is desired to perform enciphering in order to secure the confidentiality of the user.

In this embodiment, it is added as conditions of which the restriction of the restricting unit that powder storing unit 531 enables a free passage with the external space and the internal space through the opening is canceled that the amount of the remaining powder in powder storing unit 531 has turned into below the predetermined amount.

The toner residual amount in powder storing unit 531 can periodical or constant be supervised by sensor 538, and it is transmitted to the electronic lock by making the sensor 538 detection result into an electrical signal each time. And when the toner residual amount in powder storing part 532 becomes below in a predetermined amount and changes into a near end condition, the unlock conditions of the electronic lock are met, and subsequently the operator can unlock the lock.

Thereby, while playing the role of a double key, the prevention of unsuitable opening and closing can be increased and the safety can be increased. The effectiveness of the exchange work can also be raised by being interlocked with the opening and closing at the time of toner exchange.

FIGS. 33A-33D are diagrams showing the composition of the powder supply device.

Figure 33C:
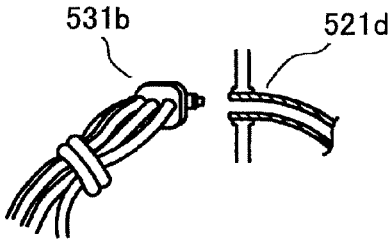
FIG. 33A, FIG. 33B, FIG. 33C, FIG. 33D are diagrams showing the composition of a powder supply device.
Figure 33A:
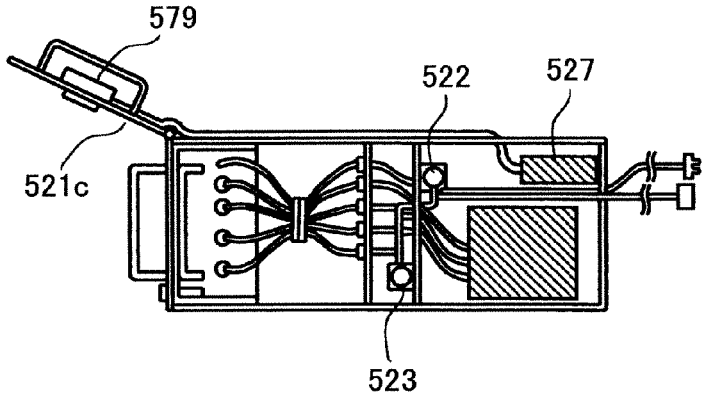
Figure 33D:
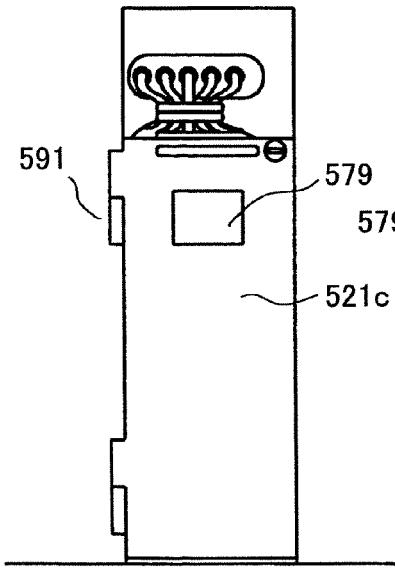
Figure 33B:
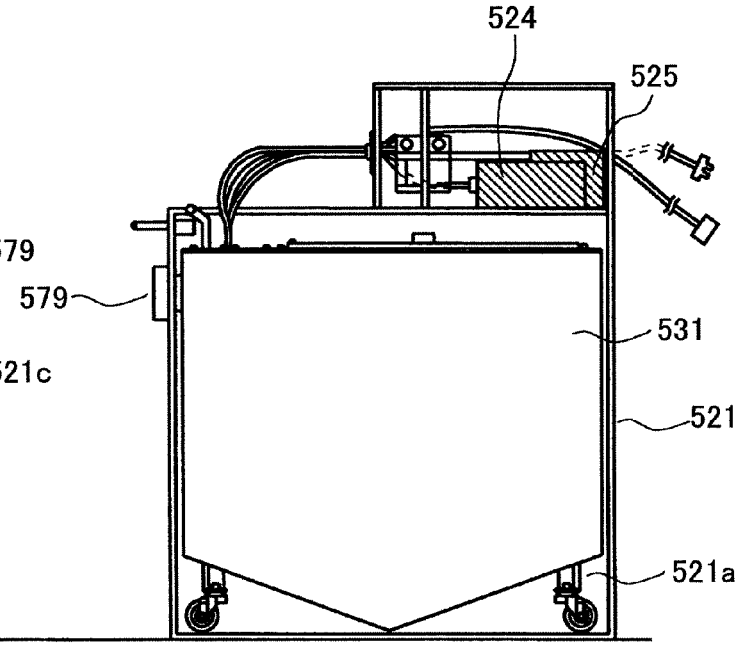

As shown in FIG. 33A and FIG. 33B, the container unit 521 includes a powder-storing-unit container part 521*a* which accommodates the powder storing unit 531, an opening through which the powder storing unit 531 enters and leaves the container unit 521, and a door 521*c* which is a 2nd opening/closing unit that opens and closes the opening of the container unit. By using the hinge 591, opening or closing of the door 521*c* is allowed, thereby enabling entering and leaving of the powder storing unit 531 (FIG. 33D). Thus, it is possible to prevent the unexpected running out and falling of the powder storing unit 531, and the prevention of the toner scattering and the safety to the operator can be secured. Since the powder storing unit 531 and the container unit 521 are connected by each connection part 521*d* and 531*b*, the effectiveness the prevention of leakage of the toner is increased, and the operator can easily perform the connecting operation.

Moreover, the container unit 521 includes the 2nd restricting unit to the door 521*c*. The effectiveness of prevention of unsuitable operation by the inexperienced person can be heightened by this, and toner management including quality can be performed appropriately. As the 2nd restricting unit, the cylinder-type lock or the electronic lock may be used as mentioned above.

Figure 34:
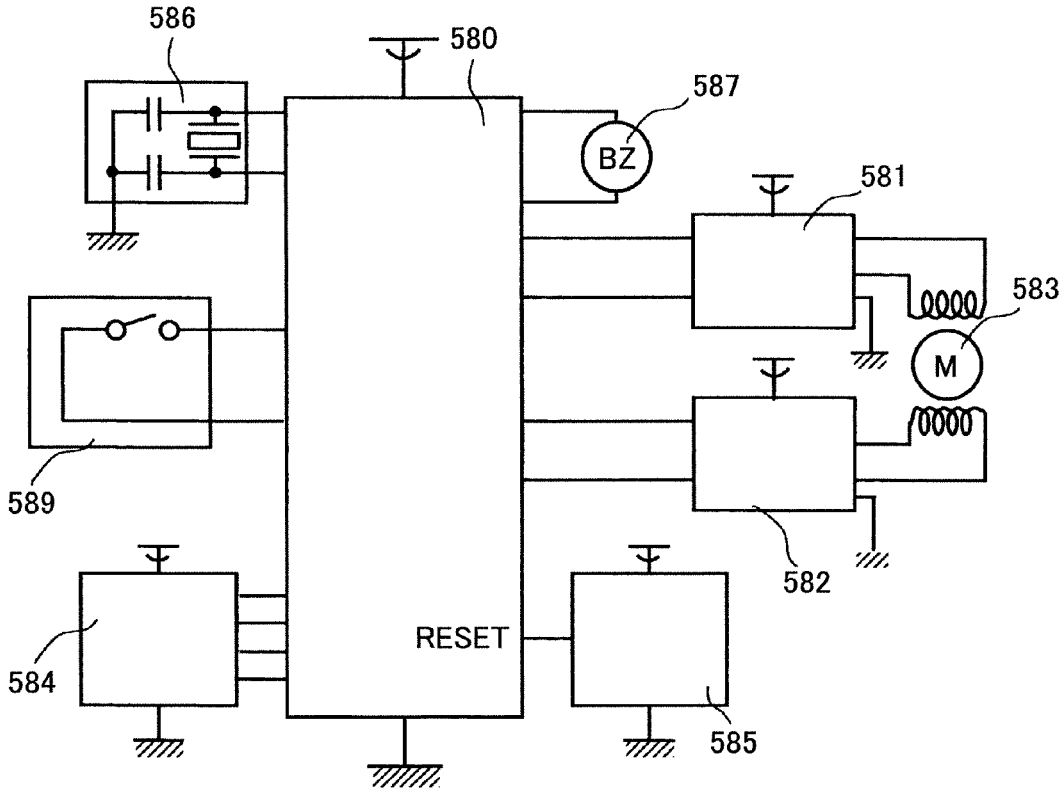
FIG. 34 is a diagram showing the electric circuit of the electronic lock in the case of having a drawer connector.

FIG. 34 shows the electric circuit of the electronic lock in the case of having a drawer connector. As shown in FIG. 34, the MPU (microprocessor) 580, stepping motor 583, motor drive circuits 581 and 582, EEPROM 584, power-on-reset circuit 585, time constant circuit 586 for clock oscillation, and electronic buzzer 587 are the same as those of the above embodiment.

In FIG. 34, reference numeral 589 indicates a circuit which recognizes connection of a drawer connector. If the powder storing unit 531 is accommodated in the container unit 521 and the door 521*b* of the container unit 521 is shut, connection of the door 521*c* of the container unit 521 and the powder storing unit 531 is provided by the drawer connector 579. If the connection of the drawer connector 579 is recognized, detection information will be transmitted to MPU 580 and locking will be made.

As the condition for canceling the restriction of the 2nd restricting unit in order to allow separation of the powder storing unit 531 from the powder-storing-unit container part 520*a*, there may be provided the condition that the amount of the remaining powder in the powder storing unit 531 is below a predetermined amount. Namely, periodical or constant monitoring of the toner residual amount in the powder storing unit 531 is performed by the sensor 538, and the detection result of the sensor 538 is converted into an electrical signal. The signal is transmitted to the electronic lock each time the toner residual amount in the powder storing part 532 becomes below the predetermined amount so that the condition of the powder storing part 532 is changed to a near end condition, the unlock conditions of the electronic lock are removed, and it can unlock by key actuation of a subsequent operator. Thereby, while playing the role of a double key, the prevention effectiveness of unprepared opening and closing can be heightened, and safety can be increased more. The effectiveness of the exchange work can be improved by being interlocked with the opening and closing at the time of toner exchange.

Figure 35:
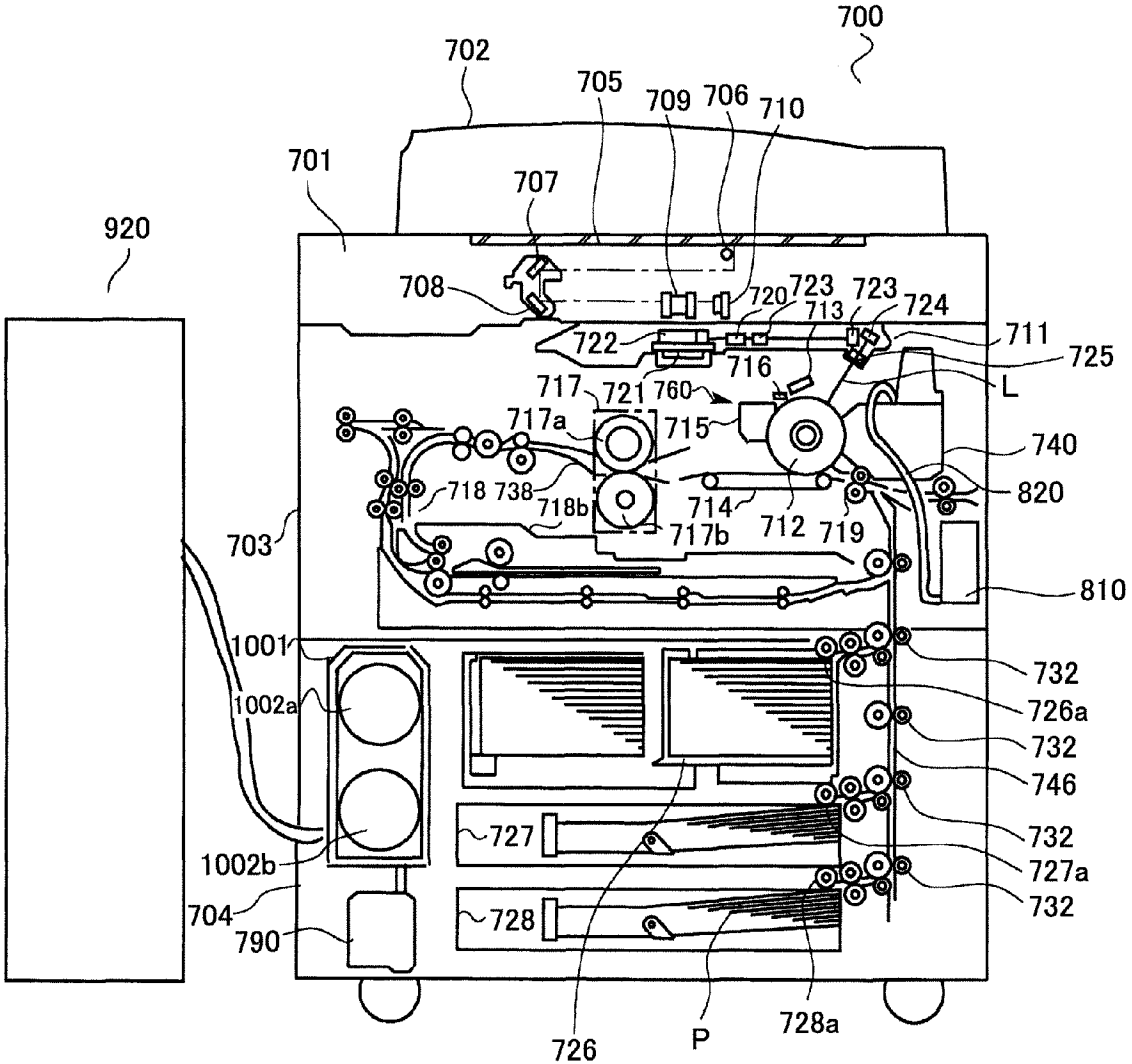
FIG. 35 is a diagram showing the composition of an image forming device in an embodiment of the invention.

FIG. 35 shows the outline composition of an image forming device in an embodiment of the invention. As shown in FIG. 35, the document reading part 701 and the automatic document feeder part 702 are provided in the upper part of this image forming device 700. The printer part 703 and the sheet feeding part 704 are provided in the bottom of the document reading part 701. Near the image forming device 700, powder supply device 920 which supplies a toner to the image forming device is formed.

In this embodiment, although powder supply device 920 is formed with image forming device 700 and another object, it is also possible to install this powder supply device 920 in image forming device 700 inside. The automatic document feeder part 702 supplies automatically the document which is laid in the top face and which is not illustrated on the below-mentioned contact glass 705. The document reading part 701 reads the image of the document which is not illustrated.

After the document has been placed by a user's manual operation on contact glass 705 fixed to the upper part of document reading part 701, shortly after the start switch which is not illustrated is operated, document reading by document reading part 701 is started.

When the start switch is pressed after a document is placed on the automatic document feeder part 702, the document is automatically fed to the contact glass 705 and the document reading is started by the document reading part 701. Optical illumination of the document placed on the contact glass 705 by the start of document reading is carried out by light source 706 which is moved in the right direction in FIG. 35.

The reflected light image from the document is reflected one by one by the 1st mirror 707 and the 2nd mirror 708. And after passing through image-formation lens 709, it is detected by image sensor 710 which includes a CCD for reading a reflected light image etc., and image information is read.

The printer part 703 forms the toner image as an image on a copy sheet P which is an image recording medium. An optical writing unit 711 which is an exposure unit and a drum-like photoconductor 712 which is a latent-image support object are provided in the printer part 703. Charging unit 713, developing device 740, drum cleaning device 715, and electricity discharging unit 716 are provided in the vicinity of photoconductor 712. Process unit 760 is provided with photoconductor 712, developing device 740, drum cleaning device 715, and electricity discharging unit 716. Development hopper 745 is provided in the upper part of the developing device 740 integrally with the developing device 740. Transfer transporting unit 714 is provided under the photoconductor 712. Belt cleaning device 710 is provided near the transfer transporting unit 714. Fixing device 717 and inversion delivery unit 718 are provided in the left-hand side of the transfer transporting unit 714.

Upon depression of the start switch, the rotation of the photoconductor 712 is started by the driving unit which is not illustrated. The optical writing unit 711 which is an exposure unit carries out light modulation of the laser beam L based on the image signal read by the document reading part 701, and exposes the photoconductor 712 which is a latent-image support object. Specifically, the laser beam L emitted by the light source 720 which includes a laser diode etc., and this laser beam L passes along the scan image-formation lens system 723 including the fθ lens while it is deflected in the main scanning direction (the axial direction of the photoconductor 712) on the polygon mirror 722 rotated by the polygon motor 721.

And the laser beam L passing through the mirror 724 and the lens 725 reaches the surface of the photoconductor 712 rotated, and forms an electrostatic latent image on the surface.

In the transfer transporting unit 714, the transfer transporting belt is wound under tension between two or more rollers. This transfer transporting belt being moved by the rollers forms the transfer nip part in contact with the circumference of the photoconductor 712.

The transfer bias roller which is not illustrated contacts the rear surface of the transfer transporting belt in the transfer nip part. Transfer bias voltage is applied to this transfer bias roller by the power source which is not illustrated, and a transfer electric field is formed in the transfer nip by the applied bias voltage.

After the electrostatic latent image formed on the photoconductor 712 by exposure of the optical writing unit 711 is developed by the developing device 740 and made into a toner image, it is moved to the transfer nip part. The resist roller pair 719 provided in the lower right location of the photoconductor 712, pinches, between the rollers, the copy sheet P sent from the sheet feeding part 704 in response to the pressing of the start switch. And the copy sheet P is sent out to the timing which can be laid on top of the toner image on the photoconductor 712 in the transfer nip part.

By sending of the copy sheet P, the toner image formed on the photoconductor 712 is fixed to the copy sheet P in the transfer nip part. And the toner image of the photoconductor 712 surface is transferred by the copy sheet P surface by the nip pressure in the transfer electric field and transfer nip part by a transfer bias roller.

The copy sheet P which passed the transfer nip part is sent in fixing device 717 with the transfer transporting belt of transfer transporting unit 714. The fixing device 717 puts the copy sheet P sent with the transfer transporting belt between heating roller 717*a* and pressurizing roller 717*b*. And the sheet is delivered to a toner image to the delivery unit 718 under the heat of each roller, and the effect of pressure, being provided on copy sheet P.

The inversion delivery unit 718 delivers the copy sheet P to the discharge path 718*a* at the paper output tray of the device exterior. However, when the double-sided copy mode is chosen by the user, after the copy sheet P is inverted by the inversion part 718*b*, the copy sheet P is transported to the resist roller pair 719. Thereby, the copy sheet P is again sent from the resist roller pair 719 to the transfer nip, so that a new toner image is transferred to the surface of the copy sheet which is opposite to the surface where the previous toner image is transferred. After the remaining toner adhering to the surface of the photoconductor 712 after passing the transfer nip part is cleaned by the drum cleaning device 715, it is stored in the recovery tank 790 which is a powder recovery container through the inside of a recovery path.

The photoconductor 712 surface after cleaning is discharged by the electricity discharging unit 716, and it is again charged uniformly by the charging unit 13 in preparation for a next image formation.

Three sheet paper cassettes 726, 727, and 728 by which multi-stage allocation is carried out are formed in the sheet feeding part 704. A number of copy sheets P are accommodated in each sheet paper cassette. The transporting passage which has two or more transporting roller pairs 732 is provided.

Sheet paper cassettes 726, 727, and 728 are pressing feed rollers 726*a*, 727*a*, and 728*a* against copy sheet P accommodated in the inside, and send out copy sheet P to a transporting passage by the rotation. Upon pressing of the start switch, a copy sheet from one sheet paper cassette is delivered to the transporting passage. The copy sheet P received by the transporting passage is sent to the resist roller 719 of the printer part by the transporting roller pair 732. The developing device 740 provided in the side of the photoconductor 712 is opened for free passage by the powder supply device 920 provided outside the image forming device 700, the 2nd transport tube 860 and the transport passage 850, and the toner transport passage which includes the transport tube 820. The toner in the powder storing unit 921 is supplied to the development hopper 745, provided in the developing device 740, by the powder transporting unit which comprises the toner bank 1010 provided in the toner transport passage, the toner transport passage, the subtank 810, and the powder pump 830.

Specifically, the toner in the powder supply device 920 is collected through the 2nd transport tube in the toner bank case 1011 accommodated in the toner bank 1010. The toner within the toner bank case 1011 is supplied via the transport tube 820 to the development hopper 745 of the developing device 740 via the transport passage 850 by the powder pump 830 in the subtank 810.

In the developing device 740, the 2-component developing agent containing a toner and a magnetic carrier is accommodated. Mixed churning is carried out with the internal 2-component developing agent, and the toner which passed through the transport passage and is supplied in developing device 440 is used for a processing procedure. T sensor which is not illustrated is provided in the base of developing device 740. This T sensor outputs to the control unit (which is not illustrated) the signal according to the permeability of the 2-component developing agent in the developing device 740.

Since the toner density of the 2-component developing agent has a relation correlated with permeability, the T sensor can detect the toner density of the 2-component developing agent. The control unit is operating suitably the powder pump 830, the drive motor of transport passage 850, etc. so that the output signal from the T sensor may be brought close to a predetermined command, and it recovers the toner density of the 2-component developing agent to which toner density is reduced with development.

However, since the permeability of the 2-component developing agent is changed by environmental variations, such as humidity, height change of the 2-component developing agent, etc., the control unit corrects the above-mentioned command suitably.

Specifically, a command is corrected according to the image concentration of the criteria toner image formed on photoconductor 712 to predetermined timing. About this image concentration, it is grasped by the output from the reflection type photosensor (P sensor) which detects the rate of a light reflex of a criteria toner image, for example etc.

The transfer remaining toner which is not transferred by the copy sheet has adhered to the surface of drum-like photoconductor 712 which passed the above-mentioned transfer nip. This transfer remaining toner is scratched by drum cleaning device 715, and is collected by recovery tank 790.

Figure 36:
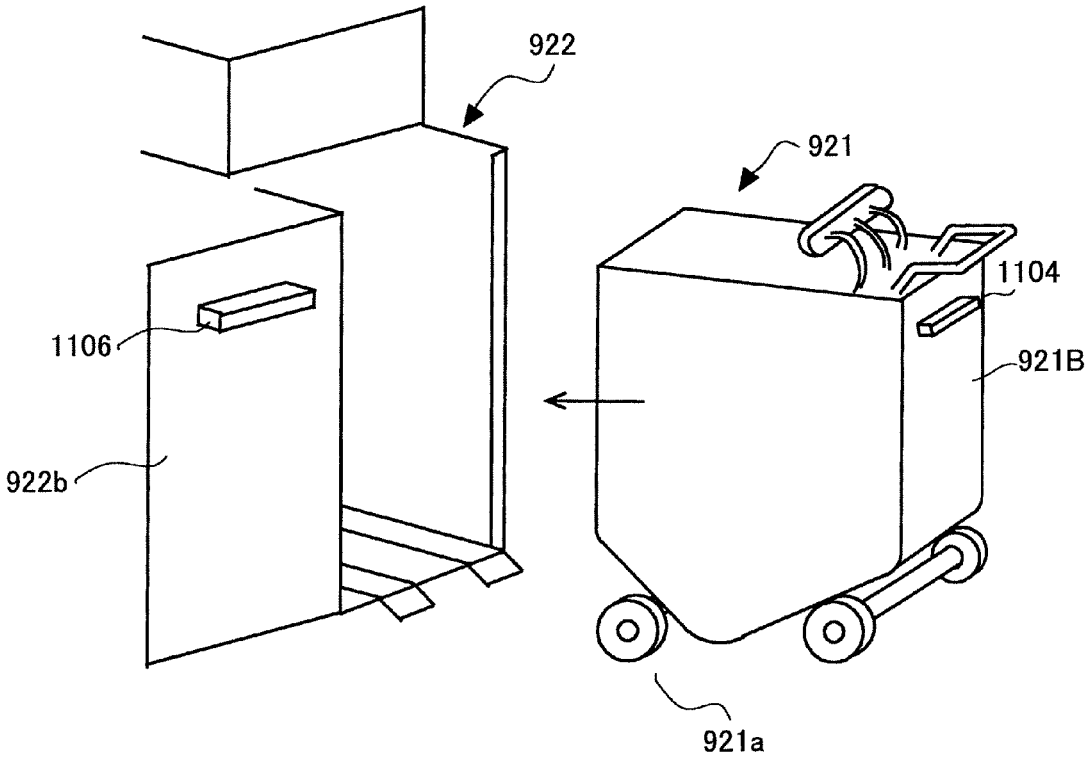
FIG. 36 is a diagram showing the condition that a powder storing unit is about to be accommodated in a container unit.

FIG. 36 is a schematic diagram showing the condition that a powder storing unit is about to be accommodated in a container unit. In FIG. 36, the powder supply device 920 comprises the powder storing unit 921 which stores the toner supplied to the image forming device 700, and the container unit 922 which accommodates the powder storing unit 921. The powder storing unit 921 is constituted to be detachably attached to the powder supply device 920.

Figure 37:
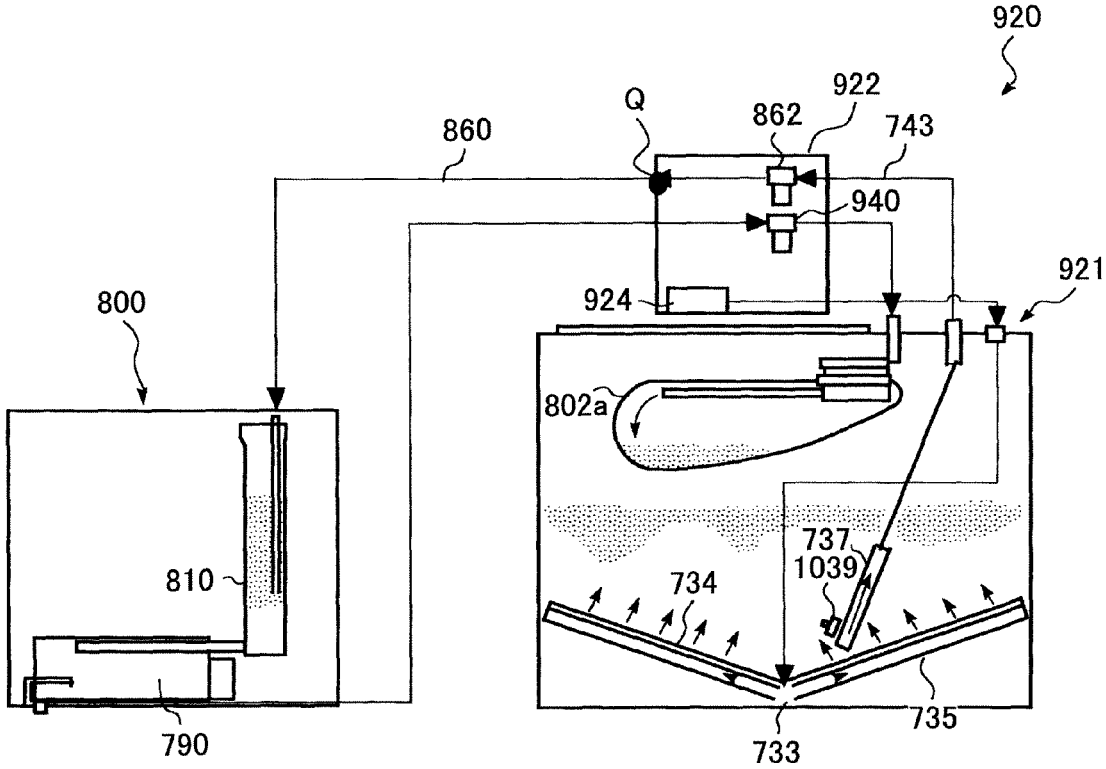
FIG. 37 is a diagram for explaining the internal structure of a powder storing unit and a container unit.
Figure 38:
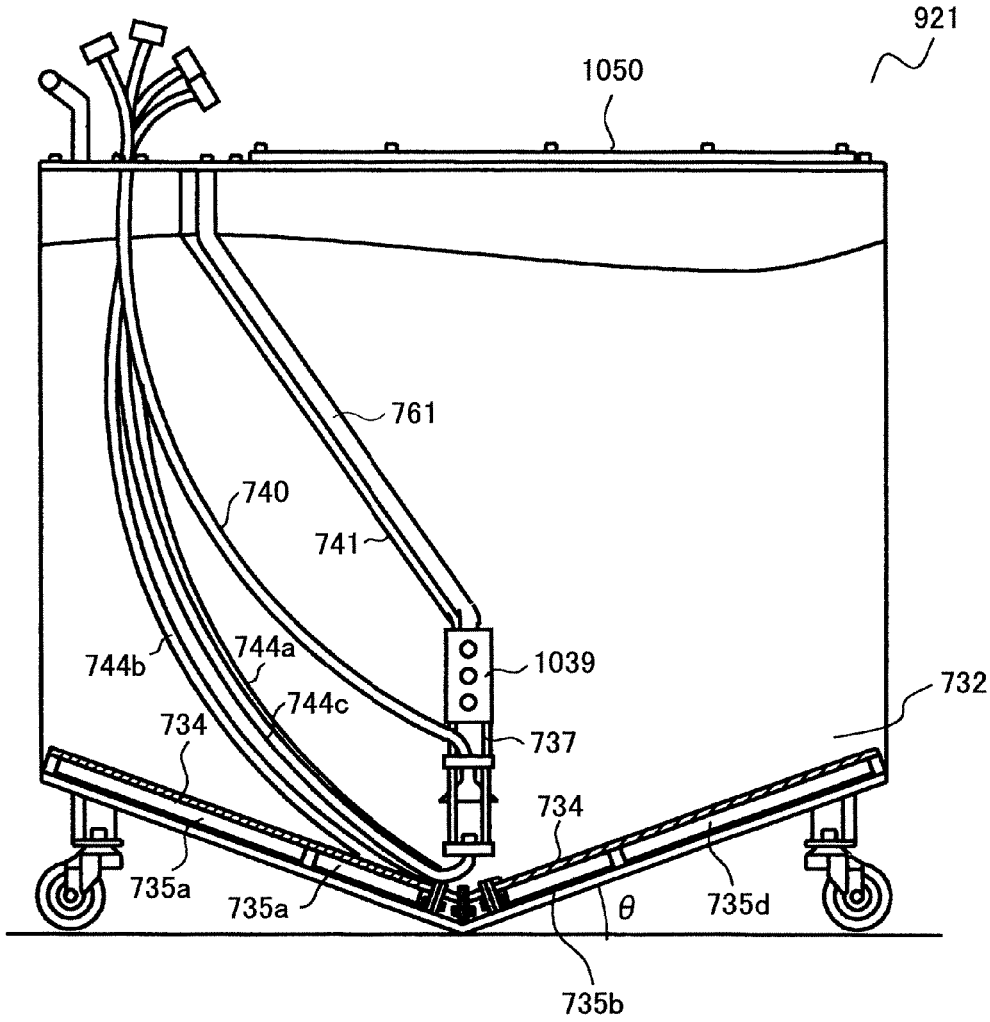
FIG. 38 is a diagram showing the internal structure of the powder storing unit.

FIG. 37 is a diagram for explaining the internal structure of the powder storing unit and the container unit. FIG. 38 is a diagram showing the internal structure of the powder storing unit 921.

As shown in FIG. 37, provided in the container unit 922 of the powder supply device 920 are a suction pump 862 which attracts the toner accommodated in the powder storing unit 921 and discharges the toner to the toner bank 1010, a gas supplying pump 924 which supplies air to the gas blowout part 732 (FIG. 38), and a suction pump 940 which attracts and transports the toner collected in the recovery tank 790, to the waste toner bottle 802*a*.

In this embodiment, the diaphragm type air pump is used as the suction pump 862. This suction pump 862 may be replaced with the one-axial off-center screw pump which will be mentioned later.

As shown in FIG. 38, provided in the powder storing unit 921 are a suction tubing 737, a relay part 733, a gas blowout part 732 including four chambers 735*a*-735*d*, a porous member 734, four tubes 740 and 744*a*-744*c* made of a flexible silicone rubber, a 2nd gas blowout part 762, a hold component 765 holding the 2nd gas blowout part 762, a suction tubing 737, a detection unit to detect the amount of the remaining toner in the powder storing unit 921, a support member 761 which supports the cable 747 (harness line) electrically connected to the toner residual amount sensor 1039 and the toner residual amount sensor 1039, the toner residual amount sensor 1039, the hold component 765 and cable 747. The toner as powder is accommodated in the powder storing part 731.

The volume average particle diameter of the toner stored is in a range of 3-15 micrometers. The powder storing part 731 is formed so that the horizontal cross-section thereof is in the shape of a rectangle, and the toner is stored with the maximum storage capacity.

The bottom of the powder storing unit 921 is formed into the V-shaped slope which is inclined such that the neighborhood of the center part is at the lowest location. That is, the cross-section of the bottom of the powder storing unit 921 is formed in the shape of a V character. It is provided in the bottom of powder storing unit 921 so that gas blowout part 732 may meet the slope. The slope of the bottom of powder storing unit 921 is set as the inclination angle smaller than the angle of repose (inclination angle which a toner slips down) over the toner to accommodate.

Specifically, the resting angle of toner is about 40 degrees, and the inclination angle of the slope is set to about 20 degrees. Thus, it can prevent that can make the dead space by dip small, a toner deposits only in the lowest location of a slope, and the density of the location becomes high too much by setting up the inclination angle of a slope gently.

The gas blowout part 732 includes a relay part 733, a porous member 734, four chambers 735*a*-735*d*, etc., and discharges gas to the inside of the powder storing unit 921. The cross-section (which intersects perpendicularly with the jet direction of air) of the gas blowout part 32 is formed in the shape of a rectangle. The porous member 734 of the gas blowout part (fluid membrane) 732 is formed so that the hole size thereof is smaller than the particle diameter of the toner, and it is provided in the base which touches the toner in powder storing unit 921 directly.

The air sent out from the gas supplying pump 931 of the powder supply device 920 is sent to the porous member 734 via the tubes 744*a* and 744*b* and the chambers 735*a*-735*d*, and the porous member 734 serves as an exhaust outlet of the air to the powder storing unit 921.

The porous member 734 includes a fine porous material which lets air pass, and the open area ratio of the porous member 734 is in a range of 5 to 40%. More desirably, it is in a range of 10 to 20%. The average opening diameter of the porous member 734 is set to be in a range of 0.3-20 micrometers. More desirably, it is in a range of 5-15 micrometers. The diameter of the hole part of the porous member 734 is 0.1 to 5 times as large as the volume average particle diameter of the toner. More desirably, it is 0.5 to 3 times as large as the volume average particle diameter of the toner.

As a porous material, porosity resin materials, such as glass, a sintered body of a resin particle, resin by which photoetching is carried out, and resin punched thermally, metal sintered bodies, the metal plate-like material by which punching is carried out, a net layered product, etc. can be used, for example.

By discharging air to the toner in powder storing unit 921 via porous member 734, the density of a toner can be reduced constantly, a toner can be mobilized and bridge construction of a toner can be prevented.

Since it is to some extent strong, although toner enters into the hole part of the porous member 734, the toner does not invade in the chamber, does not close the hole part, or does not create air pressure whose weight per toner particle is minute and which is applied to the porous member 734.

The chamber provided under the porous member 734 comprises four chambers 735*a*-735*d* which became independent, respectively. The 1st chamber 735*a* and the 2nd chamber 735*b* adjoin relay part 733 provided in the lowest location at the bottom (slope).

The air after branching by relay part 733 via a contact button, relay tubing which is not illustrated, and the 2nd tube 744*b* from gas supplying pump 924 is sent out to the 1st chamber 735*a* from an ejection hole (not illustrated).

The air after branching by relay part 733 via a contact button, relay tubing, and the 2nd tube 744*b* from gas supplying pump 924 is sent out to the 2nd chamber 735*b* from an ejection hole. The air breathed out by the 1st chamber 735*a* and the 2nd chamber 735*b* blows off near the lowest location at the bottom (slope) via porous member 734. The 3rd chamber 735*c* and the 4th chamber 735*d* adjoin the 1st chamber 735*a* and the 2nd chamber 735*b*, respectively.

The air after branching by relay part 733 via a contact button, relay tubing, and the 1st tube 744*a* from gas supplying pump 924 is sent out to the 3rd chamber 735*c* from the ejection hole.

The air after branching by relay part 733 via a contact button and the 1st tube 744*a* from gas supplying pump 924 is sent out to the 4th chamber 735*d* from an ejection hole.

The air breathed out by the 3rd chamber 735*c* and the 4th chamber 735*d* blows off in locations other than near the lowest location at the bottom via porous member 734.

The acreage (acreage of the contact surface which touches porous member 734) or the volume of the 1st chamber 735*a* and the 2nd chamber 735*b* is set up become smaller than acreage or the volume of the 3rd chamber 735*c* and the $4^{th}$ chamber 735*d*.

The gas blowout part is constituted so that the gas jetting volume of the unit time near the lowest location of the slope (the location where the 1st chamber 735*a* and the 2nd chamber 735*b* are disposed) per unit area. It becomes larger than the gas jetting volume of the unit time per unit area in the other location (location in which the 3rd chamber 735*c* and the 4th chamber 735*d* are disposed).

Since the density of toner in the neighborhood of the lowest location of the slope becomes high easily compared with the other location (upper location including the uppermost position), can equalize the fluidity of the toner can be equalized efficiently in the whole slope by providing a difference in the gas jetting volume in the gas blowout part according to the location of the slope.

In this embodiment, the plurality of chambers (the 1st chamber 735*a*, the 2nd chamber 735*b*, the 3rd chamber 735*c* and the 4th chamber 735*d*) are provided in the gas blowout part, gas is independently fed into two or more chambers from the gas supplying pump 924, and the difference in the gas jetting volume is formed by the location of the slope.

The difference in the gas jetting volume provides the difference in the acreage (acreage or volume of the chambers 735*a*-735*d*) of the gas blowout part 732 from which gas blows off, and is formed in it. In order to form the difference in the gas jetting volume, the method of installing the porous members (with different hole sizes or the number of pores differing) which is otherwise different in the location which wants to form the difference in the gas jetting volume can be used, or the method of establishing a difference can also be used for the air pressure sent out from the gas supplying pump 924.

The gas jetting volume of the unit time near the lowest location of a slope (location in which the 1st chamber 735*a* and the 2nd chamber 735*b* are disposed) per unit area in order to ensure above-mentioned effectiveness. It is preferred to set up by 1.1 to 2 twice the gas jetting volume of the unit time per unit area in the other location (location in which the 3rd chamber 735*c* and the 4th chamber 735*d* are disposed).

Even if the residual amount of suction tubing 737 (suction opening) of the toner in powder storing unit 921 decreases, it is provided above relay part 733 (the lowest location of a slope) so that a toner can be attracted efficiently. The suction tubing 737 is connected to the end (suction opening) of suction pump 862 via suction tube 743, a contact button, and relay tubing.

The other end (ejection hole) of suction pump 862 is connected to toner bank 1010 of an image forming device via discharge tube 860. That is, the powder discharge path of resulting in the suction pump 862 from the powder storing unit 921 with the suction tubing 737, the suction tube 743, and the contact button is formed.

The powder discharge path of reaching toner bank 1010 from suction pump 862 with the 2nd transport tube 860 is formed. When the suction pump 862 operates, the toner in powder storing unit 821 will be attracted from suction opening 737*a* of the suction tubing 737, and will be transported to the toner bank 1010 (supply destination) via the suction pump 862.

Since the suction tube 743 and the 2nd transport tube 860 are formed by low silicone rubber of toner affinity, the non-conformity to which the toner adheres to and toner transport nature falls into the tube is deterred.

The degree of freedom of the layout of powder storing unit 921, suction pump 862, and toner bank 1010 will increase by forming some or all of a powder suction channel and a powder discharge path by flexible tubes 740 and 741.

Figure 39:
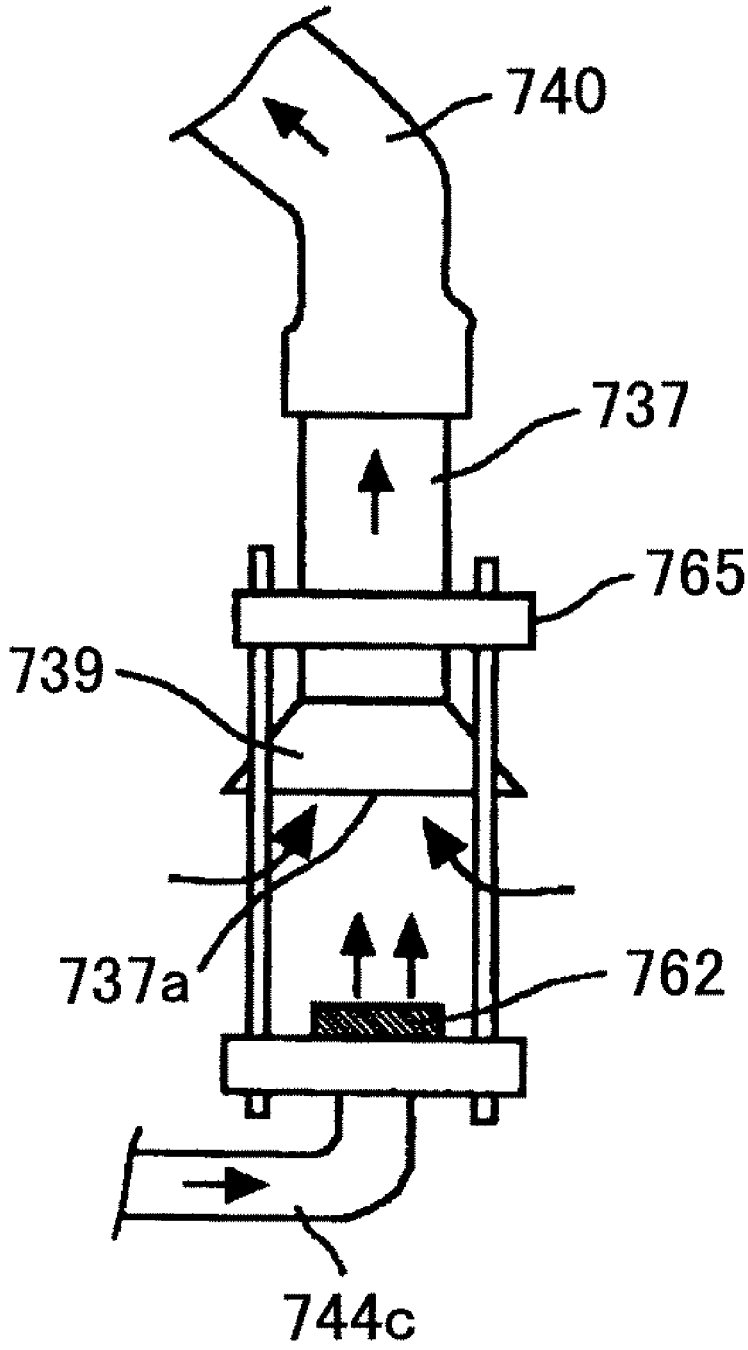
FIG. 39 is an enlarged diagram showing the composition of the suction tubing vicinity in FIG. 38.

FIG. 39 shows the configuration of the suction tubing 737 vicinity shown in FIG. 38. The suction tubing 737 is being fixed to hold component 765 supported by support member 761 in FIG. 39. Under the suction tubing 737, the 2nd gas blowout part 762 held at hold component 765 is provided. Hold component 765 and support member 761 appoint the location of the 2nd gas blowout part 762 to suction tubing 737 while appointing the location of suction tubing 737 in powder storing unit 921.

The 2nd gas blowout part 762 discharges the air sent out from gas supplying pump 924 via a contact button or the 3rd tube suction opening 737*a* of suction tubing 737, and near the toner residual amount sensor 1039.

The 2nd gas blowout part 762 is formed by the porous member. The 2nd gas blowout part 762 can also be formed via the above-mentioned chamber. The porous member of the 2nd gas blowout part 762 is formed with the same material as porous member 734 of jet generating part 732.

The toner transport characteristic improves without mobilizing the toner and a stick arising by this, by suction tubing 737, suction pump 862, suction tube 743, and the 2nd transport tube 860, while the density of the toner near the suction opening 737*a* of the suction tubing 737 falls. The toner about the toner residual amount sensor 1039 will be mobilized, and the detection performance of the toner residual amount sensor 1039 will be stable.

In the above-mentioned embodiment, air is blown off near the toner residual amount sensor 1039 near the suction opening 737*a* of the suction tubing 737 using the 2nd gas blowout part 762.

On the other hand, the gas blowout part which discharges air near the suction opening 737*a* of suction tubing 737, and the gas blowout part which discharges air near the toner residual amount sensor 1039 can also be provided independently.

The 2nd gas blowout part 762 can also be formed in one with jet generating part 732 for which it is prepared by the bottom of powder storing unit 921.

In FIG. 39, the flow adjusting member 739 is provided in the suction opening 737*a* of the suction tubing 737. This flow adjusting member 739 is a funnel-like component formed so that the effective area product of the suction opening becomes large, and makes the suction force of the suction opening 737*a* increase.

As shown in FIG. 38, the wrap filter 1050 (air omission component) is provided in the top face of the powder storing unit 921. The filter 1050 prevents the internal pressure of the powder storing unit 921 from rising, preventing that the toner in the powder storing unit 921 leaks out outside.

The material that is the same as the material of the porous member 734 may also be used for the filter 1050. Alternatively, a sheet of "Gore-Tex" (the registered trademark; produced by Japan Gore-Tex Co.) which is a continuation porous-structure object made of fluororesin can also be used.

If the filter 1050 is located above the waterline of the full-condition toner in the powder storing unit 921, it may be placed at any location (for example, the side face) other than the top face of the powder storing unit 921.

In FIG. 38, the toner residual amount sensor 1039 comprises three piezo-electric sensors disposed separately in the perpendicular direction side by side.

The piezo-electric sensors are held at the case supported by support member 761. Three cables electrically connected to the piezo-electric sensors, respectively band together within a case, are supported by the support member as one bundle of cable, and are electrically connected to the control unit of image forming device 700 via the connector and the cable.

The toner residual amount sensor 1039 divides the toner residual amount in powder storing unit 921 into three steps, and tells a user about it. With the piezo-electric sensor installed in the upper row of toner residual amount sensor 1039, when detected as there being no toner in the location (height), the message which indicates that there is little residual amount of the toner in the powder storing unit 921 is displayed on the display screen of the image forming device 700 (pre-near end designation).

Next, when detected as there being no toner in the location (height) by the piezo-electric sensor installed in the middle of toner residual amount sensor 1039, the message which indicates that there is almost no residual amount of the toner in the powder storing unit 921 is displayed on the display screen of the image forming device 700 (near end designation).

When detected as there being no toner in the location (height) by the piezo-electric sensor installed in the lower berth of toner residual amount sensor 1039, the message which indicates that there is no residual amount of the toner in the powder storing unit 921 is displayed on the display screen of the image forming device 700 (toner end designation).

Simultaneously, it controls to stop the toner suction with pump 722 until the exchange work of powder storing part 731 is completed. Next, the transport passage of the toner from powder supply device 920 to developing device 740 will be explained.

Figure 40:
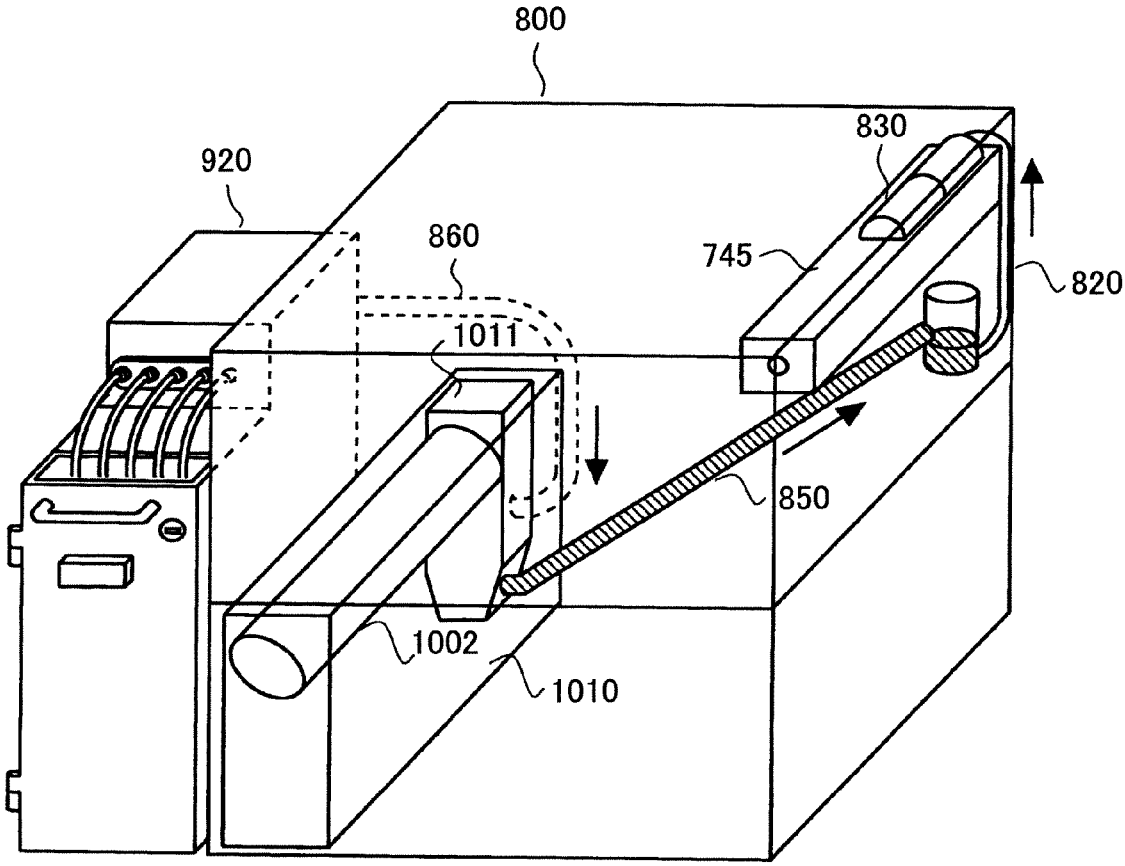
FIG. 40 is a diagram showing the transport passage of toner inside the image forming device and the powder supply device in this embodiment.

FIG. 40 shows the transport passage of the toner inside the powder supply device in this embodiment, and an image forming device. As shown in FIG. 40, in the transport passage from powder supply device 920 to developing device 740, it has powder pump 830, subtank 810 which is the 2nd toner storing part, and toner bank case 1011 which is the 1st toner storing part.

The powder pump 830 and subtank 810 are connected by transport tube 820, and subtank 810 and toner bank case 1011 are connected with transport tubing 850. The toner bank case 1011 and powder supply device 920 are connected by the 2nd transport tube 860. The 2nd transport tube 860 comprises flexible construction material.

One end of the 2nd transport tube 860 is connected to the top side face of powder supply device 920, and the other end of the 2nd transport tube 860 is connected to the bottom side face of toner bank 1010.

One end of transport tubing 850 is connected to the bottom side face of a toner bank case, and the other end of transport tubing 850 is connected to the top side face of subtank 810.

The transport tubing 850 is mostly prolonged on the straight line toward the subtank from the toner bank case. In the transport tubing 850, transport coil 851 which is a feeding unit is formed, and the toner within a toner bank case is transported to subtank 810 by rotating the transport coil 851 using the transport coil drive motor (not illustrated). The transport tube 820 comprises a flexible construction material.

One end of transport tube 820 is connected to the bottom side face of a subtank, and the other end of transport tube 820 is connected to the suction opening of powder pump 830.

The transport tube 820 is arranged in few clearances between the subtank and the device side face, and the neighborhood near the terminal area part with a subtank of a terminal area part with powder pump 830 is curving.

Figure 41:
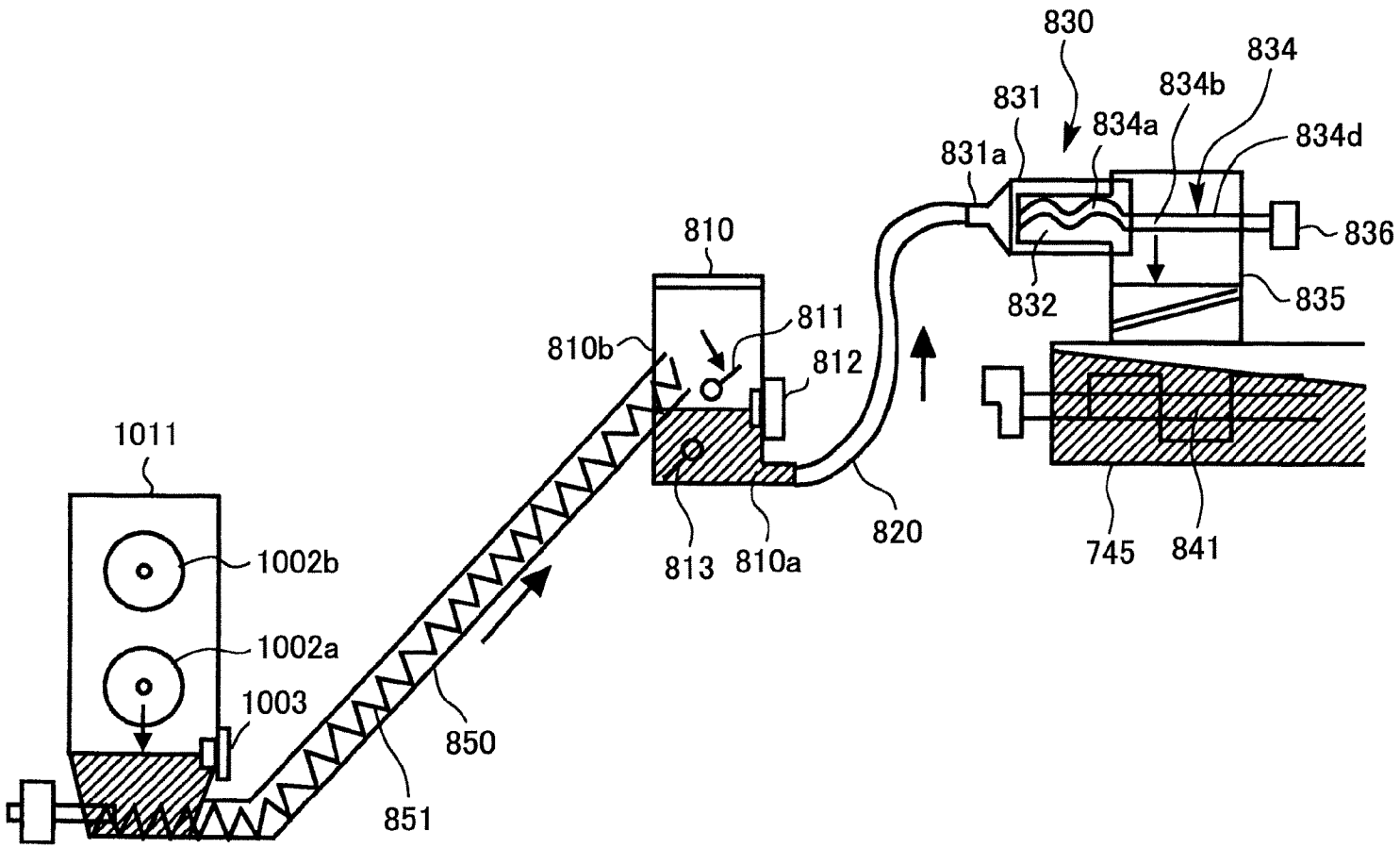
FIG. 41 is a diagram showing the structure between a toner bank and a developing hopper in the image forming device of this embodiment.

The structure of subtank 810 will be explained with reference to FIG. 41. FIG. 41 shows the structure between the toner bank 1010 and the development hopper 745 in the image forming device of this embodiment.

In FIG. 41, the agitator 813 for subtank which is a stirring unit for agitating the toner which collected in subtank 810 is formed in subtank 810. The agitator 813 for subtank comprises a revolving shaft and an agitation member fixed to the projection projecting from the revolving shaft.

This agitation member comprises deformable laminated components, such as a resin film, and has the opening. The subtank 810 has a toner amount detection sensor 812 for subtank which detects the toner amount in the subtank.

The toner amount detection sensor 812 for subtank is the upper part from terminal area 810*a* with transport tube 820, and is arranged below rather than terminal area 810*b* with transport tubing 850.

When the toner amount detection sensor 812 for subtank detects those with a toner by arranging up rather than terminal area 810*a* with transport tube 820, the terminal area 810*a* with transport tube 820 can be covered with a toner. Therefore, when attracting the toner in a subtank with a powder pump, attracting air with a toner is lost and decline in carrying efficiency can be controlled.

When the toner is collected up rather than terminal area 810*b* with transport tubing 850, the toner amount made to store in subtank 810 increases too much, and large driving torque is needed for making agitator 813 for subtank rotate. For this reason, the nonconformity which the agitator drive motor for subtank enlarges will arise.

The sensor surface cleaning member 811 for subtank which cleans the surface of toner amount detection sensor 812 is formed in subtank 810. The sensor surface cleaning member 811 for subtank is formed with the wire rod attached to the revolving shaft, and the revolving shaft includes a picking component.

Next, the powder pump 830 will be explained with reference to FIG. 41 and FIG. 42.

Figure 42:
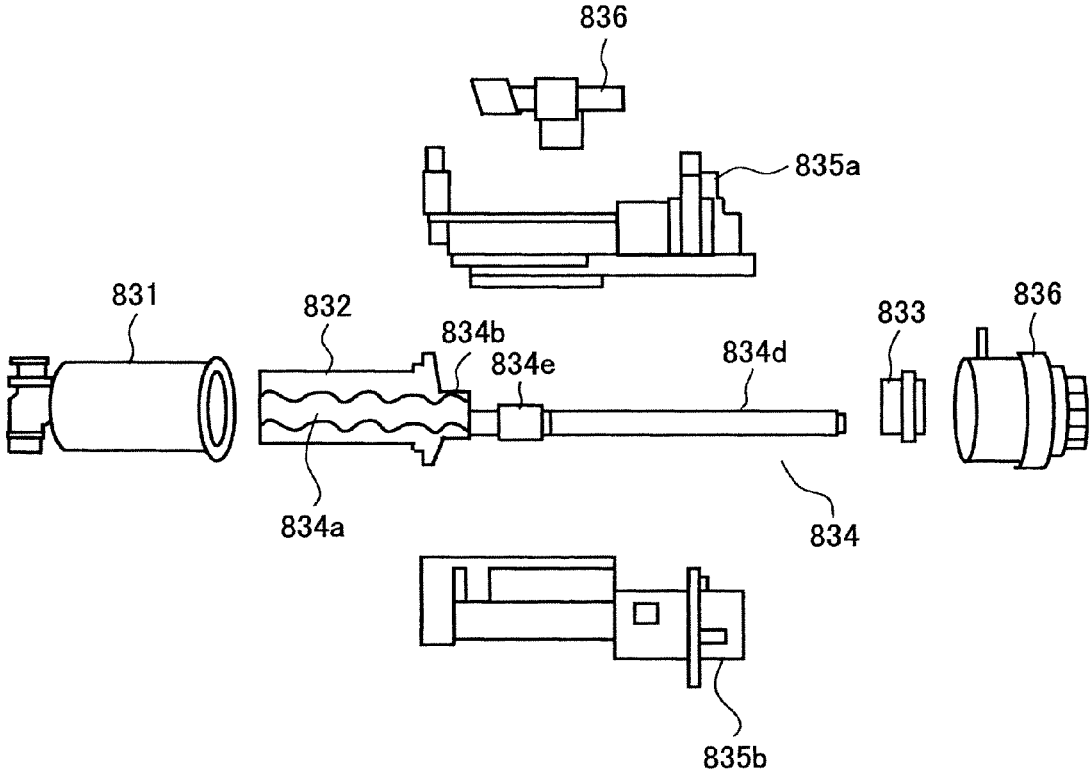
FIG. 42 is an exploded view of a powder pump.

FIG. 42 is an exploded view of powder pump 830. In this embodiment, powder pump 830 attracts the toner in subtank 810, and it is formed in order to supply a toner to development hopper 745 of developing device 740.

As an establishment mode of a powder pump, it is not restricted to this and can install in other parts suitably if needed.

As powder pump 830, a one-axial off-center screw pump of revolution positive displacement is used. Since a one-axial off-center screw pump of revolution positive displacement does not transport powder with air like an air pump type, it needs to provide a large-scale omission unit in neither the subtank 810 nor the powder pump, and can make the image forming device compact.

Since suction/discharge force is strong, a toner is not easily got blocked and the toner transport characteristic stabilized over temporality can be maintained. The powder pump 830 has a stator 832 which includes an elastic body, such as rubber, and has a through hole in the shape of a double-spiral internal thread, and a rotor 834 in which a one-axial off-center screw part 834*a* is provided.

The screw part 834*a* of rotor 834 is inserted in the through hole of stator 832 pivotally. The nickel plate is given to the inner circumference side of the through hole of stator 832 so that it may not wear out by attrition with a toner or a one-axial off-center screw part 834*a*.

The stator 832 has fitted in with the inner circumference side of cap 831. The suction opening 831*a* is formed in the left-hand side of the cap 831, and the transport tube 820 is connected to this suction opening 831*a*. The rotor 834 has joint part 834*b* in the right side end part of screw part 834*a*.

As shown in FIG. 42, the revolving shaft 834*a* is attached to the shaft end of the joint part 834*b* with the spring pin 834*e*. The bearing 833 and the clutch 836 are attached to the right side end part of the revolving shaft 834*d* of the rotor 834. It connects with the powder pump drive motor which is not illustrated, and clutch 836 is made to rotate rotor 834.

The case 835 is attached to the toner blowdown side edge part of the cap 831. The case 835 includes the top case 835*a* and the lower case 835*b*, as shown in FIG. 42.

The left side end part of top case 835*a* and the left side end part of lower case 835*b* are made to contact the toner blowdown side edge part of the cap 831, respectively. By making the right side end part of top case 835*a*, and the right side end part of lower case 835*b* contact bearing 833, respectively, top case 835*a* and lower case 835*b* are inserted in.

After top case 835*a* and lower case 835*b* have suited, by cover member 836, top case 835*a* and lower case 835*b* are held, and it fixes. The opening 837 is provided in the underside of the case 835, and this opening 837 is attached to opening 847 of the development hopper 745.

Figure 43:
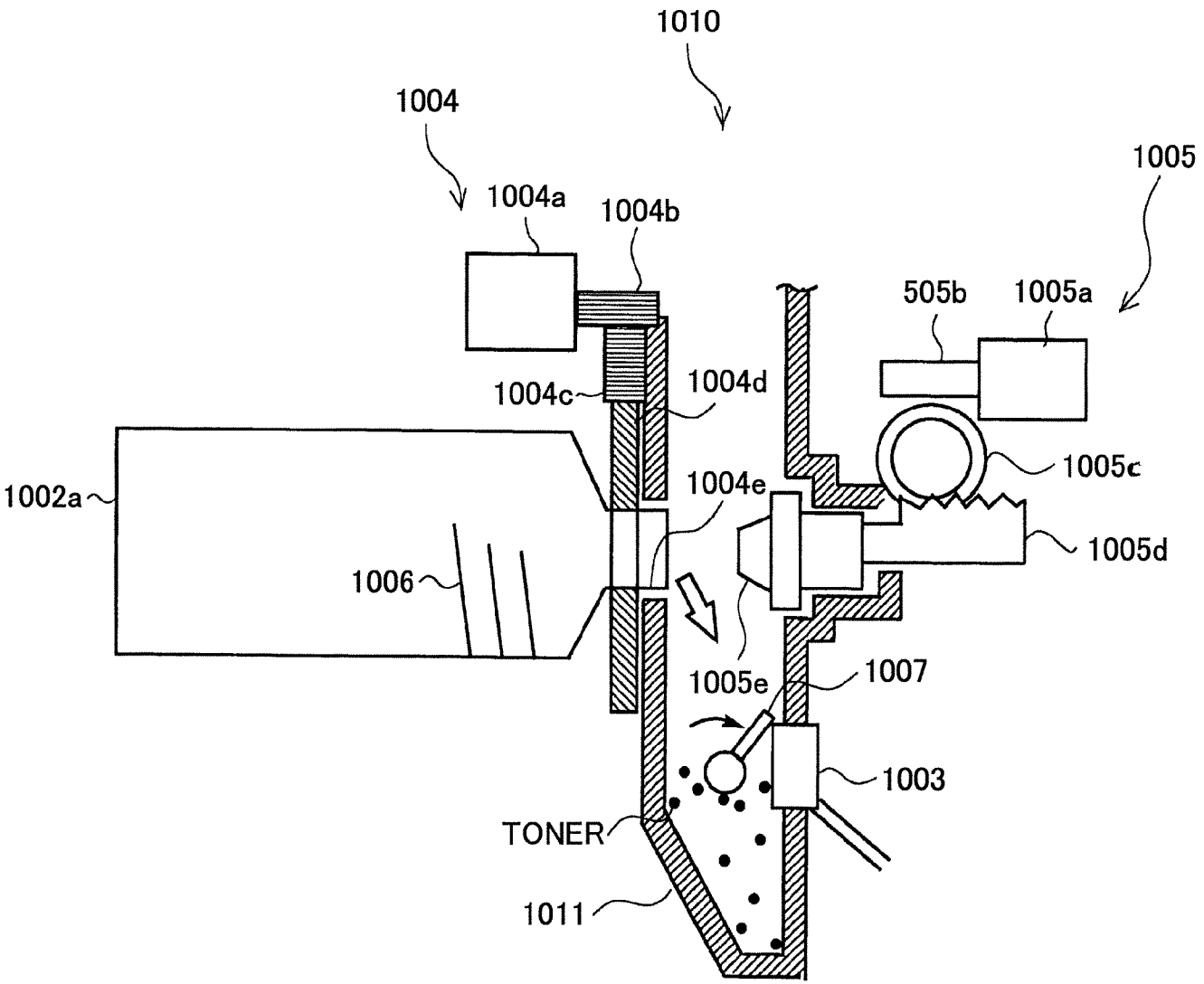
FIG. 43 is an enlarged diagram showing the internal structure of a toner bank.

Next, the internal structure of the toner bank 1010 will be explained. FIG. 43 shows the internal structure of the toner bank 1010.

As shown in FIG. 41, the side face of toner bank case 1011 is provided with toner bottles 1002*a* and 1002*b* which are filled up with toner, and the toner bank case 1011 is provided with the toner bottles 1002*a* and 1002*b* by the same device.

FIG. 43 shows a part of the toner bottle 1002*a* with which the lower side face of the toner bank case 1011 is provided. The bottle drive unit 1004 for rotating a toner bottle is provided in the upper part of this toner bottle 1002*a*.

The bottle drive unit 1004 includes the bottle drive motor 1004*a*, the motor reduction gear 1004*b*, the idler reduction gear 1004*c* that is engaged with the motor reduction gear, the wearing opening 1004*e* for equipping with opening of the toner bottle, and the actuation reduction gear 1004*d* which is engaged with the idler reduction gear.

The bottle opening closing gear 1005 is provided in toner bottle opening and the location which counters. The bottle opening closing gear 1005 is engaged with the bottle opening-and-closing drive motor 1005*a*, motor reduction gear 1005*b*, opening-and-closing reduction gear 1005*c* that is engaged with a motor reduction gear, and an opening-and-closing reduction gear, and includes pinion 1005*d* which has cap part 1005*e* which plugs up bottle opening at a head. The bottle opening is closed by cap part 1005*e* when not supplying the toner in a toner bottle.

Under the toner bank case 1011, the toner is stored and toner amount detection sensor 1003 for toner bank which detects the amount of this stored toner is provided.

When it is detected that there is no toner in the predetermined height in this toner amount detection sensor 1003 for toner bank, the bottle opening-and-closing drive motor 1005*a* drives, and it is made to move in the direction which separates the cap part 1005*e* from the bottle opening. Thereby, the bottle opening is opened.

When the bottle opening is opened, the bottle opening-and-closing drive motor 1005*a* will be made to drive and the toner bottle 1002*a* will be rotated. The spiral projection 1006 is provided in the toner storing part wall of the toner bottle 1002*a*. By revolution of the toner bottle 1002, the toner in the storing part is guided by the projection 1006, moved to the bottle opening, and falls from the bottle opening to the toner bank case 1011.

If the toner amount detection sensor 1003 for toner bank detects that the toner is in the predetermined height, the revolution of the toner bottle 1002*a* will be suspended, the cap part 1005*e* will be moved, and the bottle opening will be closed.

As shown in FIG. 43, the sensor surface cleaning member 1007 for toner bank which cleans the surface of the toner amount detection sensor 1003 for toner bank may be provided.

The sensor surface cleaning member 1007 for toner bank has the same structure as that of the sensor surface cleaning member 811 for subtank shown in FIG. 41. It can control the surface of toner amount detection sensor 1003 for toner bank becoming dirty with a toner, and stopping achieving a detection function.

The toner attracted by the suction tubing 737 is stored by the toner bank case 1011 of the toner bank 1010 through the 2nd transport tube 860 from the powder storing unit 921. When the toner in the toner bank 1010 are collected in the subtank 810 by transport passage 850, they pass along transport tube 820 and are transported by suction of powder pump 830 in development hopper 745 (refer to FIG. 40).

The toner transported in development hopper 745 is suitably supplied to the developing tank 746 based on the output signal of the T sensor provided in the developing tank 746, and a processing procedure is performed.

Figure 44:
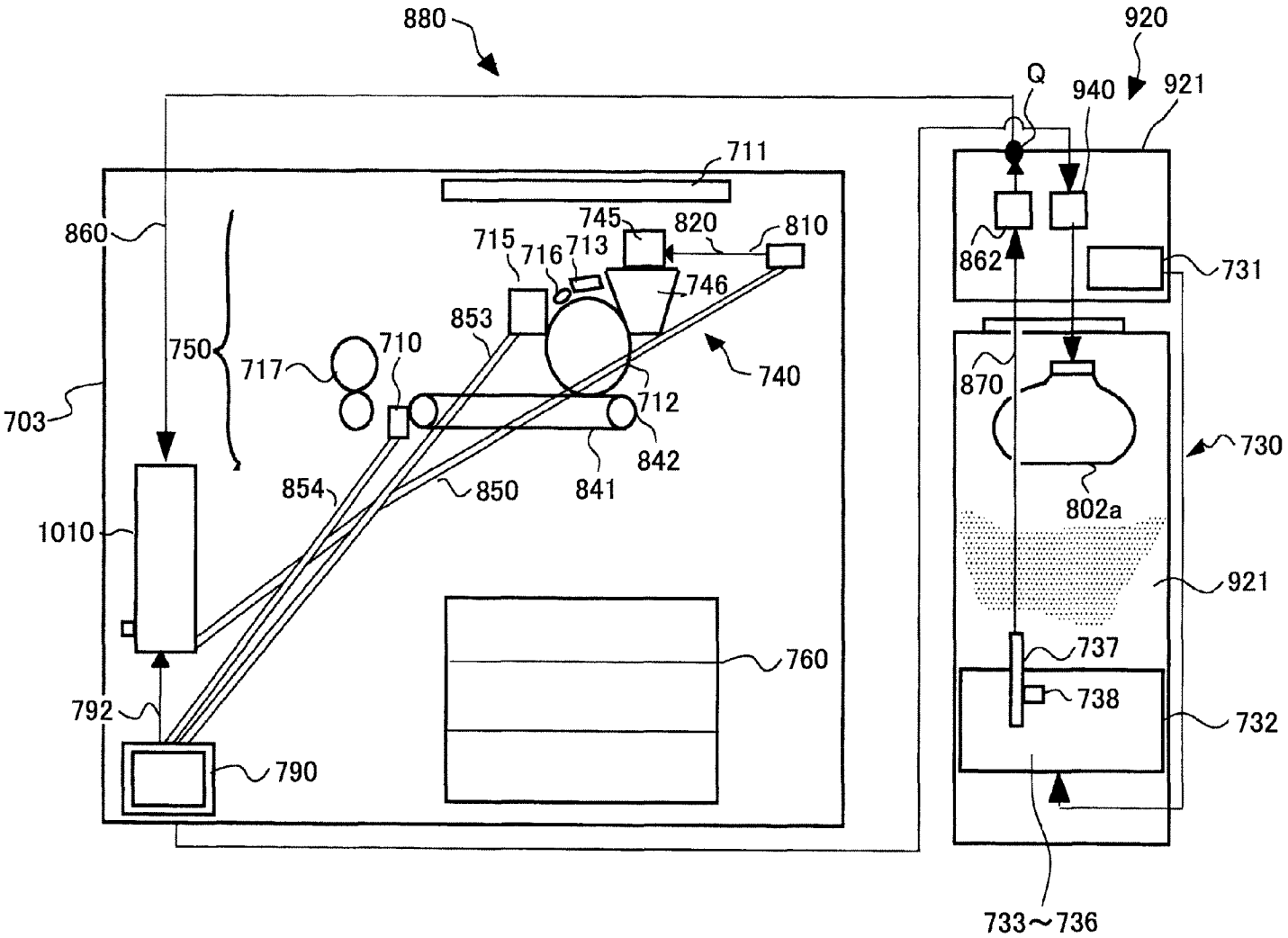
FIG. 44 is a diagram showing the internal structure of the powder supply device and the image forming device in this embodiment.

With reference to FIG. 35 and FIG. 44, the transport passage of the toner in the recovery tank will be explained.

FIG. 44 shows the configuration inside the image forming device in this embodiment, and a powder supply device. In FIG. 44, the non-transferred toners collected with drum cleaning device 715 are once collected by recovery tank 790 via recovery path 853.

Similarly, the toners collected with belt cleaning device 710 are also once collected by recovery tank 790 via recovery path 854. The toner collected by recovery tank 790 is transported via recovery path 791 in the waste toner bottle 802*a* provided in powder storing unit 921 by suction of the suction pump 940 provided in the container unit 7222.

The 3rd gas blowout part (fluid membrane) which has a porous member is provided in the bottom of recovery tank 790. The air sent out from the air pump provided in the container unit 922 is fed into this 3rd gas blowout part via the tube.

Air blows off from the porous member, the toner collected in recovery tank 790 is mobilized by such structure, and the toner is attracted by suction of pump 940 via a tube, and is transported to the waste-toner recovery container 802*a*.

As the waste-toner recovery container 802*a*, the flexible component (for example, plastic bag) which includes a resin material is used. The waste-toner recovery container 802*a* is attached to a set part with an elastic band etc. The line provided with the exhaust port by which the waste toner is discharged, and the filter as a degassing device which discharges the air fed into the inside are provided in the set part. Thus, the line and the filter can be attached to the recovery container 790 by actuation by providing the line (exhaust port) and the filter in the set part.

The toner in the waste toner bottle 802*a* are collected with exchange of powder storing unit 921, and are newly used as a recycle toner.

As shown in FIG. 44, recovery tank 790 and toner bottle 1002 in toner bank 1010 are connected by recovery path 792.

The toner collected in recovery tank 790 is transported in toner bottle 1002 via recovery path 792, and is again used in image forming device 700. By forming the toner bank 1010 other than subtank 810 as the intermediate storing part, the toner collected from cleaning device 715 and belt cleaning device 710 in recovery tank 790 is refluxed in an image forming device according to recovery path 792, and a recovery toner can be used effectively.

It is also possible to establish the recovery path which connects recovery tank 790 and subtank 810, and to have structure which transports the toner collected in the recovery tank 790 in the subtank 810.

It is also possible to establish the recovery path which connects recovery tank 790 and development hopper 745, and to have structure which transports the toner collected in the recovery tank 790 in development hopper 745.

In the above-mentioned embodiment, this invention is applied to the powder supply device 720 which supplies a toner to the toner receiving unit. This invention is also applicable to a powder supply device which supplies a 2-component developing agent which contains a toner and a carrier to the powder receiving unit. In that case, a permeability sensor can also be used as a detection unit to detect the amount of the remaining 2-component developing agent in the powder receiving unit.

As shown in FIG. 36, the powder supply device 920 of this embodiment comprises powder storing unit 921 and container unit 922. The IC chip 1104 which is an electronic information recording unit is provided in the tooth back 921B of the powder storing unit 921. The non-contact IC reader/writer 1106 which is an electronic information transmitting unit is provided in the container unit 922.

Figure 45:
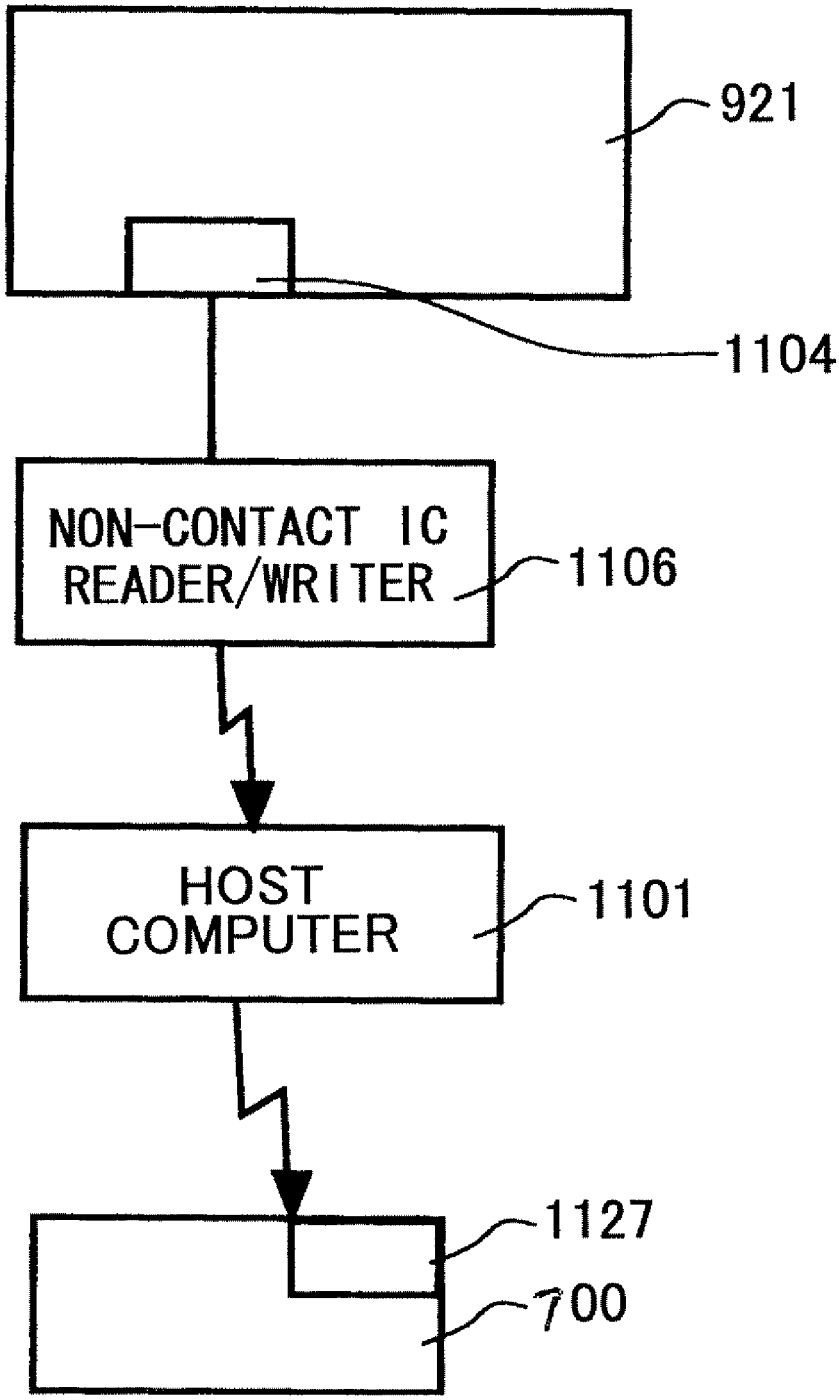
FIG. 45 is a block diagram showing the composition of a powder storing unit, a non-contact IC reader/writer (electronic information transmitting unit) and a control unit.

FIG. 45 shows the connection between powder storing unit 921, and non-contact IC reader/writer 1106 and control unit 1127. As shown in FIG. 45, image forming device 700 as a terminal unit is connected to host computer 1101.

By the non-contact IC reader/writer 1106 and non-contact, electromagnetic coupling of IC chip 1104 which non-contact IC reader/writer 1106 is connected to host computer 1101, and is provided in powder storing unit 921 is carried out, and it can communicate. The ID information of powder storing unit 921 recorded on IC chip 1104 is inputted into host computer 1101 via non-contact IC reader/writer 1106.

The identification information for identifying the powder currently stored in the identification information for identifying a powder storing unit or a powder storing unit is recordable on IC chip 1104.

It is also possible to record the identification information for identifying the identification information and powder for identifying a powder storing unit on IC chip 1104. For example, it is possible to record at least one of a model and a serial number of the powder storing unit 921 as the identification information of the powder storing unit 921, and record at least one of a model of powder, a serial number, a production date, a filling date, and a powder supplier identifier as the identification information of the powder in the powder storing unit 921.

The identification information recorded on the IC chip 1004 is not limited to the above mentioned one. For example, it is also possible to record information, including the information about the composition information on a toner, the activity term of validity, service temperature, etc., the number of times of utilization permission of the toner in powder storing unit 921, utilization permission time, etc.

Figure 46:
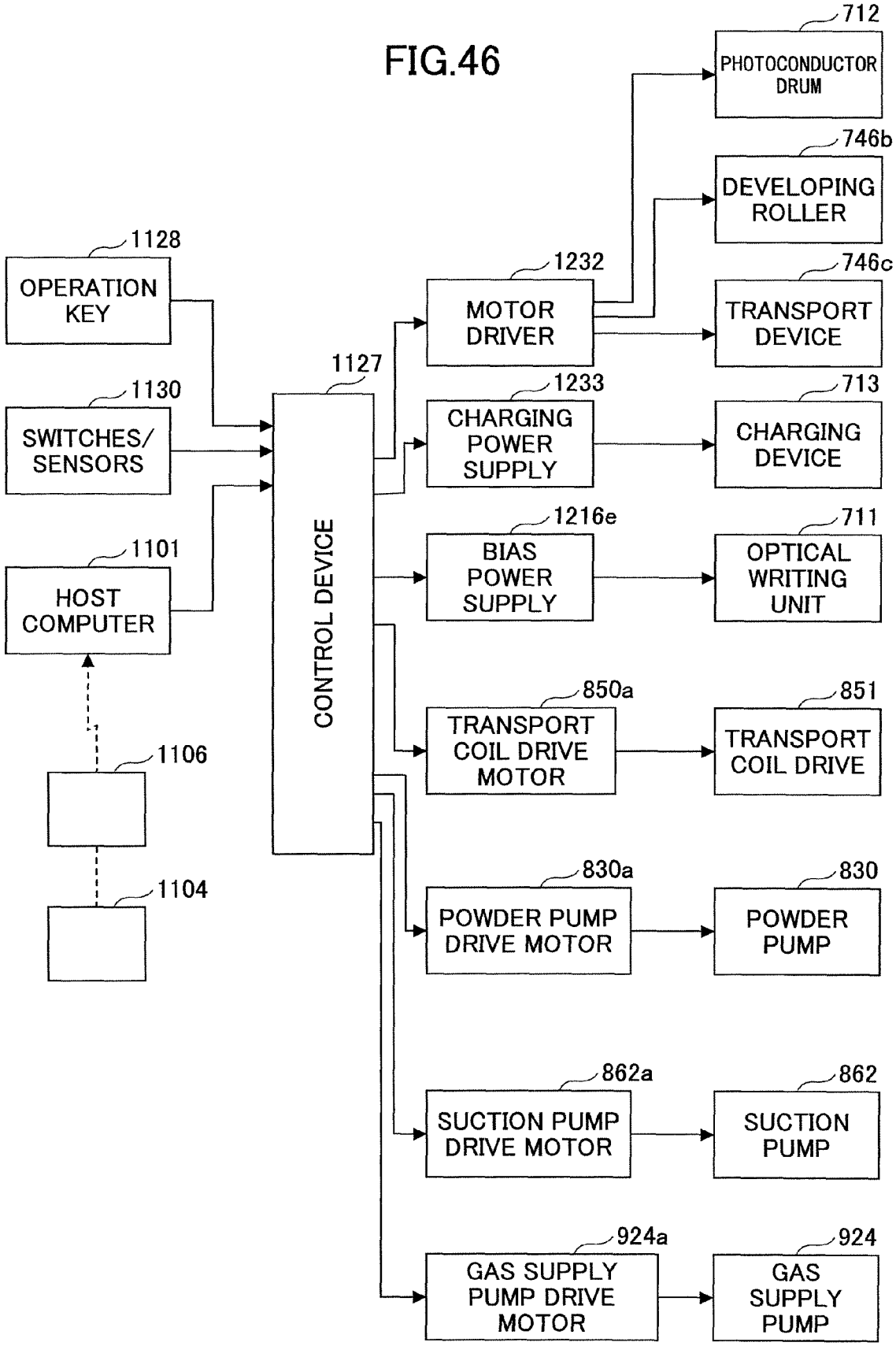
FIG. 46 is a block diagram showing a part of an electronic circuit of the image forming device in this embodiment.

Next, the electronic system in this embodiment will be explained. FIG. 46 is a block diagram showing the electronic circuit of the image forming device in this embodiment.

As shown in FIG. 46, the control unit 1127 has a CPU, a RAM, a ROM, etc. which are not illustrated, and is provided to control the whole image forming device 700. The actuation key 1128 of the operation panel (not shown) which can input print mode, a seat paper choice, number of sheets, etc., and various switches/sensors 1130 are connected to the input side of control unit 1127.

The host computer 1101 is connected to the input side of control unit 1127. The ID information recorded on IC chip 1104 is transmitted to control unit 1127 with which image forming device 700 is provided with host computer 1101 via the non-contact IC reader/writer 1106.

In the output side of control unit 1127, photoconductor 712, developing roller 746*b*, bias supply 1216*e*, motor driver 1232 which rotates transporting device 746*c* etc., charging power source 1233 which impresses adjustable voltage to charging unit 713, and which impresses adjustable voltage to exposure unit 711. Transport coil drive motor 850*a* of the transport tubing 850 and drive motor 830*a* of the powder pump 830 are connected.

The drive motor of suction pump 862 of container unit 922 and the drive motor of the gas supplying pump 924 are also connected to the output side of control unit 1127.

Next, a circulation delivery system of powder storing unit 921 which is combined with the management and maintenance of the powder transporting unit connected to the powder storing unit 921 will be explained.

First, a manufacturer fills up the powder storing unit 921 with toner at the powder filling factory. Subsequently, the terminal unit and non-contact IC reader/writer 1106 which are not illustrated are used, and the ID information of powder storing unit 921 is written in IC chip 1104 provided in powder storing unit 921.

This ID information is transmitted and recorded also on host computer 1101 via non-contact IC reader/writer 1106. From the operator of the image forming device 700, if exchange of powder storing unit 921 is required, a manufacturer's serviceman will visit this operator and will equip image forming device 700 with the above-mentioned powder storing unit 921.

As shown in FIG. 36, the casters 921*a* are provided in the base of the powder storing unit 921, and as mentioned above, the powder storing unit 921 is constituted by powder supply device 920.

Powder storing unit 921 will be moved to the arrow direction of FIG. 36 by the function of the casters 921*a*, and the operator, such as a serviceman, will be stored in container unit 922, if tooth back 921B is pushed.

Figure 47:
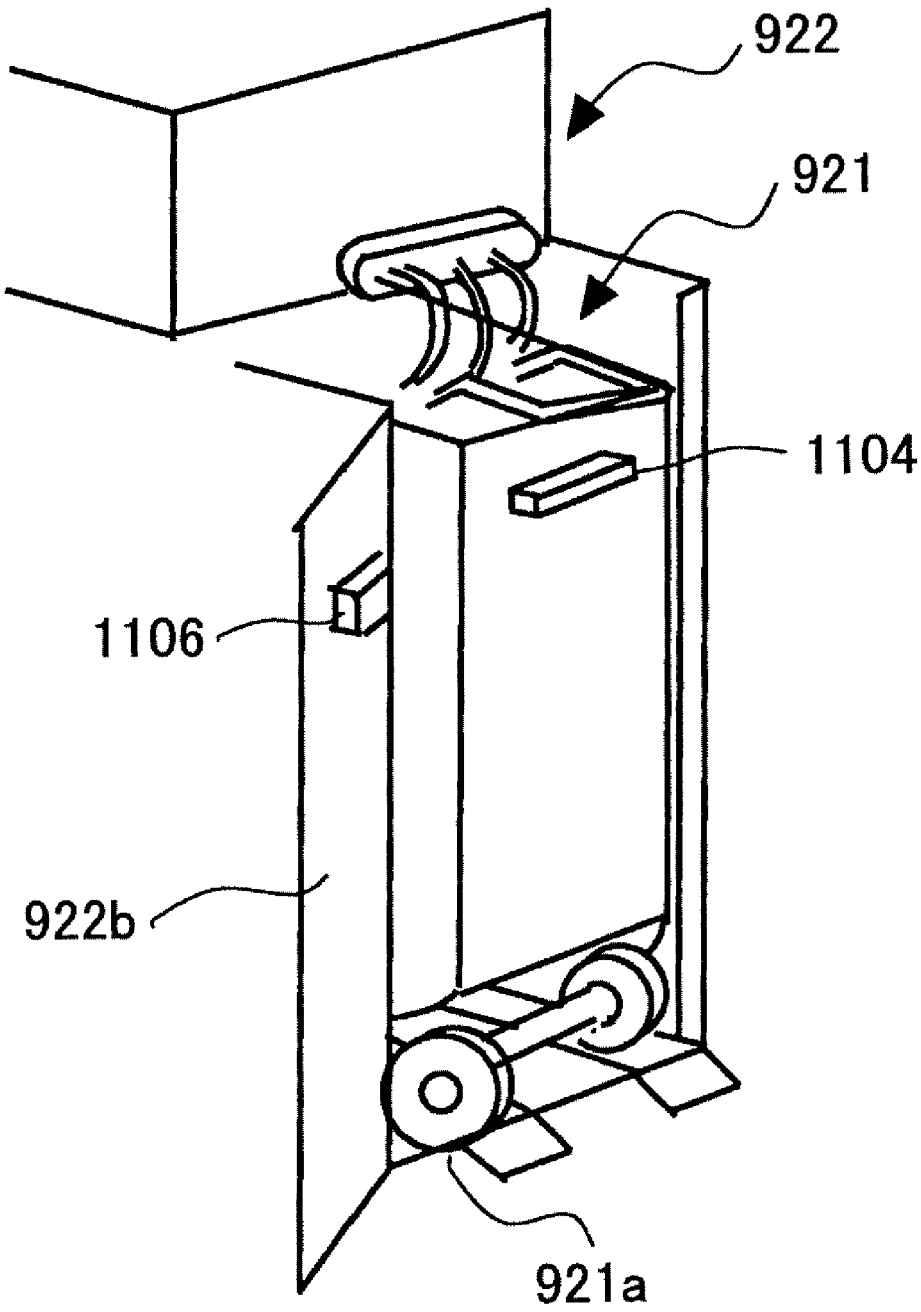
FIG. 47 is a diagram showing the condition after the powder storing unit is accommodated in the container unit.

FIG. 47 shows the condition that powder storing unit 921 is stored in container unit 922. If container unit 922 is provided with powder storing unit 921 with which a new toner is filled up, image forming device 700 will be detected by a detection unit by which this powder storing unit 921 is not illustrated, and will drive non-contact reader/writer 1106.

The non-contact reader/writer 1106 communicates with IC chip 1104, and transmits the ID information recorded on IC chip 1104 to host computer 1101 connected to image forming device 700.

The host computer 1101 transmits this ID information to the control unit 1127 of the image forming device. The ID information is transmitted to the control unit 1127 via the host computer 1101 from the non-contact reader/writer 1106.

With reference to the ID information which is electronic information, it is judged whether the powder storing unit 921 with which it is newly provided is a powder storing unit suitable for carrying out supply operation of the powder transporting unit.

Or the control unit 1127 judges whether the toner currently stored in the powder storing unit 921 with which it is newly provided is suitable as an object supplied to the image forming device 700. In this case, at the powder filling factory, the criteria used are the ID information transmitted and recorded on host computer 1101, when this powder storing unit 921 is filled up with toner.

When the powder storing unit 921 with which it is newly provided is not a powder storing unit suitable for carrying out supply operation of the powder transporting unit, or when the toner currently stored by this powder storing unit 921 is not suitable as an object for feed to the image forming device 700, the control unit 1127 performs control to the image forming device 700 of the powder transporting unit which suspends the action of toner feed.

As a result, when not provided with the powder storing unit of a right class, or when provided with the powder storing unit with which the mistaken toner of the class is filled up, the problem which image forming device 700 breaks down or produces malfunction can be avoided. When the powder storing unit 921 with which it is newly provided is the powder storing unit suitable for carrying out supply operation of the powder transporting unit, or when the toner currently stored by this powder storing unit 921 is suitable as an object for feed to the image forming device 700, the control unit 1127 performs control to image forming device 700 of a powder transporting unit to which the action of toner feed is permitted.

If the toner in the powder storing unit 921 is consumed and it is lost, the user will request the manufacturer to collect the powder storing unit 921, or to newly carry out re-filling of toner into this powder storing unit 921. When degradation of the powder storing unit 921 collected by the manufacturer is remarkable, or when changing the toner class with which it is filled up, the powder storing unit 921 is provided to the powder filling factory, and the IC chip 1104 is read via non-contact reader/writer 1106 connected to host computer 1101 after that.

It is again filled up with the toner corresponding to the read ID information of the powder storing unit 921 with the supplying device. After the manufacturer performs re-filling of the toner to the powder storing unit 921 properly, the manufacturer clears the conventional ID information recorded on the IC chip and writes new ID information thereto. This ID information is recorded also on host computer 1101 via non-contact reader/writer 1106. Then, the manufacturer returns the powder storing unit 921 to the PD process of the circulation delivery system.

By alteration of ID information, without changing other devices etc. after recovery of the powder storing unit 921, since the image forming device 700 used combining powder storing unit 921 can also be changed, efficient activity specific to the circulation delivery system is attained.

In the powder supply device 920 provided with the powder storing unit 921 which can accommodate a mass toner, the powder storing unit 921 into which the toner is filled up at the powder filling factory is delivered from the powder filling factory to the user of the image forming device 700. The toner in the powder storing unit 921 is consumed, and when exchange is required, the used powder storing unit 921 is returned to the powder filling factory from the user.

By adopting such a circulation delivery system for powder storing unit 921, the exchange frequency of the powder storing unit 921 is lessened, and the time and effort for which the operator of image forming device 700 exchanges powder storing unit 921 for operator itself is saved. For this reason, the convenience of the operator of image forming device 700 can be raised more. Using the IC chip 1104 which is the electronic information recording medium which recorded ID information in the circulation delivery system for the powder storing unit 921, and controlling the powder transporting unit of image forming device 700. When the powder storing unit 921 is delivered from the powder filling factory to the user, it can prevent that mistaken powder storing unit 921 is delivered.

When the toner which is mistaken in powder storing unit 921 is filled up with and delivered, the action of a powder transporting unit can be stopped and it can prevent that the toner which is mistaken in image forming device 700 is used. Therefore, it is possible to prevent an image forming device breaking down or carrying out malfunction.

In the above-mentioned embodiment, the control unit 1127 is considered as the structure provided in image forming device 700. It is good also as the structure which forms this control unit 1127 in the container unit 922.

Figure 48:
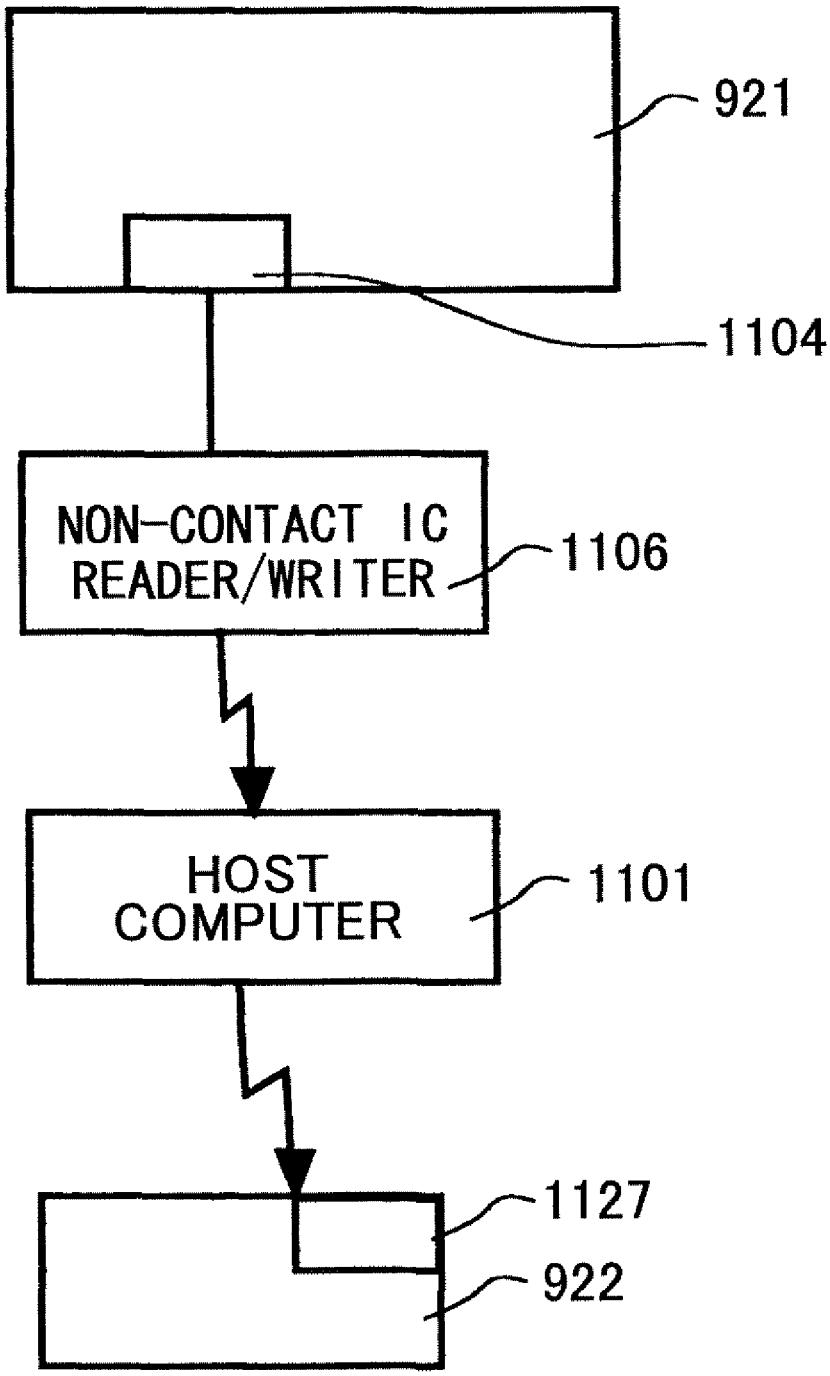
FIG. 48 is a block diagram showing the composition of a powder storing unit, a non-contact IC reader/writer (electronic information transmitting unit) and a control unit.

FIG. 48 shows connection with control unit 1127 to be container unit 922 in this embodiment, and non-contact IC reader/writer 1106. In the image forming device 700 and powder supply device 920 in this embodiment, the same structure as the embodiment of FIG. 45 is taken except the point of forming control unit 1127 in container unit 922.

The IC chip 1104 which is an electronic information recording unit, the non-contact IC reader/writer 1106 which is an electronic information transmitting unit, and the control unit 1127 are considered as the structure provided in the powder supply device 920.

Alternatively, the powder supply device 920 may be provided to control transport feed of the toner from the powder supply device 920 to the image forming device 700 independently.

In the above-mentioned embodiment, it is the structure which equips container unit 922 with non-contact IC reader/writer 1106 which is an electronic information transmitting set. It is also possible to consider non-contact IC reader/writer 1106 as the structure provided in image forming device 700.

In the image forming device 700 and the powder supply device 920 in this embodiment, the same structure as the embodiment of FIG. 45 is taken except the point of forming non-contact IC reader/writer 1106 in image forming device 700. Since it has the non-contact IC reader/writer 1106 which is an electronic information transmitting unit, and the structure provided with control unit 1127 in the image forming device 700, it can have the container unit 922 in the powder supply device 920 as simpler structure.

In the above-mentioned embodiment, the IC chip 1104 provided in the powder storing unit 921 is adopted to a wireless-communications system which performs wireless communication with an external apparatus. Alternatively, the same may be adopted to a wired communications system which performs wired communication with an external apparatus by short-circuiting of terminals of the IC chip and corresponding terminals of the external apparatus by a cable or the like.

The present invention is not limited to the above-described embodiments, and variations and modifications may be made without departing from the scope of the present invention.

Further, the present application is based on and claims the benefit of priority of Japanese patent application No. 2006-066772, filed on Mar. 10, 2006, Japanese patent application No. 2006-065749, filed on Mar. 10, 2006, and Japanese patent application No. 2006-071882, filed on Mar. 15, 2006, the entire contents of which are hereby incorporated by reference.

What is claimed is:

1. An image forming device including an image support object which supports an electrostatic latent image, and a developing device which turns the electrostatic latent image formed on the surface of the image support object, into a visible image with toner, the image forming device comprising:

a powder storing unit storing powder for image formation which is either a developing agent containing a toner and a carrier or a toner; and a powder supplying unit supplying the powder stored in the powder storing unit, to the developing device, the powder storing unit comprising:

a gas supplying unit blowing off a gas from an exhaust outlet of the gas supplying unit into the powder storing unit; and a powder passage allowing the powder storing unit to communicate with the developing device, wherein the gas supply unit includes a jet generating part including a porous member which forms the exhaust outlet, and a gas supplying pump supplying gas to the jet generating part, the jet generating part being connected with the powder storing unit, wherein the image forming device comprises an intermediate powder storing part provided in the powder passage to temporarily store powder received from the powder storing unit, and a downstream powder transporting part provided in the powder passage to transport the powder stored in the intermediate powder storing part, to the developing device.

2. The image forming device according to claim 1, wherein the powder passage comprises:

a suction tubing attracting powder which is agitated in the powder storing unit by the gas supplied by the gas supply unit; and a suction pump generating a negative pressure in the suction tubing to attract the powder from the powder storing unit.

3. The image forming device according to claim 1, wherein the image forming device is provided with a container unit which accommodates the powder storing unit.

4. The image forming device according to claim 1, wherein the gas supplying pump is provided in the powder storing unit.

5. The image forming device according to claim 3, wherein the gas supplying pump and a gas suction pump are provided in the container unit.

6. The image forming device according to claim 3, wherein the container unit is constituted to be integral with the image forming device.

7. The image forming device according to claim 3, wherein the container unit is constituted to be separate from the image forming device.

8. The image forming device according to claim 1, wherein the image forming device comprises a development hopper which stores powder being supplied to the developing device and is provided in the powder passage.

9. A powder storing unit for use in a powder supply device which transports powder to a powder receiving device by mixing the powder to an air flow, the powder storing unit comprising:

a powder storing part to store powder therein;

an opening to supplement powder to an internal space of the powder storing part;

an opening/closing unit that allows or inhibits communication of the internal space of the powder storing part with an outside through the opening;

a restricting unit that prevents removal of the opening/closing unit from the powder storing unit from being performed by an unauthorized user; and a sensor that detects the remaining powder in the powder storing unit, the sensor configured to send an electronic signal to the restricting unit based on the detected amount of powder, wherein the opening/closing unit is a lid which is provided to close the opening, and the restricting unit is an electronic lock which is provided on the lid so that the electronic lock is locked or unlocked in response to electronic information provided by an authorized user, and wherein the restricting unit is provided so that, when an amount of remaining powder in the powder storing unit is below a predetermined amount, the prevention of removal of the opening/closing unit from the powder storing unit by the restricting unit is canceled.

10. The powder storing unit according to claim 9, wherein the opening/closing unit is a lid which is provided to close the opening, and the restricting unit is a fixture which fastens the lid to the powder storing unit.

11. The powder storing unit according to claim 9, wherein the opening/closing unit is a lid which is provided to close the opening, and the restricting unit is a cylinder-type lock which is provided on the lid.

12. A powder supply device which supplies powder for image formation to an image forming device, the powder supply device comprising:

a powder storing unit storing powder for image formation; and a container unit accommodating the powder storing unit, the container unit being constituted to be integral with or separate from the image forming device, wherein the powder storing unit is arranged so that the powder storing unit is detachably connected to a powder transporting unit transporting the powder, stored in the powder storing unit, in a state where the powder is mixed with air, to the image forming device, wherein the powder storing unit includes an electronic information recording unit recording electronic information related to the powder storing unit, and the container unit includes an electronic information transmitting unit transmitting the electronic information related to the powder storing unit, further comprising a control unit provided in the container unit to control powder supply operation of the powder transporting unit, wherein the control unit receives the electronic information from the electronic information transmitting unit, and starts the operation of the powder transporting unit after it is detected that the powder stored in the powder storing unit is suitable for the operation of the powder transporting unit, or that the powder storing unit is suitable for the operation of the powder transporting unit.

13. The powder supply device according to claim 12, wherein the electronic information contains identification information for identifying the powder storing unit and/or identification information for identifying the powder stored in the powder storing unit.

14. The powder supply device according to claim 13, wherein the identification information for identifying the powder storing unit contains at least one of a model and a serial number of the powder storing unit, and the identification information for identifying the powder stored in the powder storing unit contains at least one of a model, a serial number, a production date, a filling date, and a powder supplier identifier of the powder.

15. The powder supply device according to claim 12, wherein, after the powder storing unit is filled up with powder at a powder filling factory, the powder storing unit is delivered to a service location of the image forming device where the powder is used for image formation, and returned to the powder filling factory after the powder in the powder storing unit is consumed at the service location of the image forming device.

16. The powder storing unit according to claim 9, wherein the prevention of removal of the opening/closing unit from the powder storing unit by the restricting unit is canceled when the sensor detects an amount of powder in the powder storing unit that is at least nearly exhausted.

* * * * *

UNITED STATES PATENT AND TRADEMARK OFFICE

CERTIFICATE OF CORRECTION

PATENT NO. : 7,869,746 B2
APPLICATION NO. : 11/683253
DATED : January 11, 2011
INVENTOR(S) : Fumihito Itoh et al.

It is certified that error appears in the above-identified patent and that said Letters Patent is hereby corrected as shown below:

On the title page, Item (54), and column 1, the title is incorrect. Item (54) and column 1 should read:

-- (54) IMAGE FORMING DEVICE, POWDER SUPPLY DEVICE, AND POWDER STORING UNIT INCLUDING A GAS SUPPLYING UNIT --

Signed and Sealed this
Fifth Day of April, 2011

David J. Kappos

David J. Kappos
*Director of the United States Patent and Trademark Office*